US010975663B2

(12) United States Patent
Kratochvil

(10) Patent No.: US 10,975,663 B2
(45) Date of Patent: Apr. 13, 2021

(54) APPARATUS FOR DOWNHOLE FRACKING AND A METHOD THEREOF

(71) Applicant: Key Completions Inc., Calgary (CA)

(72) Inventor: Robert B. Kratochvil, Calgary (CA)

(73) Assignee: Key Completions Inc.

( * ) Notice: Subject to any disclaimer, the term of this patent is extended or adjusted under 35 U.S.C. 154(b) by 28 days.

(21) Appl. No.: 16/405,949

(22) Filed: May 7, 2019

(65) Prior Publication Data

US 2020/0355044 A1 Nov. 12, 2020

(30) Foreign Application Priority Data

May 7, 2019 (CA) ..... CA 3042542

(51) Int. Cl.
*E21B 34/14* (2006.01)
*E21B 43/26* (2006.01)
*E21B 33/12* (2006.01)

(52) U.S. Cl.
CPC ..... *E21B 34/14* (2013.01); *E21B 33/12* (2013.01); *E21B 43/26* (2013.01); *E21B 2200/06* (2020.05)

(58) Field of Classification Search
CPC ..... E21B 34/14; E21B 43/26; E21B 2200/06
See application file for complete search history.

(56) References Cited

U.S. PATENT DOCUMENTS 4,928,770 A * 5/1990 Murray ..... E21B 4/14 166/178
4,928,772 A * 5/1990 Hopmann ..... E21B 34/12 166/332.1
5,123,489 A * 6/1992 Davis ..... E21B 29/00 166/377
5,368,098 A * 11/1994 Blizzard, Jr. ..... E21B 33/127 166/100
5,829,524 A * 11/1998 Flanders ..... E21B 17/08 166/277
6,318,465 B1 * 11/2001 Coon ..... E21B 34/12 166/278
6,554,062 B1 * 4/2003 Dewey ..... E21B 7/061 166/50
7,398,832 B2 7/2008 Brisco
7,766,086 B2 * 8/2010 Mondelli ..... E21B 23/006 166/374
7,789,163 B2 * 9/2010 Kratochvil ..... E21B 33/1265 166/387
7,926,580 B1 4/2011 Darnell et al.
(Continued)

*Primary Examiner* — Aaron L Lembo
(74) *Attorney, Agent, or Firm* — D. Doak Horne

(57) ABSTRACT

A downhole valve has a valve body having at least one port and slidably receiving in a longitudinal bore thereof at least a first sliding sleeve for opening and closing the at least one port. The first sliding sleeve has a circumferential actuation groove. An actuation assembly is extendable into the first sliding sleeve and has an actuation housing axially movably receiving thereon a compressible sealing element and a slip assembly. The slip assembly has one or more slips radially outwardly extendable under a hydraulic pressure for engaging the circumferential actuation groove of the first sliding sleeve for opening the at least one port, and the actuation assembly is longitudinally extendable to position a portion thereof on an inner side of the one or more slips for supporting the one or more slips at a radially outwardly extended configuration.

8 Claims, 33 Drawing Sheets

(56) References Cited

U.S. PATENT DOCUMENTS

| | | | | |
|---|---|---|---|---|
| 8,235,114 | B2 | 8/2012 | Clem et al. | |
| 8,893,810 | B2 | 11/2014 | Zimmerman et al. | |
| 8,899,334 | B2 * | 12/2014 | Merron | E21B 34/14 166/373 |
| 8,978,773 | B2 * | 3/2015 | Tilley | E21B 43/14 166/351 |
| 9,260,939 | B2 * | 2/2016 | Beck | E21B 34/14 |
| 9,284,823 | B2 * | 3/2016 | Kratochvil | E21B 33/124 |
| 9,587,464 | B2 * | 3/2017 | Jani | E21B 43/26 |
| 9,593,535 | B2 * | 3/2017 | Fears | E21B 43/114 |
| 9,752,412 | B2 * | 9/2017 | Shkurti | E21B 23/006 |
| 9,784,071 | B2 * | 10/2017 | Byberg | E21B 34/14 |
| 10,018,015 | B2 * | 7/2018 | Purkis | E21B 33/124 |
| 10,030,477 | B2 * | 7/2018 | Hornsby | E21B 34/12 |
| 10,087,734 | B2 | 10/2018 | Fehr et al. | |
| 10,364,648 | B2 * | 7/2019 | Wood | E21B 34/10 |
| 10,519,748 | B2 * | 12/2019 | Campbell | E21B 34/103 |
| 10,584,559 | B2 * | 3/2020 | Campbell | E21B 34/063 |
| 10,597,974 | B2 * | 3/2020 | Atkins | E21B 21/103 |
| 10,633,949 | B2 * | 4/2020 | Tilley | E21B 33/14 |
| 10,648,274 | B2 * | 5/2020 | Hughes | E21B 23/006 |
| 10,669,830 | B2 * | 6/2020 | Facca | E21B 43/08 |
| 2009/0056952 | A1 * | 3/2009 | Churchill | E21B 34/14 166/373 |
| 2009/0145605 | A1 * | 6/2009 | Kratochvil | E21B 31/107 166/301 |
| 2012/0042966 | A1 * | 2/2012 | Ross | E21B 34/103 137/517 |
| 2017/0058644 | A1 | 3/2017 | Andreychuk et al. | |
| 2017/0342800 | A1 * | 11/2017 | Themig | E21B 34/063 |
| 2019/0100980 | A1 * | 4/2019 | Fuxa | E21B 21/14 |
| 2019/0112896 | A1 * | 4/2019 | Andreychuk | E21B 34/12 |
| 2020/0182016 | A1 * | 6/2020 | Hardesty | E21B 23/03 |
| 2020/0240241 | A1 * | 7/2020 | Oprea | E21B 34/10 |

* cited by examiner

APPARATUS FOR DOWNHOLE FRACKING AND A METHOD THEREOF

CROSS-REFERENCE TO RELATED APPLICATIONS

This application claims priority to Canadian Patent Application Serial No. 3042542, entitled "APPARATUS FOR DOWNHOLE FRACKING AND A METHOD THEREOF" filed on May 7, 2019, published Jun. 26, 2019, and which issued as CA 3,042,542 on Aug. 11, 2020, the content of which is incorporated herein by reference in its entirety.

FIELD OF THE DISCLOSURE

The present disclosure relates generally to an apparatus and method for downhole fracking, and in particular to an apparatus and method for downhole fracking using a pressure-actuated sliding sleeve set.

BACKGROUND

Downhole fracking has been widely used for increasing the hydrocarbon production of a subterranean formation. For example, downhole fracking may be conducted by running a downhole fracking tool in a wellbore to a target location via a tubing string. The fracking tool comprises a plurality of fracking ports and a valve. The valve is initially in a closed configuration closing the fracking ports and may be actuated to open the fracking ports.

After isolating a section of the wellbore about the target location e.g., by using a pair of packers, the valve is configured to an open configuration opening the fracking ports. Then, a high-pressure fracking fluid is injected into the wellbore along the annulus between the wellbore and the tubing string and jetted out from the opened fracking ports into the formation about the target location to create cracks therein for improving the flow conditions of the hydrocarbon therein, thereby increasing the hydrocarbon production. Usually, the high-pressure fracking fluid comprises suitable solids such as sands for maintaining the created cracks in the formation.

The valve controlling the opening and closing of the fracking ports may be a sliding-sleeve valve which uses a sliding sleeve to open and close the fracking ports. For example, U.S. Pat. No. 7,926,580 to Darnell et al. teaches a coiled tubing multi-zone frac system for fracking a formation adjacent a well using a sliding sleeve and erodible jets. Erodible jets may provide a means for perforating, fracking and flowing the well which takes the place of two separate tools that are otherwise needed to cause a well to flow.

U.S. Pat. No. 8,235,114 to Clem et al. teaches a fracturing and gravel packing tool having features that prevent well swabbing when the tool is picked up with respect to a set isolation packer. An upper or jet valve allows switching between the squeeze and circulation positions without risk of closing the wash pipe valve. The wash pipe valve can only be closed with multiple movements in opposed direction that occur after a predetermined force is held for a finite time to allow movement that arms the wash pipe valve. The jet valve can prevent fluid loss to the formation when being set down whether the crossover tool is supported on the packer or on the smart collet.

U.S. Pat. No. 8,893,810 to Zimmerman et al. teaches the use of a plurality of sliding sleeves deployed on tubing in a wellbore annulus for wellbore fluid treatment. Operators deploy a plug down the tubing to a first sleeve. The plug seats in this first sleeve, and pumped fluid pressure opens the first sleeve and communicates from the tubing to the wellbore annulus. In the annulus, the fluid pressure creates a pressure differential between the wellbore annulus pressure and a pressure chamber on second sleeves on the tubing. The resulting pressure differential opens the second sleeves so that fluid pressure from the tubing can communicate through the second open sleeves. Using this arrangement, one sleeve can be opened in a cluster of sleeves without opening all of them at the same time. The deployed plug is only required to open the fluid pressure to the annulus by opening the first sleeve. The pressure chambers actuate the second sleeves to open up the tubing to the annulus.

U.S. Pat. No. 10,087,734 to Fehr et al. teaches a method for fracturing a formation which includes positioning a fluid treatment string in the formation. The fluid treatment string includes a port configured to pass fracturing fluid from within the string's inner bore to outside the string, and a sliding sleeve located inside string and configured to move by fluid pressure within the inner bore of the fluid treatment string between (i) a first position in which the sliding sleeve covers the port and (ii) a second position in which the sliding sleeve exposes the port to the inner bore. The method also includes applying a fluid pressure within the inner bore such that the sliding sleeve moves from the first position to the second position without the sliding sleeve engaging a sealing device, and pumping fracturing fluid through the inner bore and through the port to fracture a portion of the formation.

US Patent Publication No. 2017/0058644 to Andreychuk et al. teaches a bottom hole actuator tool for locating and actuating one or more sleeve valves spaced along a completion string. A shifting tool includes radially extending dogs at ends of radially controllable, and circumferentially spaced support arms. Conveyance tubing actuated shifting of an activation mandrel, indexed by a J-Slot, cams the arms radially inward to overcome the biasing for in and out of hole movement, and for releasing the arms for sleeve locating and sleeve profile engagement. A cone, movable with the mandrel engages the dogs for positive locking of the dogs in the profile for sleeve opening and closing. A treatment isolation packer can be actuated with cone engagement. The positive engagement and compact axial components results in short sleeve valves.

U.S. Pat. No. 7,398,832 to Brisco teaches an apparatus and method for forming a monodiameter wellbore casing. The casing includes a second casing positioned in an overlapping relation to a first casing. The inside diameter of the overlapping portion and at least a portion of the second casing are substantially equal to the inside diameter of the non-overlapping portion of the first casing. The apparatus includes a support member, an adaptor coupled to the support member, an outer sleeve coupled to the adaptor, a hydraulic slip body coupled to the outer sleeve, a packer cup mandrel coupled to the hydraulic slip body, hydraulic slips coupled to the hydraulic slip body, a shoe coupled to the outer sleeve, an inner mandrel coupled to the shoe and hydraulic slip body, an expansion cone mandrel coupled to the inner mandrel, an expansion cone coupled to the expansion cone mandrel, and a guide nose coupled to the expansion cone mandrel.

The prior-art downhole fracking tools, however, still have disadvantages. For example, some prior-art downhole fracking tools may require a collar locator for proper positioning of the downhole fracking tools. However, with the increased use of premium-thread connections, a casing string may not have any gaps at the collars for the collar locator to position the downhole fracking tool.

Moreover, many prior-art downhole fracking tools require operators to be skilled in not overly pulling the downhole fracking tool through the gap, which depends on how strongly the drag blocks in the collar locator are spring loaded. An insufficient pulling may cause the collar to fail to register on the weight indicator. On the other hand, an overly pulling may, due to the tension in tubing, cause the downhole fracking tool to "jump" uphole through the gap to be engaged, thereby causing the downhole fracking tool be set too high in a fracking sleeve and leading to severe adverse consequences or failures that may be expensive to fix.

Some prior-art downhole fracking tools such as those using J-slots generally require a plurality of steps and consequently a long time to complete a fracking process. For example, in some prior-art downhole fracking tools, a J-slot having up to six positions is used, and the downhole fracking tool needs to cycle through the six positions to complete the fracking process which significantly increases the fracking time.

Many prior-art downhole fracking tools have sophisticated designs with a plurality of parts, and in particular a plurality of moving parts, causing the downhole fracking tools prone to failure in complicated downhole environment due to various factors such as sand clogging, wearing out, insufficient pressure resistance, and/or the like.

Moreover, downhole fracking tools with more parts generally require longer lengths, thereby increasing the manufacturing cost, and causing significant burden to operators because of their larger sizes and higher weights.

SUMMARY

According to one aspect of this disclosure, there is provided a downhole valve comprising: a valve body having a longitudinal bore extending therethrough, an uphole shoulder and a downhole shoulder in the longitudinal bore, and at least one port on a sidewall of the valve body and intermediate the uphole and downhole shoulders; and a sliding-sleeve set received in the bore of the valve body and slidable between the uphole and downhole shoulders thereof for configuring the sliding-sleeve set between a closed configuration for closing the at least one port and an open configuration for opening the at least one port. The sliding-sleeve set comprises an uphole sliding sleeve and a downhole sliding sleeve each longitudinally slidable within the longitudinal bore of the valve body; the sliding-sleeve set is in the closed configuration when the downhole sliding sleeve contacts the downhole shoulder of the valve body and the uphole sliding sleeve and the downhole sliding sleeve are in contact with each other; and the sliding-sleeve set is in the open configuration when the downhole sliding sleeve contacts the downhole shoulder of the valve body and the uphole sliding sleeve contacts the uphole shoulder of the valve body.

In some embodiments, the sliding-sleeve set is in an additional closed configuration when the uphole sliding sleeve contacts the uphole shoulder of the valve body and the downhole sliding sleeve contacts the uphole sliding sleeve.

According to one aspect of this disclosure, there is provided a downhole valve comprising: a valve body having a given longitudinal bore extending therethrough, and at least one port at a longitudinal location therealong circumferentially spaced about a sidewall thereof; and a sliding-sleeve set slidably received in the bore of the valve body and comprising an uphole sliding sleeve and a downhole sliding sleeve. The sliding-sleeve set is in a closed configuration for closing the at least one port when the downhole sliding sleeve is at a downhole position in the valve body and the uphole sliding sleeve engages the downhole sliding sleeve; and the sliding-sleeve set is in an open configuration for opening the at least one port when the downhole sliding sleeve is at the downhole position in the valve body and the uphole sliding sleeve is at an uphole position in the valve body.

In some embodiments, the sliding-sleeve set is in an additional closed configuration when the uphole sliding sleeve is at the uphole position in the valve body and the downhole sliding sleeve engages the uphole sliding sleeve and covers said at least one port.

In some embodiments, the downhole valve further comprises an actuation assembly configured for engaging the sliding-sleeve set and actuating the sliding-sleeve set to the open configuration.

In some embodiments, the actuation assembly is further configured for engaging the sliding-sleeve set and actuating the sliding-sleeve set to the additional closed configuration.

According to one aspect of this disclosure, there is provided a downhole valve comprising: a valve assembly having a valve body and at least a first sliding sleeve, the valve body having at least one port, the first sliding sleeve slidably received in a longitudinal bore of the valve body for indirectly or directly opening and closing the at least one port, the first sliding sleeve comprising a circumferential actuation groove; and an actuation assembly, at least a portion of which is extendable into the first sliding sleeve, said actuation assembly comprising an actuation housing axially movably receiving therein a slip assembly, the slip assembly comprising one or more slips in an initial radially inwardly retracted configuration and being radially outwardly extendable upon application of a hydraulic pressure to a radially outwardly extended configuration for engaging the circumferential actuation groove of the first sliding sleeve and for radially outwardly extending said one or more slips to allow engagement thereof with said circumferential actuation groove to then allow for moving the first sliding sleeve thereby opening the at least one port. When the one or more slips are at the radially outwardly extended configuration, the actuation housing of the actuation assembly is longitudinally movable to position a supporting structure on an inward side of the one or more slips for supporting the one or more slips at the radially outwardly extended configuration.

In some embodiments, the supporting structure is portion of the actuation housing.

In some embodiments, at least one of the one or more slips comprises one or more buttons brazed on an outward surface thereof.

In some embodiments, the one or more buttons are made of tungsten carbide.

In some embodiments, the actuation housing further receives thereon a compressible sealing element uphole of the slip assembly.

In some embodiments, the actuation housing further comprises a circumferential recess on an outer surface thereof for receiving the compressible sealing element.

In some embodiments, when the one or more slips are at the radially outwardly extended configuration and when the portion of the actuation housing is on an radially inward side of the one or more slips, and the compressible sealing element is compressed to engage an inner surface of the valve assembly for forming a seal downhole to the at least one port in an annulus between the valve assembly and the actuation assembly.

In some embodiments, each of the one or more slips comprises at least a second chamfer engageable with an edge of the circumferential actuation groove for, upon application of a longitudinal downward force and release of application of said hydraulic pressure, configuring the one or more slips to a radially inwardly retracted configuration.

In some embodiments, each of the one or more slips is coupled to a spring for biasing the slip to a radially inwardly retracted configuration.

In some embodiments, the actuation assembly further comprises a fluid path for supplying the hydraulic pressure for radially outwardly actuating the one or more slips; the fluid path is in fluid communication with the bore of the valve body when downward force is applied to the actuation assembly and the one or more slips are maintained in, or to be configured to, the radially inwardly retracted configuration and no fracking pressure is applied; and the actuation assembly further comprises a flow-restriction structure or a sealing structure for restricting or completely blocking the fluid communication between the fluid path and the bore of the valve body and for maintaining the hydraulic pressure for radially outwardly actuating the one or more slips when upward force is applied to the actuation assembly and the one or more slips are maintained in, or to be configured to, the radially outwardly extended configuration.

In some embodiments, the slip assembly comprises a piston in the fluid path for being actuated by the hydraulic pressure and having a cone-shaped end engageable with the one or more slips for, upon the application of the hydraulic pressure, radially outwardly actuating the one or more slips.

In some embodiments, each of the one or more slips comprises at least a first chamfer engageable with the cone-shaped end of the piston.

In some embodiments, the compressible sealing element is uphole of and spaced from the piston so as to maintain a gap therebetween, said gap being a part of the fluid path.

In some embodiments, the actuation assembly further comprises an elongated actuation mandrel assembly axially movably received in a longitudinal bore of the actuation housing, said actuation mandrel assembly comprising a longitudinal bore forming a portion of the fluid path; the actuation housing comprises a reduced inner diameter (ID) section; and the actuation mandrel assembly comprises an increased outer diameter (OD) section engageable with the reduced ID section of the actuation housing body when the reduced ID section of the actuation housing body is moved relative to and in close proximity but without contact to said increased OD section so as to thereby form the flow-restriction structure.

In some embodiments, the actuation assembly further comprises an elongated actuation mandrel assembly axially movably received in a longitudinal bore of the actuation housing, said actuation mandrel assembly comprising a longitudinal bore forming a portion of the fluid path; the actuation housing comprises a reduced inner diameter (ID) section at a first location; and the actuation mandrel assembly comprises an increased outer diameter (OD) section engageable with the reduced ID section of the actuation housing body at the first location without contact for forming the flow-restriction structure at the first location when the actuation mandrel assembly is pulled uphole relative to the valve body.

In some embodiments, the actuation assembly further comprises a plug engageable with a plug seat at a second location of the bore of the valve body for forming the sealing structure at the second location.

In some embodiments, upon downhole movement of said actuation mandrel assembly and application of the hydraulic pressure, said increased OD section is less engaged with said actuation housing body, so as to allow passage or increased passage of hydraulic fluid between said increased OD section and said reduced ID section so as to allow flushing said fluid path using said hydraulic fluid.

In some embodiments, the plug is a ball.

In some embodiments, the plug is coupled to a downhole end of the actuation mandrel assembly; and the actuation housing further comprises a circumferential ridge on an inner surface thereof about the second location for engaging the actuation mandrel assembly and establishing a seal or forming a flow-restriction structure about the second location, when the actuation mandrel assembly is pulled uphole relative to the valve body.

In some embodiments, the plug is coupled at an uphole end thereof a collet for receiving a downhole end of the actuation mandrel assembly.

In some embodiments, the downhole valve further comprises a second sliding sleeve slidably received in the longitudinal bore of the valve body and uphole to the first sliding sleeve. The at least one port is opened when the first sliding sleeve is at a downhole position and the second sliding sleeve is at an uphole position; and the at least one port is closed when the first sliding sleeve is at a downhole position and the second sliding sleeve is adjacent the first sliding sleeve, or when the second sliding sleeve is at the uphole position and the first sliding sleeve is adjacent the second sliding sleeve.

In some embodiments, the at least one port is closed when the first sliding sleeve is at an uphole position covering the at least one port; and the at least one port is opened when the first sliding sleeve is at a downhole position uncovering the at least one port.

In some embodiments, the first sliding sleeve comprises at least one aperture at a position overlapping the at least one port of the valve body when the first sliding sleeve is at an uphole position, thereby opening the at least one port of the valve body; and the first sliding sleeve covers the at least one port and the at least one aperture is misaligned with the at least one port when the first sliding sleeve is at a downhole position thereby closing the at least one port of the valve body.

According to one aspect of this disclosure, there is provided a method of fracking a subterranean formation about a section of a wellbore using the above-described downhole valve. The method comprises: locating the valve assembly in said section of the wellbore; running the actuation assembly downhole to pass the valve assembly; pulling the actuation mandrel assembly uphole to move the actuation assembly uphole and form the flow-restriction structure; while pulling the actuation mandrel assembly uphole, injecting a pressurized fluid through the longitudinal bore of the actuation mandrel assembly to actuate the one or more slips radially outwardly; continuing to pull the actuation mandrel assembly uphole to allow the one or more slips to engage the circumferential actuation groove; further continuing to pull the actuation mandrel assembly uphole to slide the first and second sliding sleeves uphole until the second sliding sleeve is at the uphole position and the first sliding sleeve is adjacent the second sliding sleeve; pushing the actuation mandrel assembly downhole while maintain the pressurized fluid to slide the first sliding sleeve to the downhole position to open the at least one port; further moving an uphole portion of the actuation assembly downhole while maintaining the application of the pressurized fluid to extend the actuation housing of the actuation assembly downhole so as to position the portion of the actuation housing on a radially inward side of the one or more slips for supporting the one or more slips at the radially outwardly extended configuration; and fracking the formation by injecting a fracking fluid stream downhole and jetting the fracking fluid stream through the at least one port into the formation.

In some embodiments, the method further comprises: after said fracking the formation, pulling the actuation mandrel assembly uphole and injecting the pressurized fluid to slide the first sliding sleeve to adjacent the second sliding sleeve to close the at least one port.

In some embodiments, the method further comprises: stopping the application of the pressurized fluid and pulling the actuation mandrel assembly uphole to configure the one or more slips to a radially inwardly retracted configuration and allow moving the actuation assembly uphole and out of the valve assembly.

According to one aspect of this disclosure, there is provided a method of fracking a subterranean formation about a section of a wellbore. The method comprises: locating a valve assembly in said section of the wellbore, said valve assembly having a valve body and a first and a second sliding sleeves slidably received in a longitudinal bore thereof, the valve body having at least one fracking port, the first sliding sleeve located at a downhole position and comprising a circumferential actuation groove, and the second sliding sleeve is uphole to but adjacent to the first sliding sleeve and covering the at least one fracking port; running an actuation assembly downhole to pass the valve assembly, said actuation assembly comprising one or more slips reconfigurably in a radially inwardly retracted configuration; pulling the actuation assembly uphole; while pulling the actuation assembly uphole, applying a hydraulic pressure so as to actuate the one or more slips radially outwardly to engage the circumferential actuation groove of the first sliding sleeve; continuing to pull the actuation assembly uphole to slide the first and second sliding sleeves uphole until the second sliding sleeve is uphole to the at least one fracking port; pushing the actuation assembly downhole to slide the first sliding sleeve downhole to open the at least one fracking port; further moving an uphole portion of the actuation assembly downhole to position a supporting structure on a radially inward side of the one or more slips for supporting the one or more slips at the radially outwardly extended configuration; and fracking the formation by injecting a fracking fluid stream downhole and jetting the fracking fluid stream through the at least one fracking port into the formation.

In some embodiments, the step of said further moving the uphole portion of the actuation assembly downhole comprises: further moving the uphole portion of the actuation assembly downhole to position the supporting structure on the radially inward side of the one or more slips for supporting the one or more slips at the radially outwardly extended configuration and to compress a compressible sealing element to radially outwardly expand at least at a central portion thereof and engage an inner surface of the first sliding sleeve, thereby forming a seal downhole to the at least one fracking port in the annulus between the valve assembly and the actuation assembly.

In some embodiments, said actuation assembly further comprises a flow path fluidly connecting a bore of the actuation assembly to the bore of the valve assembly and to a slip-actuation structure for actuating the one or more slips; and said actuating the one or more slips radially outwardly to engage the circumferential actuation groove of the first sliding sleeve comprises: restricting or isolating the flow path to the bore of the valve assembly and applying a hydraulic pressure from the bore of the actuation assembly through the flow path to the slip-actuation structure to actuate the one or more slips radially outwardly to engage the circumferential actuation groove of the first sliding sleeve.

In some embodiments, the method further comprises: after said step of restricting or isolating the flow path, reducing said restriction of the flow path to the bore of the valve assembly so as to allow passage or increased passage of hydraulic fluid therethrough so as to allow flushing said fluid path using said hydraulic fluid.

In some embodiments, the slip-actuation structure comprises a longitudinally movable piston having a chamfer engageable with a chamfer of each of the one or more slips for radially outwardly actuating the one or more slips; and said restricting or isolating the flow path to the bore of the valve assembly and applying the hydraulic pressure from the bore of the actuation assembly through the flow path to the slip-actuation structure comprises: restricting or isolating the flow path to the bore of the valve assembly and applying the hydraulic pressure from the bore of the actuation assembly through the flow path to the piston to actuate the one or more slips radially outwardly to engage the circumferential actuation groove of the first sliding sleeve.

In some embodiments, the slip-actuation structure comprises the radially inward side of each of the one or more slips; and said applying the hydraulic pressure through the flow path to the one or more slips to actuate the one or more slips radially outwardly to engage the circumferential actuation groove of the first sliding sleeve comprises: restricting or isolating the flow path to the bore of the valve assembly and applying the hydraulic pressure from the bore of the actuation assembly through the flow path to the radially inward side of the one or more slips to actuate the one or more slips radially outwardly to engage the circumferential actuation groove of the first sliding sleeve.

In some embodiments, said pushing the actuation assembly downhole to slide the first sliding sleeve downhole to open the at least one fracking port comprises: maintaining the hydraulic pressure and pushing the actuation assembly downhole to slide the first sliding sleeve downhole to open the at least one fracking port.

In some embodiments, the method further comprises: after said pushing the actuation assembly downhole to slide the first sliding sleeve downhole to open the at least one fracking port and before said fracking the formation, increasing the hydraulic pressure to compress a compressible sealing element to radially outwardly expand at least at a central portion thereof and engage an inner surface of the first sliding sleeve, thereby forming a seal downhole to the at least one fracking port in the annulus between the valve assembly and the actuation assembly.

In some embodiments, said further moving the uphole portion of the actuation assembly downhole comprises: after the actuation assembly has been moved to a downhole position to slide the first sliding sleeve downhole to open the at least one fracking port and while a downhole portion of the actuation assembly is stopped at the downhole position, allowing the uphole portion of the actuation assembly to further move downhole to position a supporting structure on a radially inward side of the one or more slips for supporting the one or more slips at the radially outwardly extended configuration.

In some embodiments, said further moving the uphole portion of the actuation assembly downhole comprises: further pushing the uphole portion of the actuation assembly downhole to position a supporting structure on a radially inward side of the one or more slips for supporting the one or more slips at the radially outwardly extended configuration.

In some embodiments, said further moving an uphole portion of the actuation assembly downhole and said fracking the formation comprises: injecting the fracking fluid stream downhole and jetting the fracking fluid stream through the at least one fracking port into the formation for fracking the formation and for further moving the uphole portion of the actuation assembly downhole to cause a supporting structure to move to a radially inward side of the one or more slips for supporting the one or more slips at the radially outwardly extended configuration.

According to one aspect of this disclosure, there is provided a method of fracking a subterranean formation about a section of a wellbore. The method comprises: locating a valve assembly in said section of the wellbore, said valve assembly having a valve body and a first sliding sleeve slidably received in a longitudinal bore thereof, the valve body having at least one fracking port, the first sliding sleeve comprising a circumferential actuation groove, and the first sliding sleeve being secured at an uphole position covering the at least one fracking port and at a distance to a downhole shoulder of the valve body; running an actuation assembly downhole to pass the valve assembly, said actuation assembly comprising one or more slips reconfigurably in a radially inwardly retracted configuration; pulling the actuation assembly uphole; while pulling the actuation assembly uphole, actuating the one or more slips radially outwardly to a radially outwardly extended configuration so as to engage a downhole end of the first sliding sleeve; continuing to pull the actuation assembly uphole to unsecure the first sliding sleeve; reconfiguring the one or more slips to the radially inwardly retracted configuration and further pulling the actuation assembly uphole; actuating the one or more slips radially outwardly to the radially outwardly extended configuration and pushing the actuation assembly downhole to engage the one or more slips with the circumferential actuation groove of the first sliding sleeve; continuing to push the actuation assembly downhole to slide the first sliding sleeve downhole to open the at least one fracking port; further moving an uphole portion of the actuation assembly downhole to position a supporting structure on the radially inward side of the one or more slips for supporting the one or more slips at the radially outwardly extended configuration; and fracking the formation by injecting a fracking fluid stream downhole and jetting the fracking fluid stream through the at least one fracking port into the formation.

In some embodiments, the step of said further moving the uphole portion of the actuation assembly downhole comprises: further moving the uphole portion of the actuation assembly downhole to position the supporting structure on the radially inward side of the one or more slips for supporting the one or more slips at the radially outwardly extended configuration and to compress a compressible sealing element to radially outwardly expand at least at a central portion thereof and engage an inner surface of the first sliding sleeve, thereby forming a seal downhole to the at least one fracking port in the annulus between the valve assembly and the actuation assembly.

In some embodiments, said actuation assembly further comprises a flow path fluidly connecting a bore of the actuation assembly to the bore of the valve assembly and to a slip-actuation structure for actuating the one or more slips; and the steps of said actuating the one or more slips radially outwardly comprise: restricting or isolating the flow path to the bore of the valve assembly and applying a hydraulic pressure from the bore of the actuation assembly through the flow path to the slip-actuation structure to actuate the one or more slips radially outwardly.

In some embodiments, the slip-actuation structure comprises a longitudinally movable piston having a chamfer engageable with a chamfer of each of the one or more slips for radially outwardly actuating the one or more slips; and said restricting or isolating the flow path to the bore of the valve assembly and applying the hydraulic pressure from the bore of the actuation assembly through the flow path to the slip-actuation structure comprises: restricting or isolating the flow path to the bore of the valve assembly and applying the hydraulic pressure from the bore of the actuation assembly through the flow path to the piston to actuate the one or more slips radially outwardly.

In some embodiments, the slip-actuation structure comprises the radially inward side of each of the one or more slips; and said applying the hydraulic pressure through the flow path to the slip-actuation structure comprises: restricting or isolating the flow path to the bore of the valve assembly and applying the hydraulic pressure from the bore of the actuation assembly through the flow path to the radially inward side of the one or more slips to actuate the one or more slips radially outwardly.

In some embodiments, said continuing to push the actuation assembly downhole to slide the first sliding sleeve downhole to open the at least one fracking port comprises: maintaining the hydraulic pressure and continuing to push the actuation assembly downhole to slide the first sliding sleeve downhole to open the at least one fracking port.

In some embodiments, the method further comprises: after said continuing to push the actuation assembly downhole to slide the first sliding sleeve downhole to open the at least one fracking port and before said fracking the formation, increasing the hydraulic pressure to compress a compressible sealing element to radially outwardly expand at least at a central portion thereof and engage an inner surface of the first sliding sleeve, thereby forming a seal downhole to the at least one fracking port in the annulus between the valve assembly and the actuation assembly.

In some embodiments, said step of further moving the uphole portion of the actuation assembly downhole comprises: after the actuation assembly moved to a downhole position to slide the first sliding sleeve downhole to open the at least one fracking port and while a downhole portion of the actuation assembly is stopped at the downhole position, allowing the uphole portion of the actuation assembly to further move downhole to position a supporting structure on a radially inward side of the one or more slips for supporting the one or more slips at the radially outwardly extended configuration.

In some embodiments, said step of further moving the uphole portion of the actuation assembly downhole comprises: further pushing the uphole portion of the actuation assembly downhole to position a supporting structure on a radially inward side of the one or more slips for supporting the one or more slips at the radially outwardly extended configuration.

In some embodiments, said further moving an uphole portion of the actuation assembly downhole and said fracking the formation comprises: injecting the fracking fluid stream downhole and jetting the fracking fluid stream through the at least one fracking port into the formation for fracking the formation and for further moving the uphole portion of the actuation assembly downhole to position a supporting structure on a radially inward side of the one or more slips for supporting the one or more slips at the radially outwardly extended configuration.

According to one aspect of this disclosure, there is provided a method of fracking a subterranean formation about a section of a wellbore. The method comprises: locating a valve assembly in said section of the wellbore, said valve assembly having a valve body and a first sliding sleeve slidably received in a longitudinal bore thereof, the valve body having at least one fracking port, the first sliding sleeve comprising at least one aperture alignable with the at least one fracking port of the valve body and a circumferential actuation groove, and the first sliding sleeve located at a downhole position covering the at least one fracking port; running an actuation assembly downhole to pass the valve assembly, said actuation assembly comprising one or more slips reconfigurably in a radially inwardly retracted configuration; pulling the actuation assembly uphole; while pulling the actuation assembly uphole, actuating the one or more slips radially outwardly to reconfigure the one or more slips to a radially outwardly extended configuration and engage the circumferential actuation groove of the first sliding sleeve; continuing to pull the actuation assembly uphole to slide the first sliding sleeve to an uphole position and secured therein to align the at least one aperture thereof with the at least one fracking port of the valve body thereby opening the at least one fracking port; injecting a fracking fluid stream downhole into the valve assembly; allowing the fracking fluid stream to further push the actuation assembly downhole to position a supporting structure on the inward side of the one or more slips for supporting the one or more slips at the radially outwardly extended configuration; and jetting the fracking fluid stream through the at least one fracking port into the formation.

According to one aspect of this disclosure, there is provided a method of fracking a subterranean formation about a section of a wellbore. The method comprises: locating a valve assembly in said section of the wellbore, said valve assembly having a valve body and a first sliding sleeve slidably received in a longitudinal bore thereof, the valve body having at least one fracking port, the first sliding sleeve comprising a circumferential actuation groove, and the first sliding sleeve being secured at an uphole or downhole position covering the at least one fracking port and at a distance to a respective uphole or downhole shoulder of the valve body; running an actuation assembly downhole to pass the valve assembly, said actuation assembly comprising one or more slips reconfigurably in a radially inwardly retracted configuration; pulling the actuation assembly uphole; while pulling the actuation assembly uphole, actuating the one or more slips radially outwardly to a radially outwardly extended configuration so as to engage a downhole end of the first sliding sleeve; continuing to move the actuation assembly uphole or downhole to slide the first sliding sleeve to open the at least one fracking port; further moving an uphole portion of the actuation assembly downhole to position a supporting structure on the radially inward side of the one or more slips for supporting the one or more slips at the radially outwardly extended configuration; and fracking the formation by injecting a fracking fluid stream downhole and jetting the fracking fluid stream through the at least one fracking port into the formation.

BRIEF DESCRIPTION OF $TH_E$ DRAWINGS

Further advantages and other embodiments of the invention will now appear from the above along with the following detailed description of the various particular embodiments of the invention, taken together with the accompanying drawings each of which are intended to be non-limiting and for illustrative purpose only, in which:

FIG. 1 is a side view of a downhole tool, according to some embodiments of this disclosure;

FIG. 2 is a cross-sectional view of the downhole tool shown in FIG. 1, the downhole tool comprising a valve assembly having a plurality of fracking ports circumferentially distributed on a sidewall thereof, and an actuation assembly movably received in a longitudinal bore of the valve assembly for actuating a sleeve set of the valve assembly between the open configuration and a closed configuration to open and close the fracking ports, wherein the sleeve set shown in this figure is in the open configuration;

FIGS. 19A to 19L show a fracking process using the downhole tool shown in FIG. 2, wherein:

Figure 3:
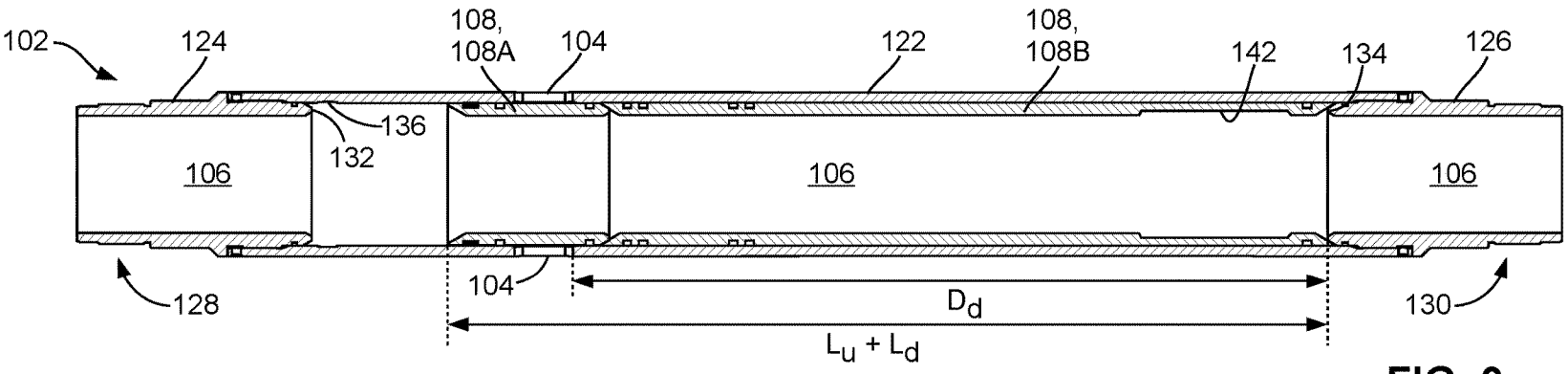
FIG. 3 is a cross-sectional view of the valve assembly of the downhole tool shown in FIG. 2, wherein the sleeve set is in the closed configuration.
Figure 4:
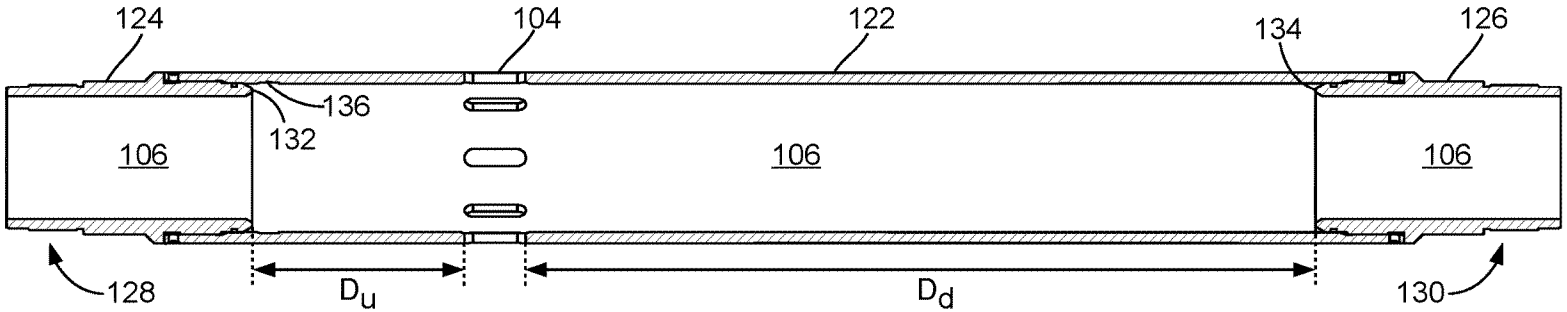
FIG. 4 is a cross-sectional view of a valve housing of the valve assembly shown in FIG. 3 coupled to an uphole coupling and a downhole coupling at opposite ends thereof.
Figure 6:
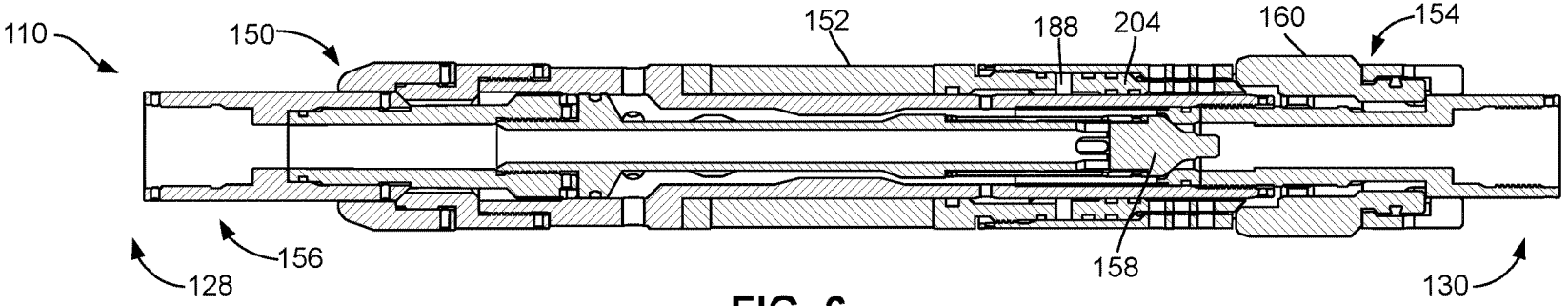
FIG. 6 is a cross-sectional view of the actuation assembly of the downhole tool shown in FIG. 2, the actuation assembly comprising an actuation housing which receives a compressible sealing element and a slip assembly on an outer surface thereof, and axially movably receives in a longitudinal bore thereof an actuation mandrel assembly and a plug assembly.
Figure 19A:
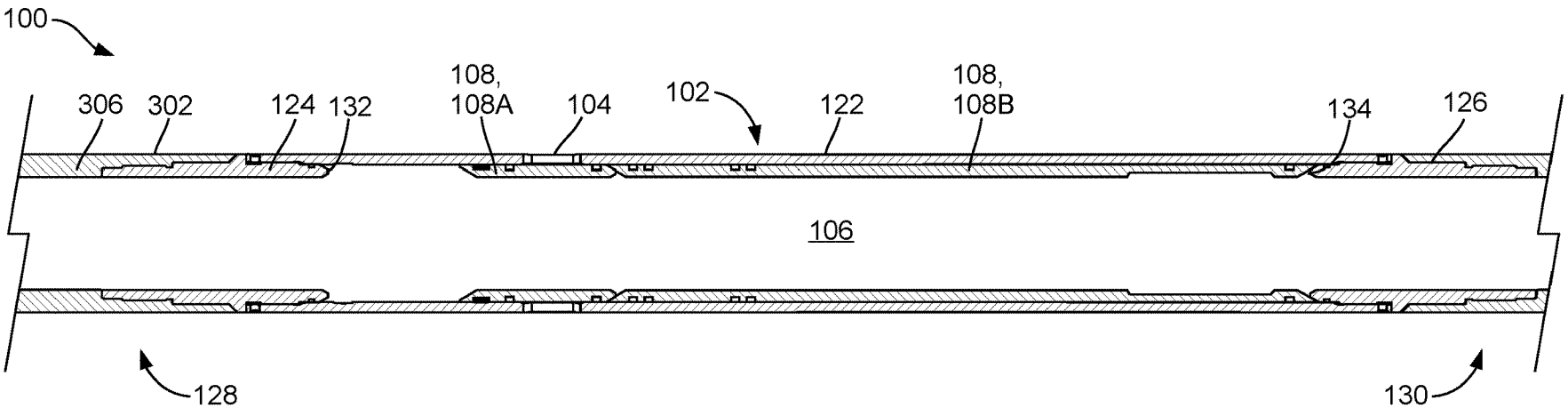
Figure 19B:
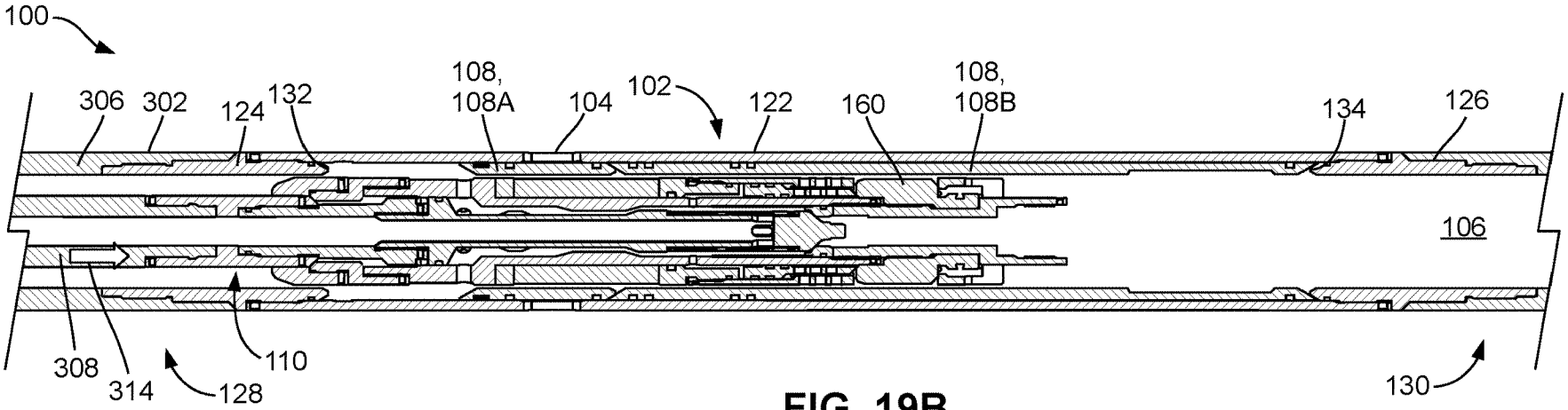
Figure 19C:
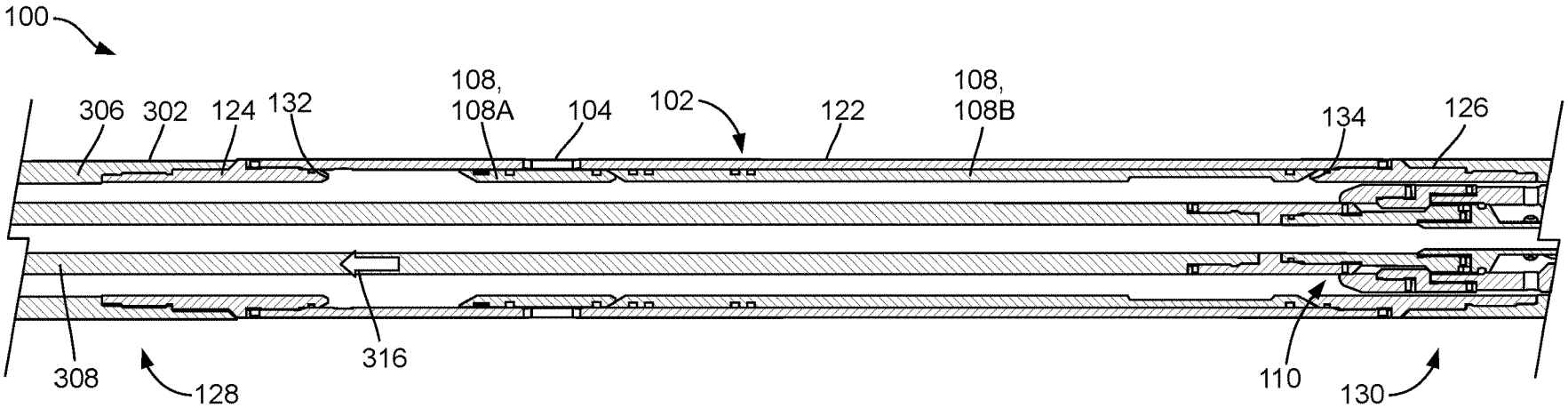
Figure 19D:
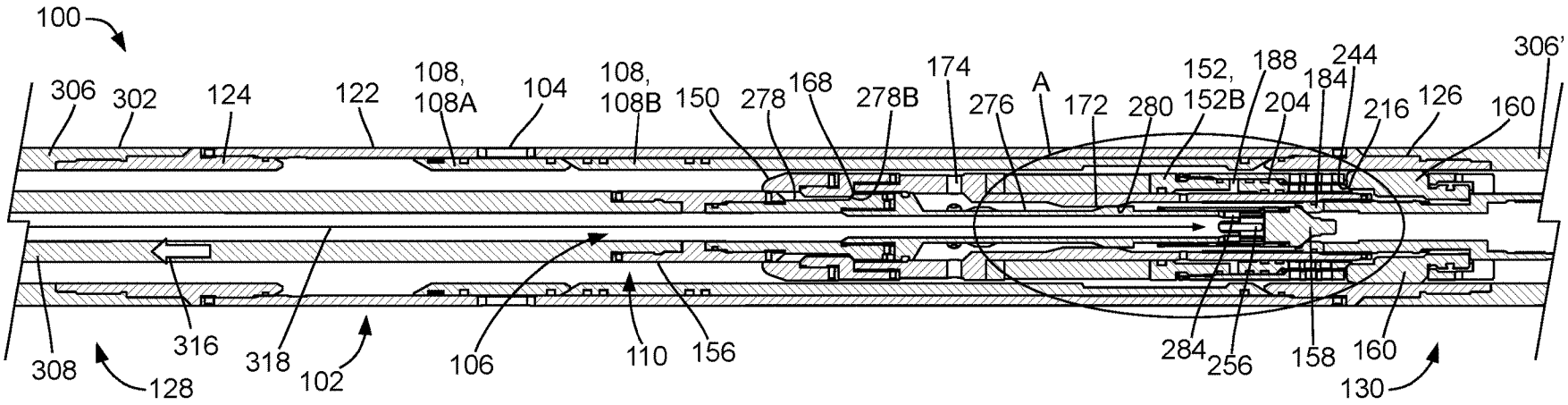
Figure 19E:
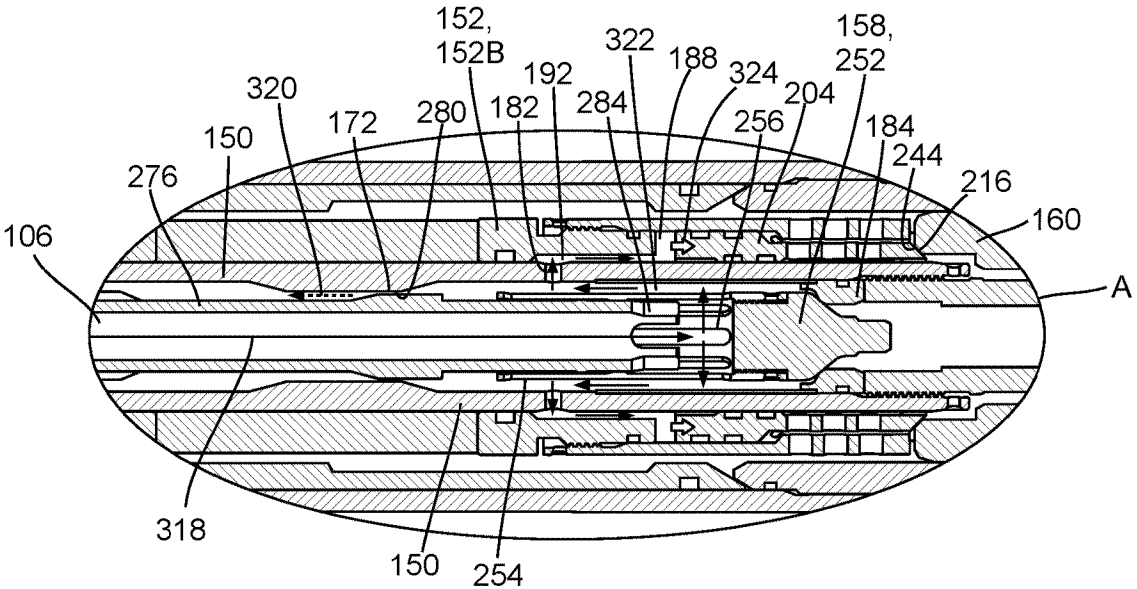
Figure 19F:
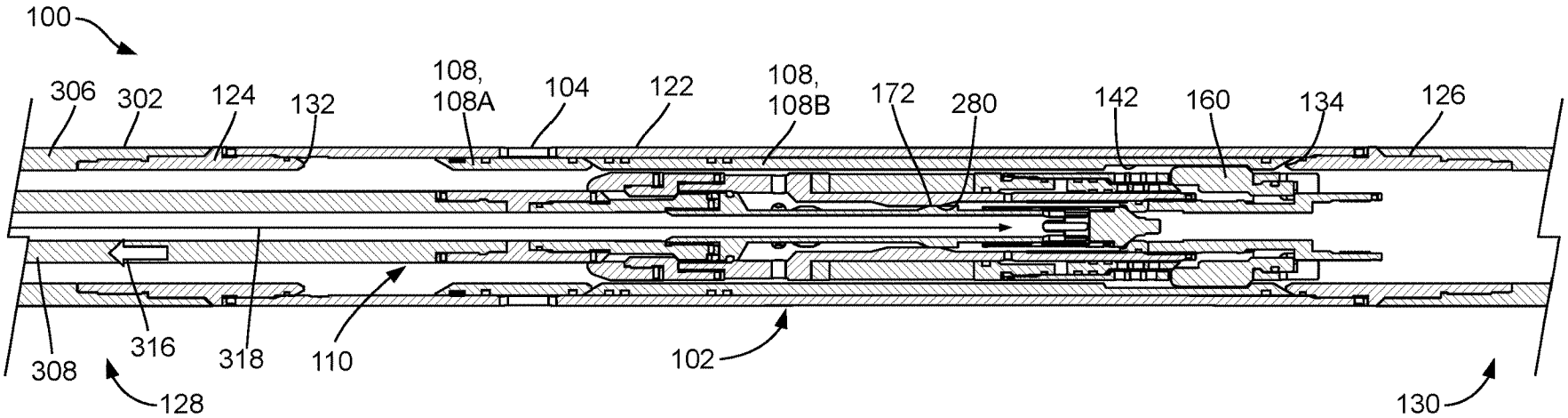
Figure 19G:
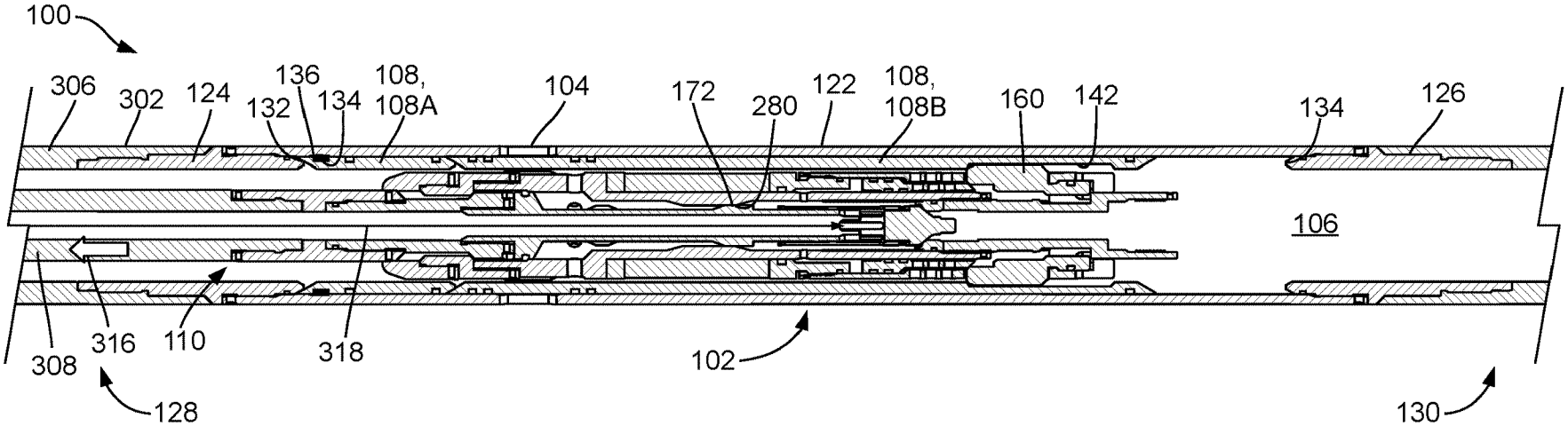
Figure 19H:
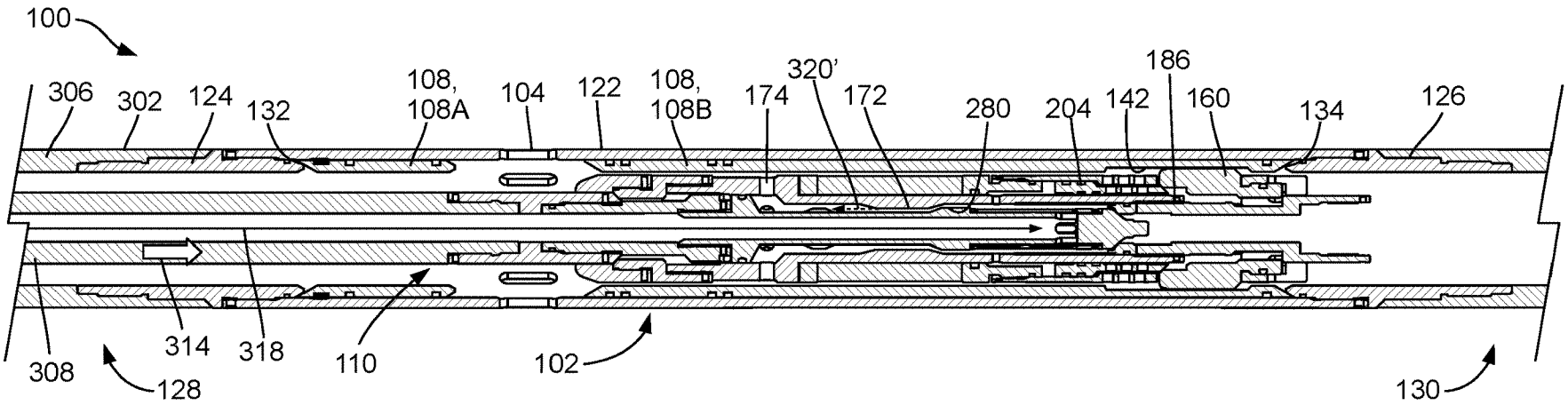
Figure 19I:
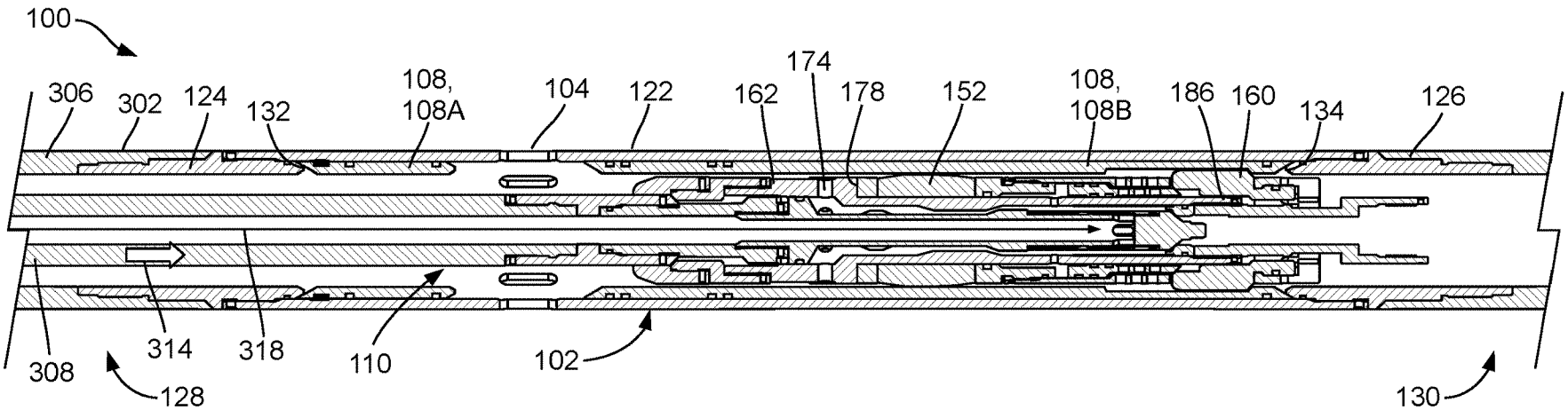
Figure 19J:
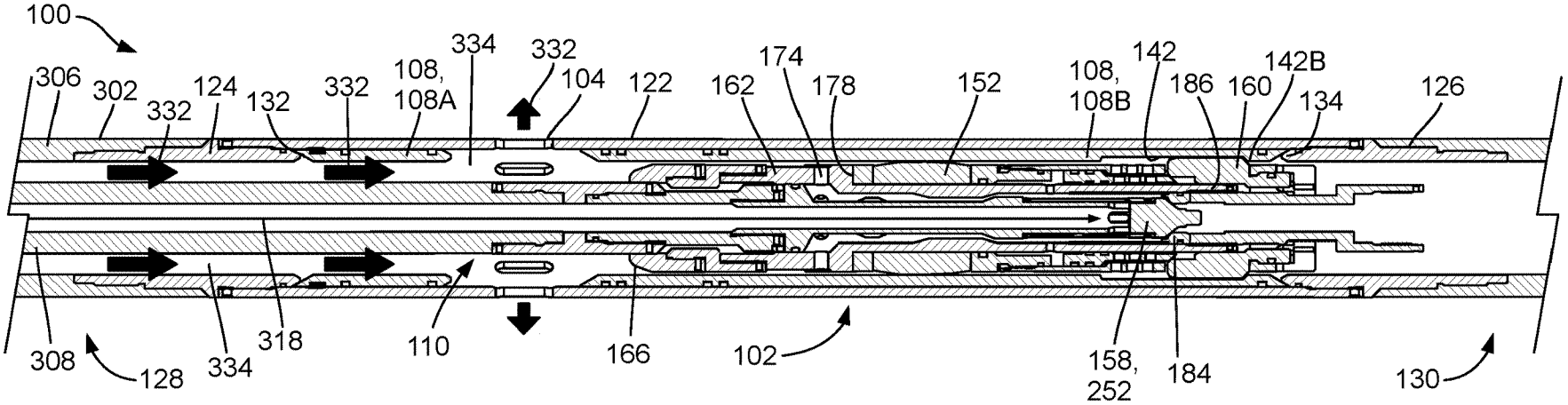
Figure 19K:
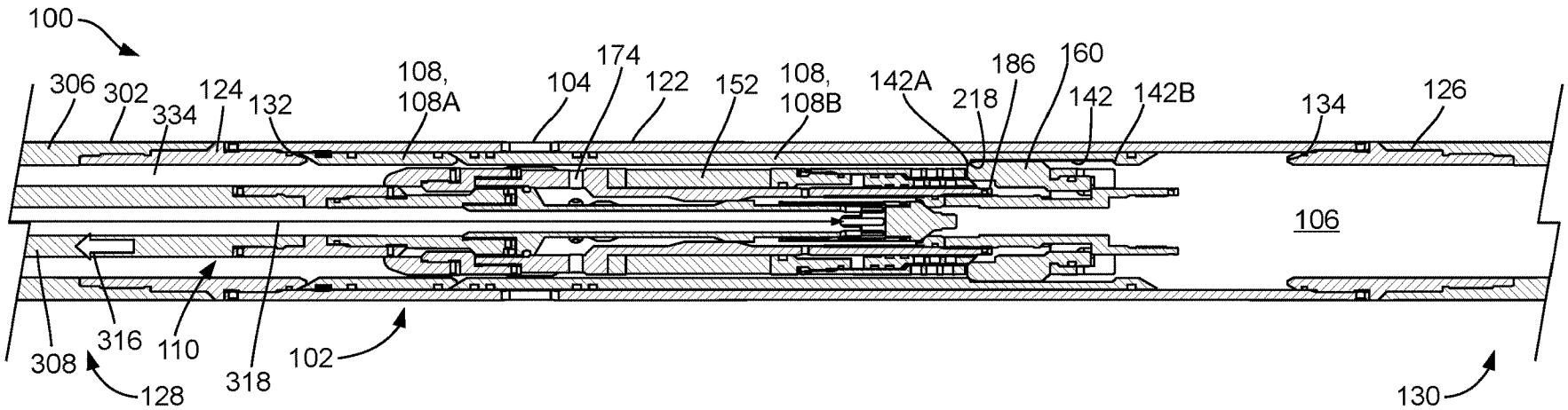
Figure 19L:
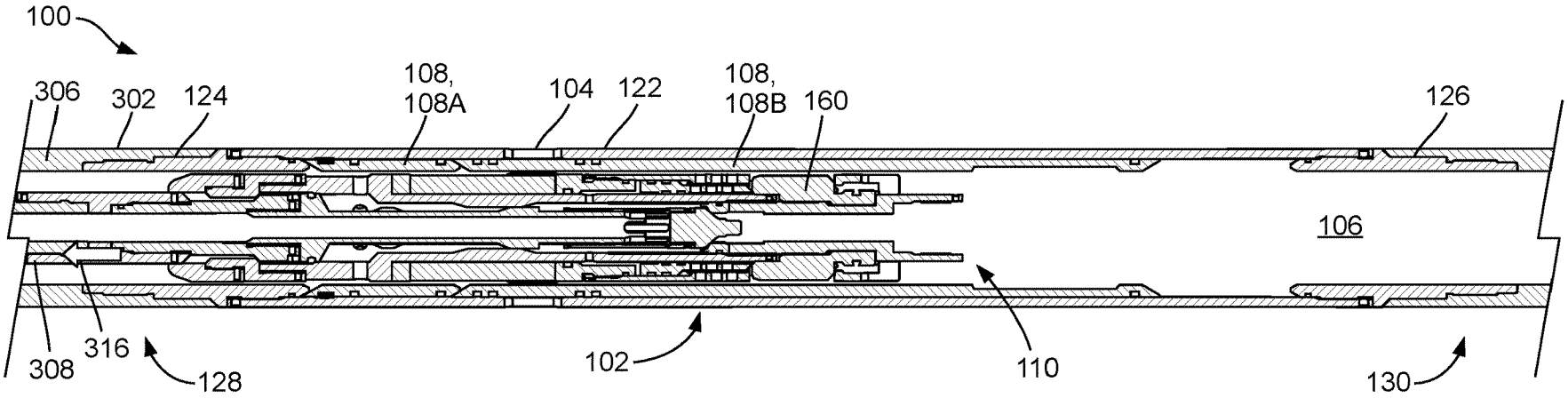
Figure 20:
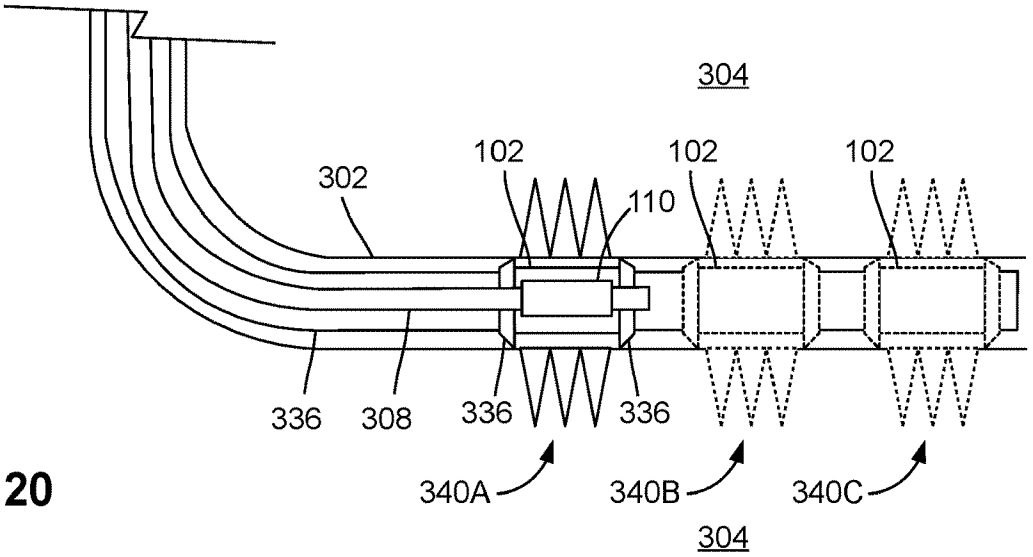
Figure 21:
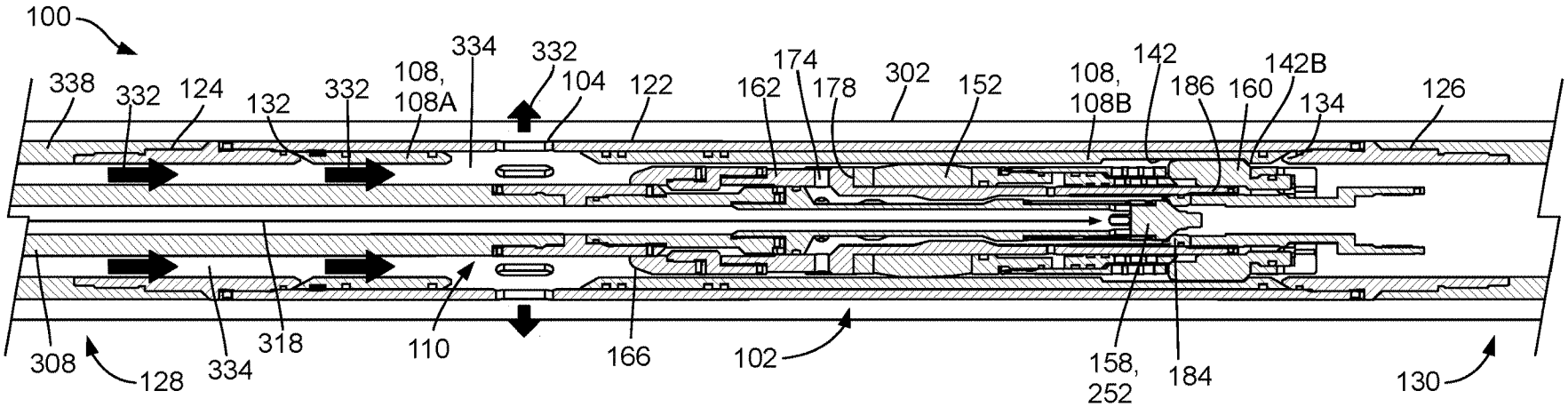
Figure 22:
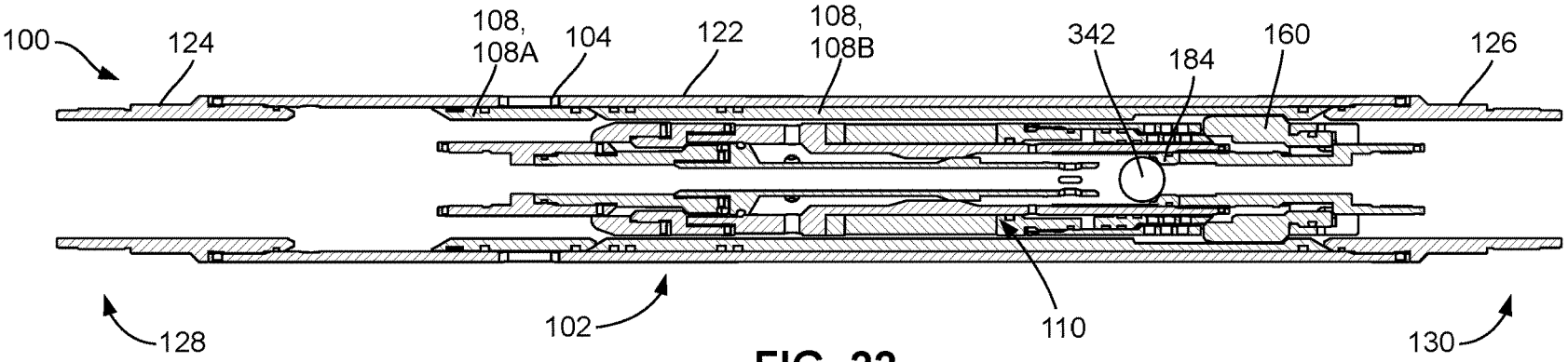
Figure 23:
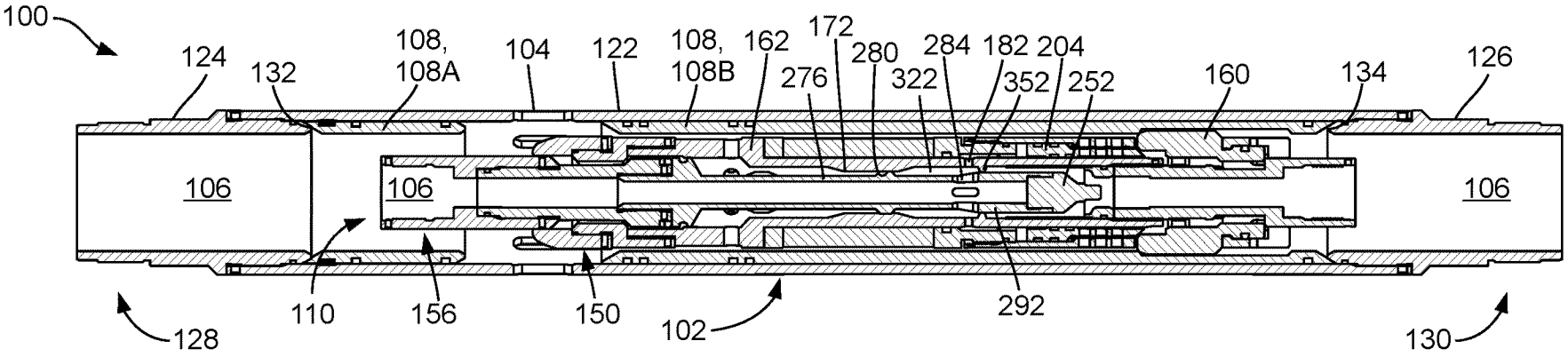
Figure 24A:
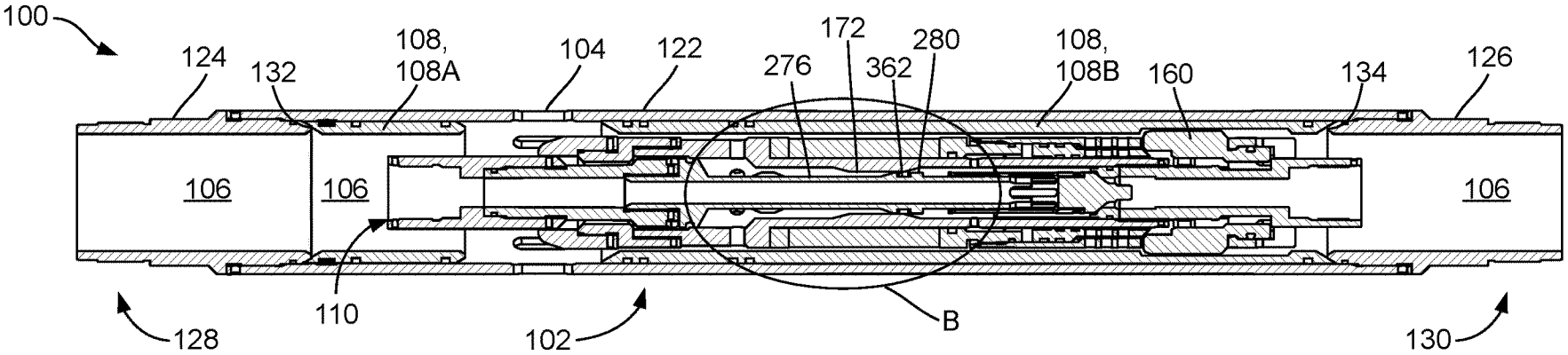
Figure 24B:
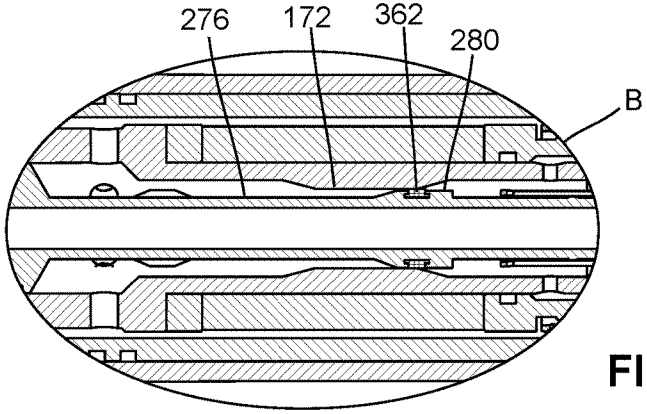
Figure 25:
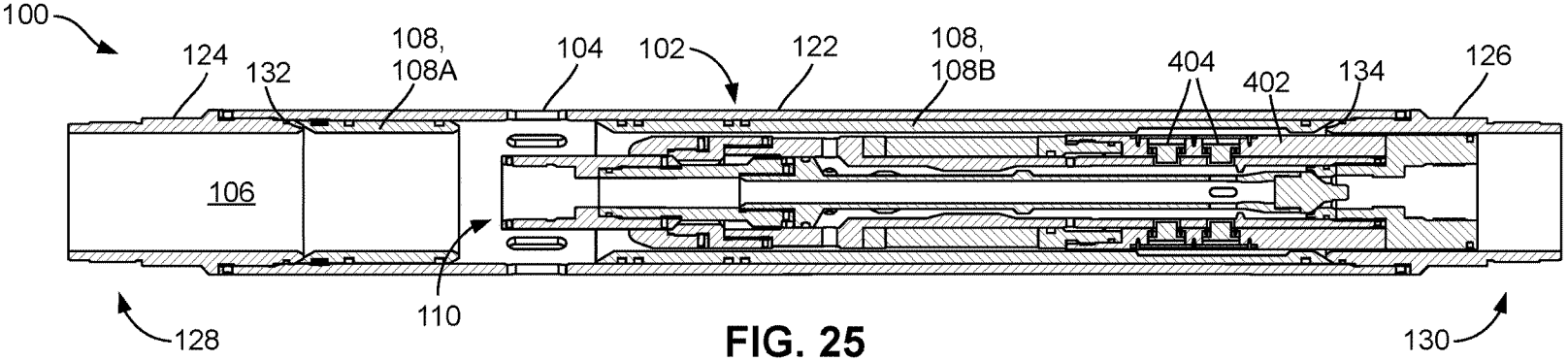
Figure 26:
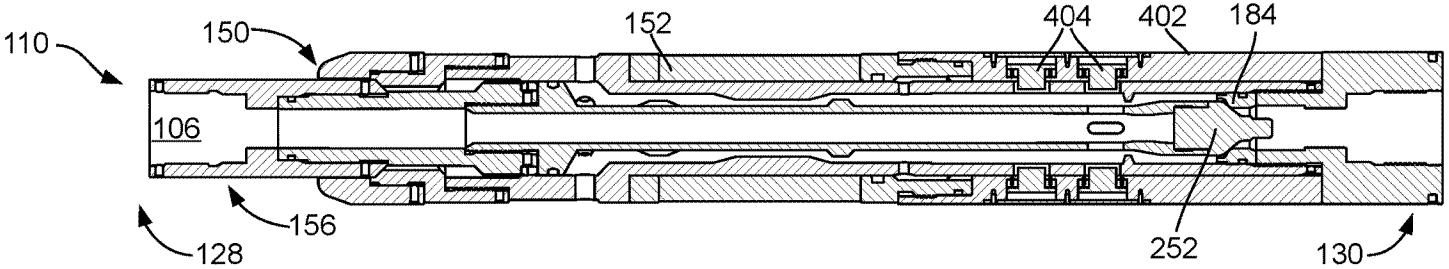
Figure 27A:
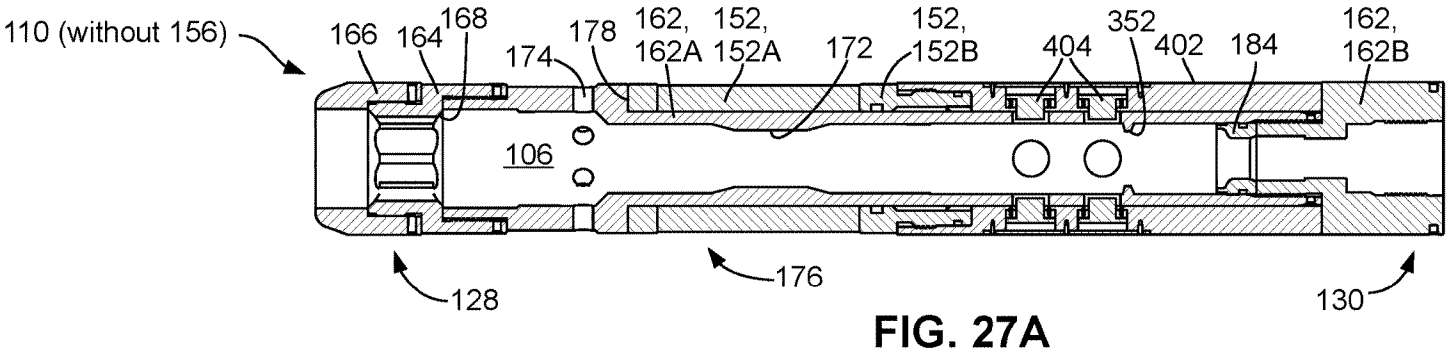
Figure 27B:
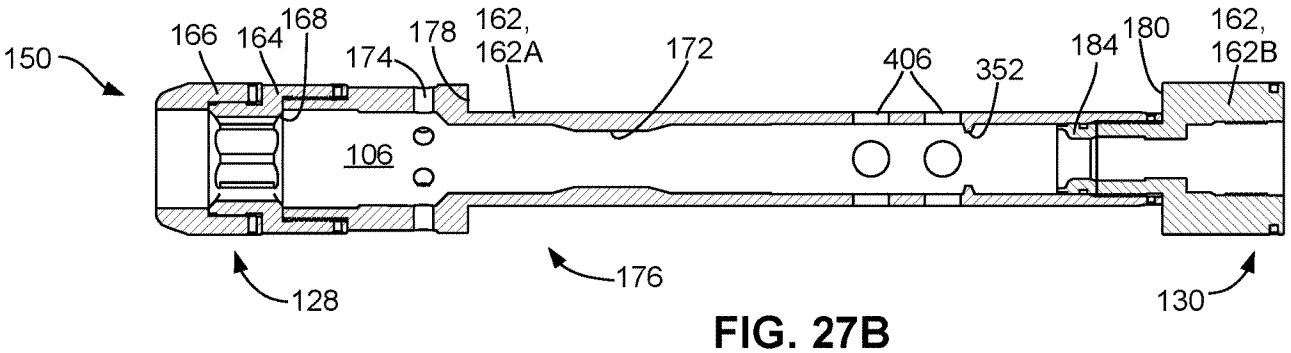
Figure 28A:
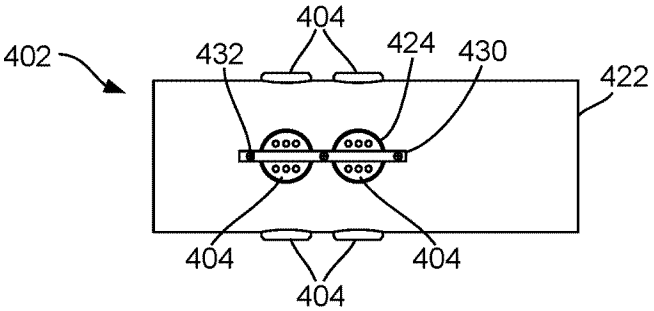
Figure 28C:
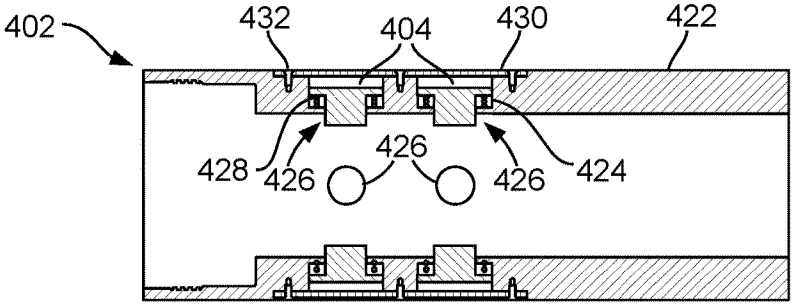
Figure 28B:
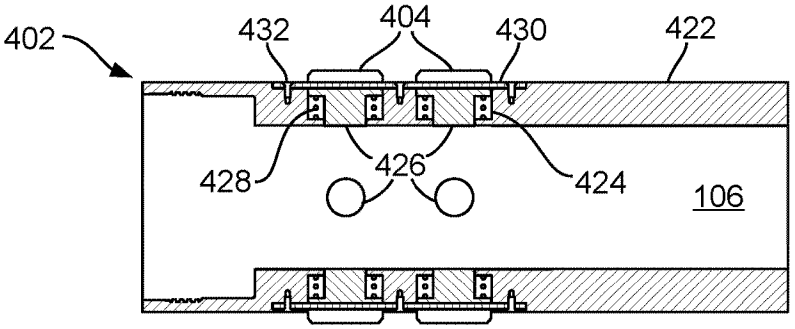
Figure 29:
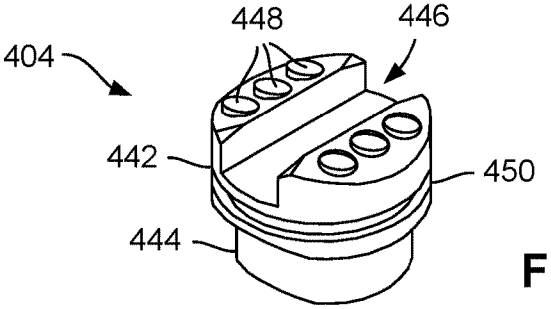
Figure 30:
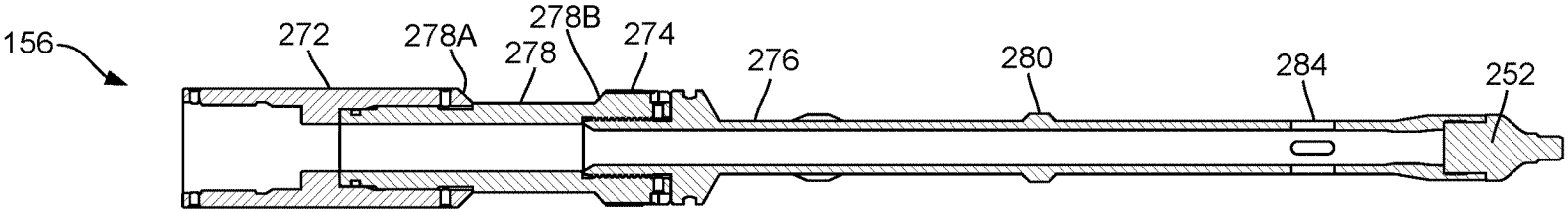
Figure 31A:
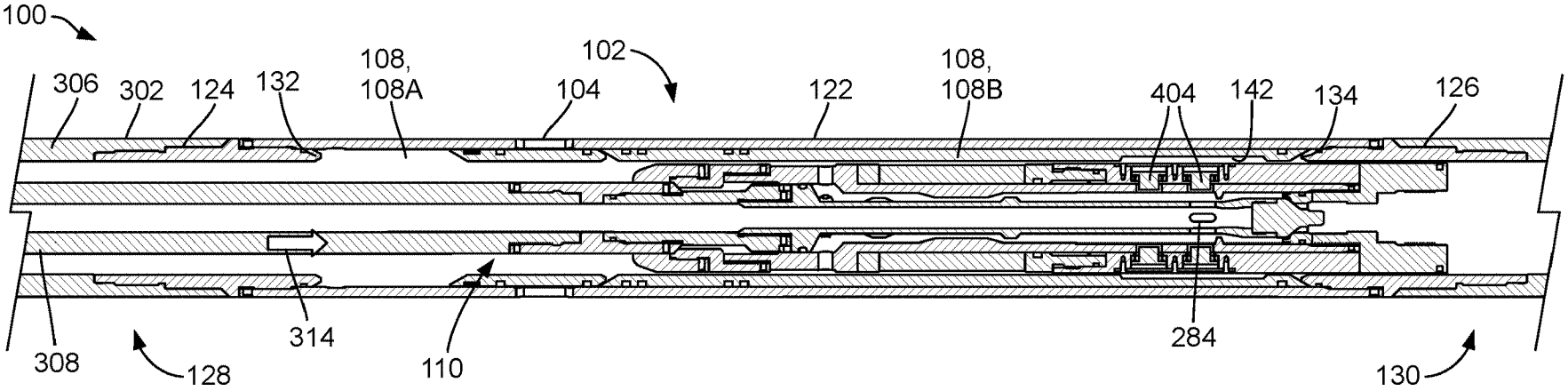
Figure 31B:
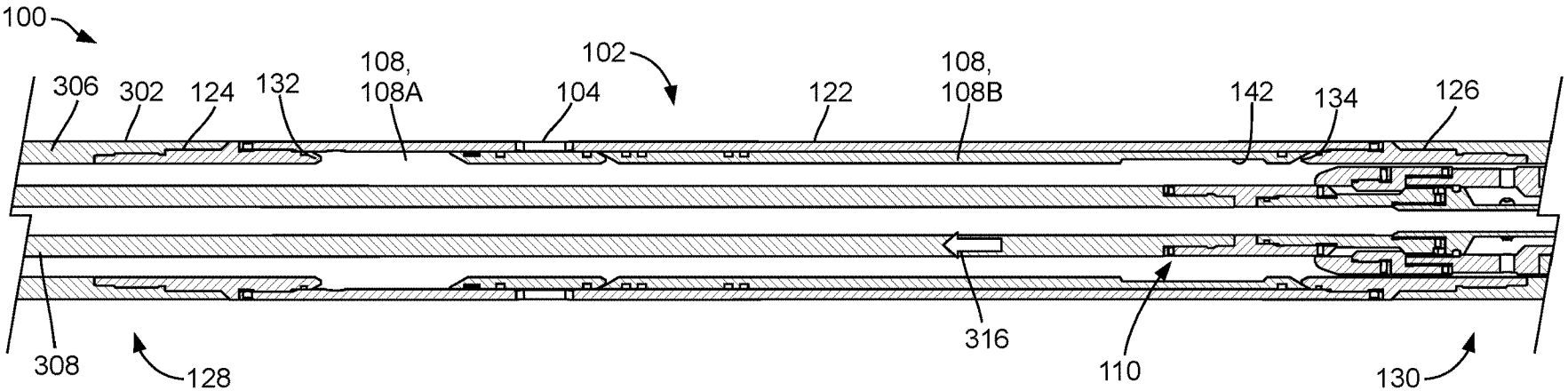
Figure 31C:
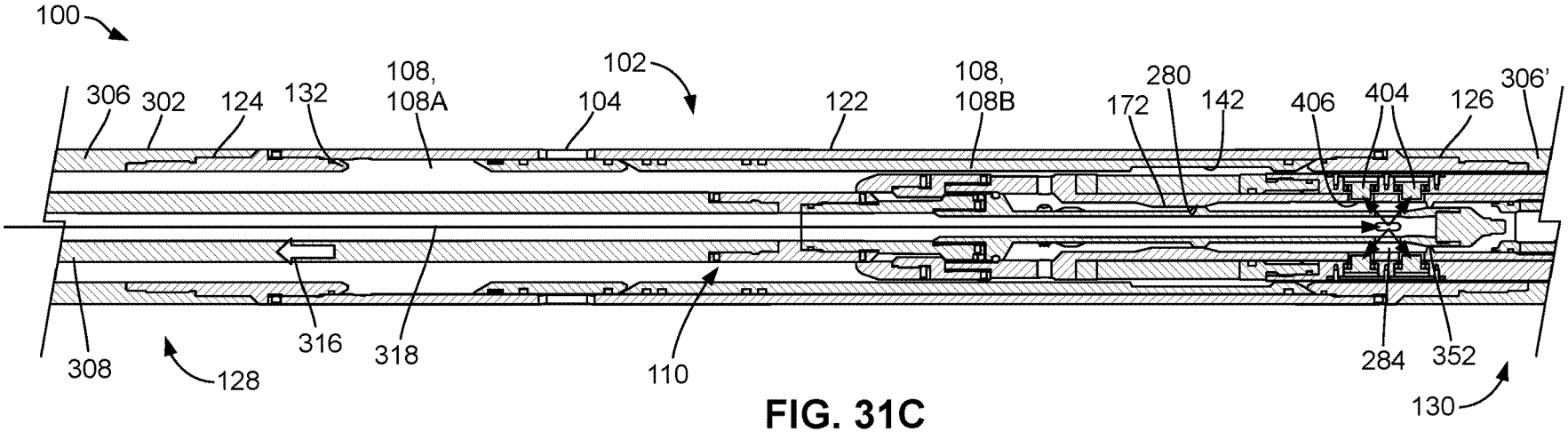
Figure 31D:
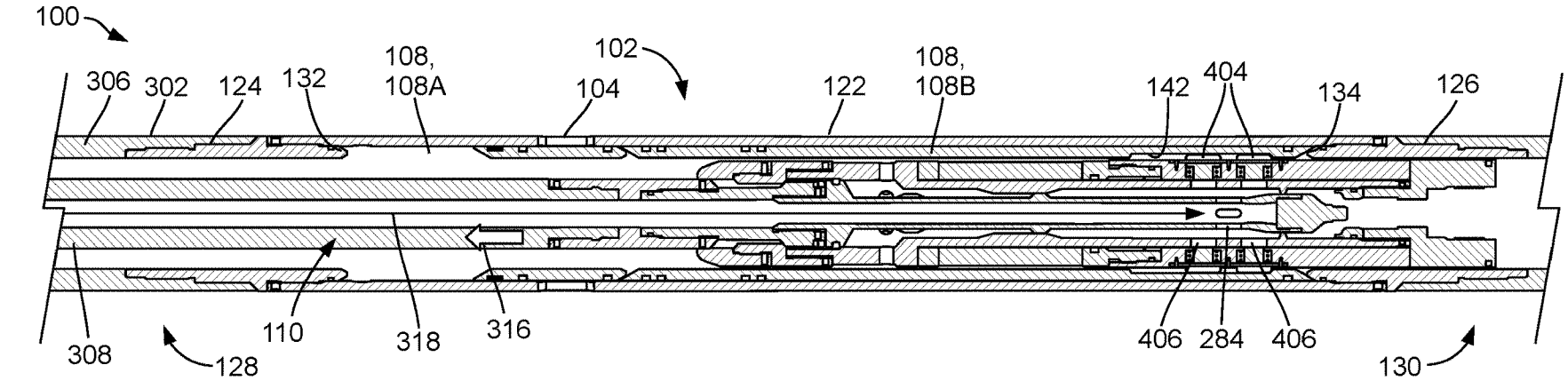
Figure 31E:
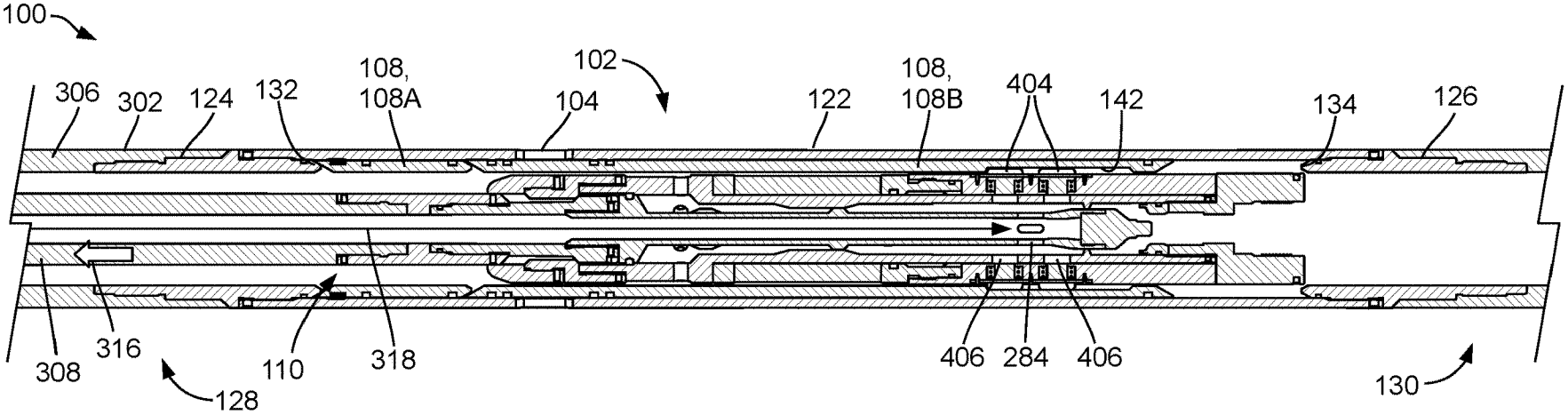
Figure 31F:
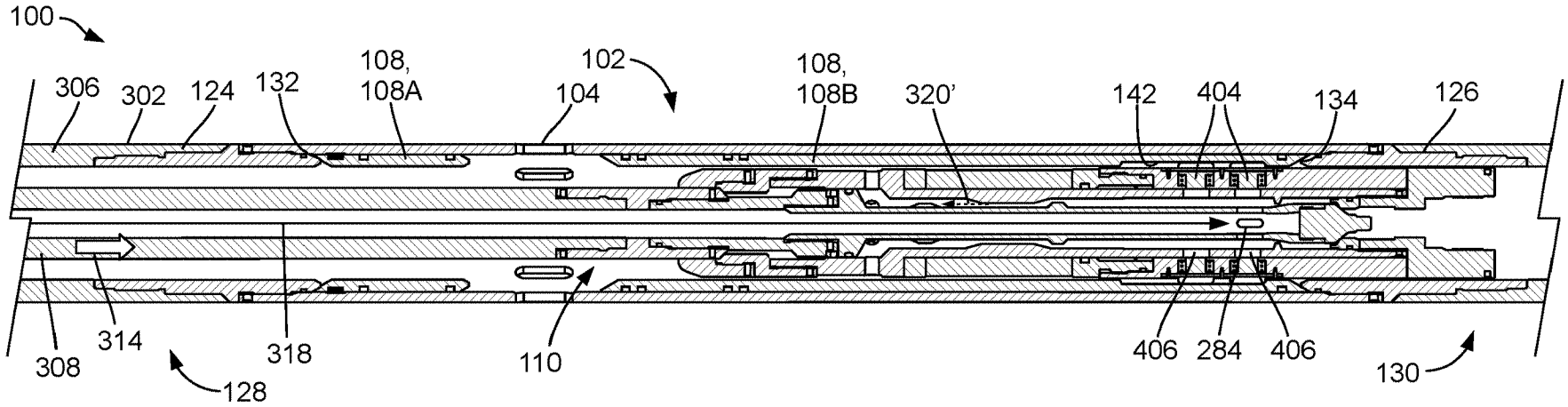
Figure 31G:
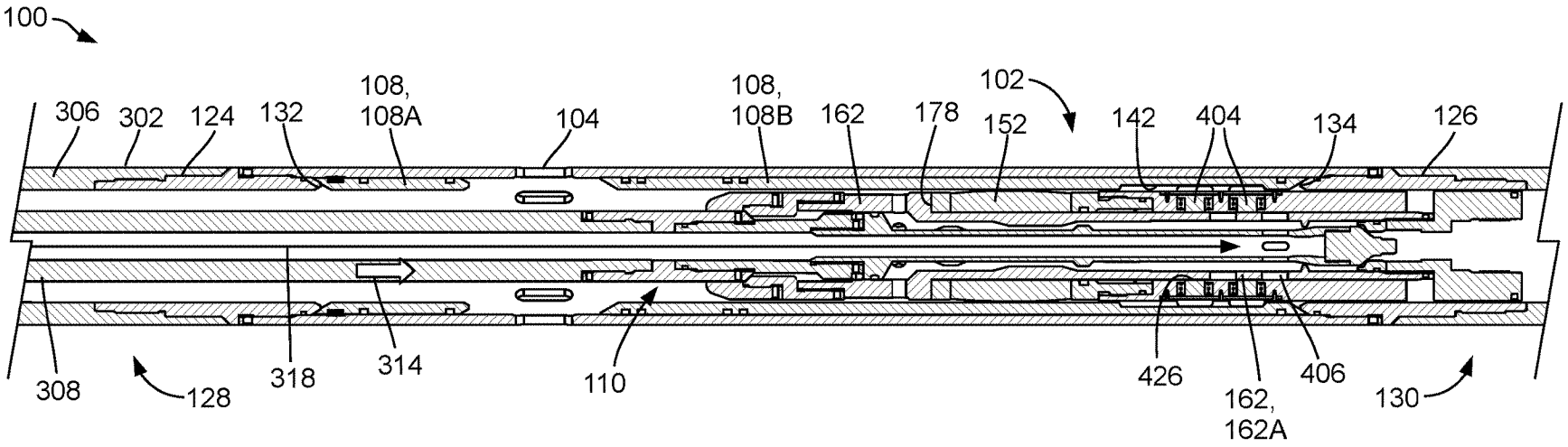
Figure 31H:
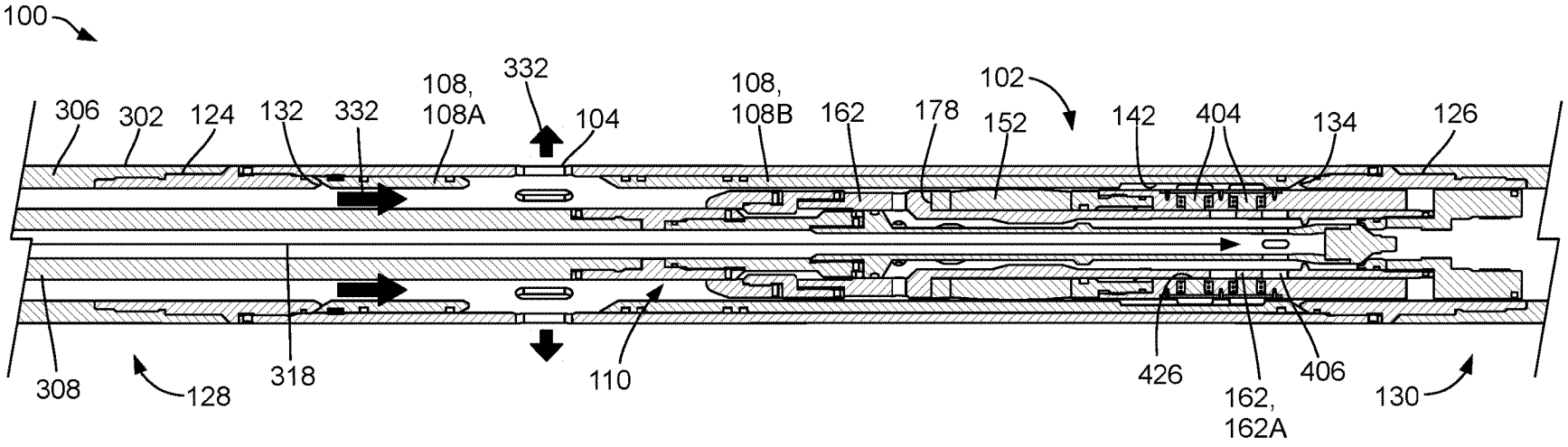
Figure 31I:
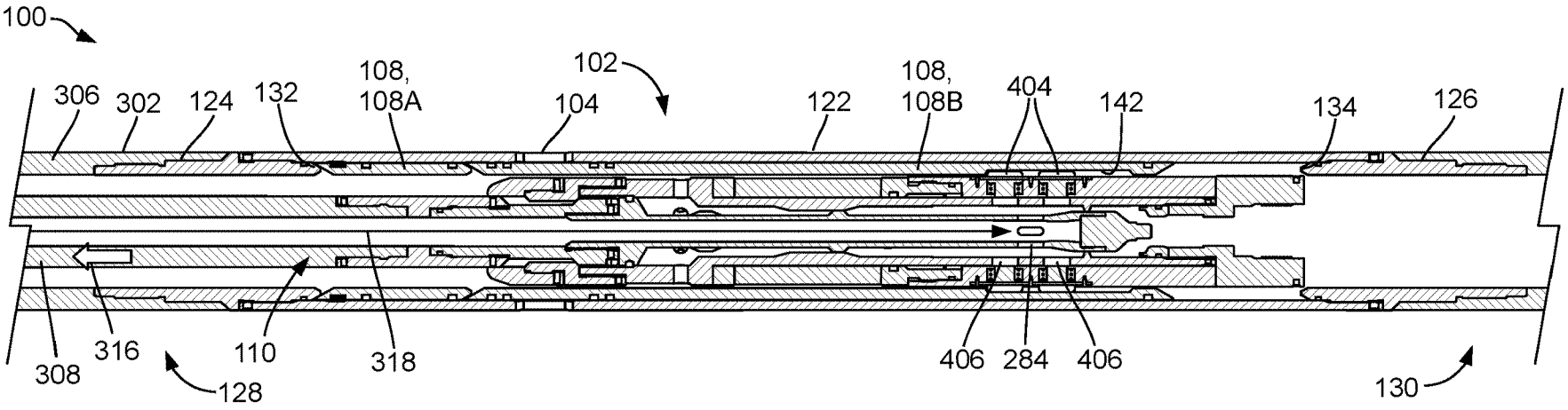
Figure 31J:
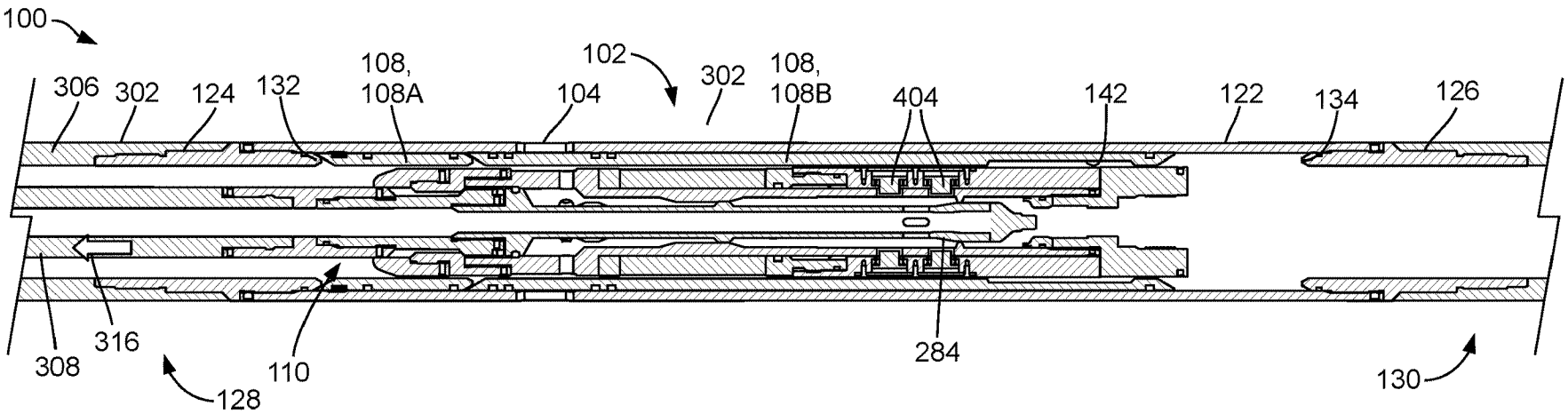
Figure 33A:
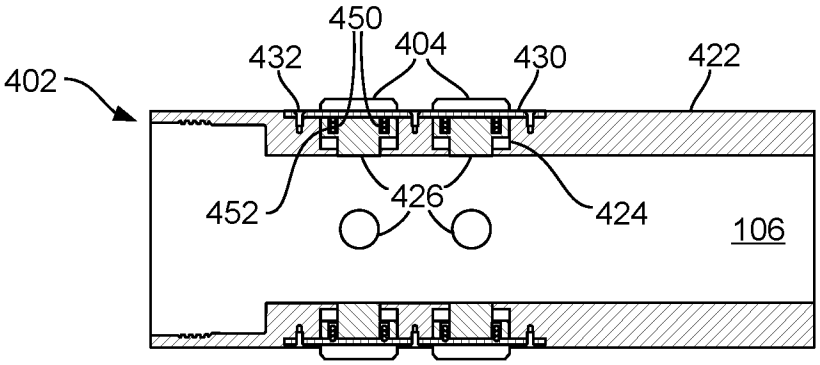
Figure 32:
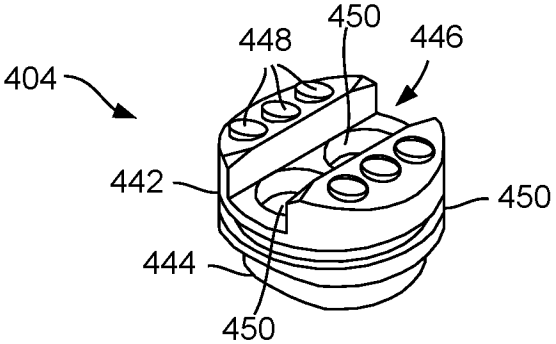
Figure 33B:
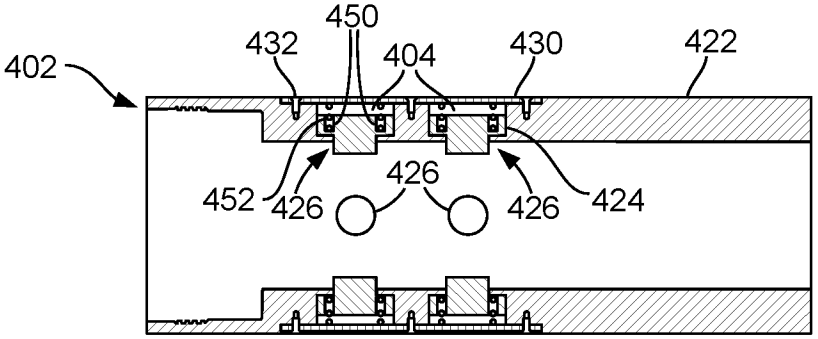
Figure 34:
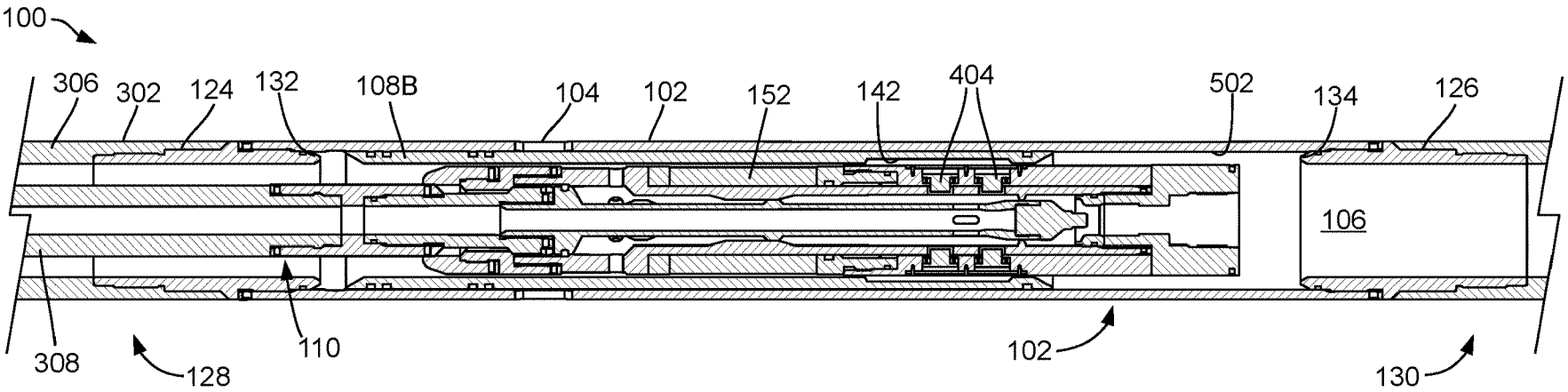
Figure 35A:
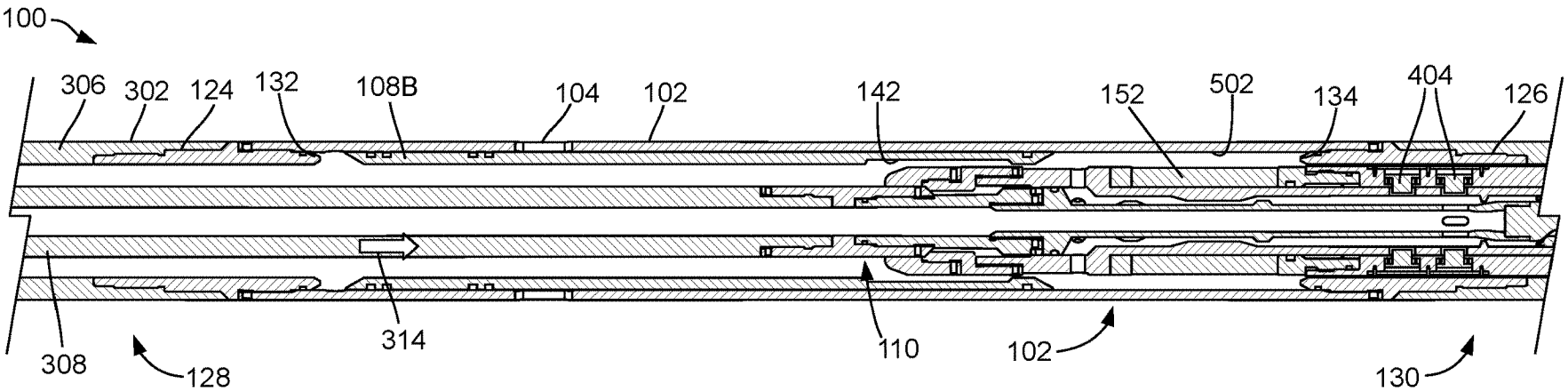
Figure 35B:
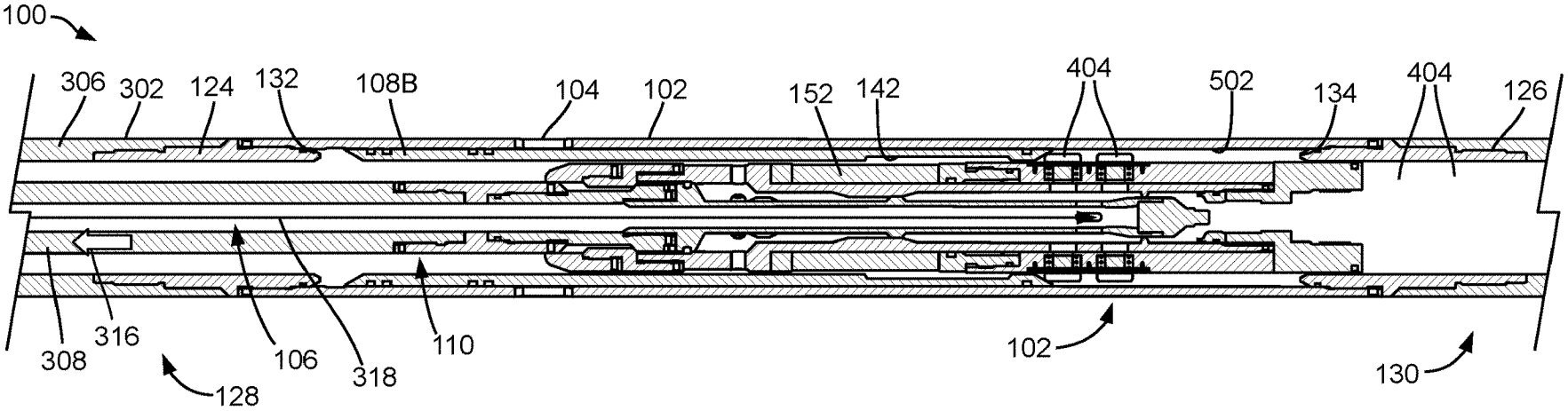
Figure 35C:
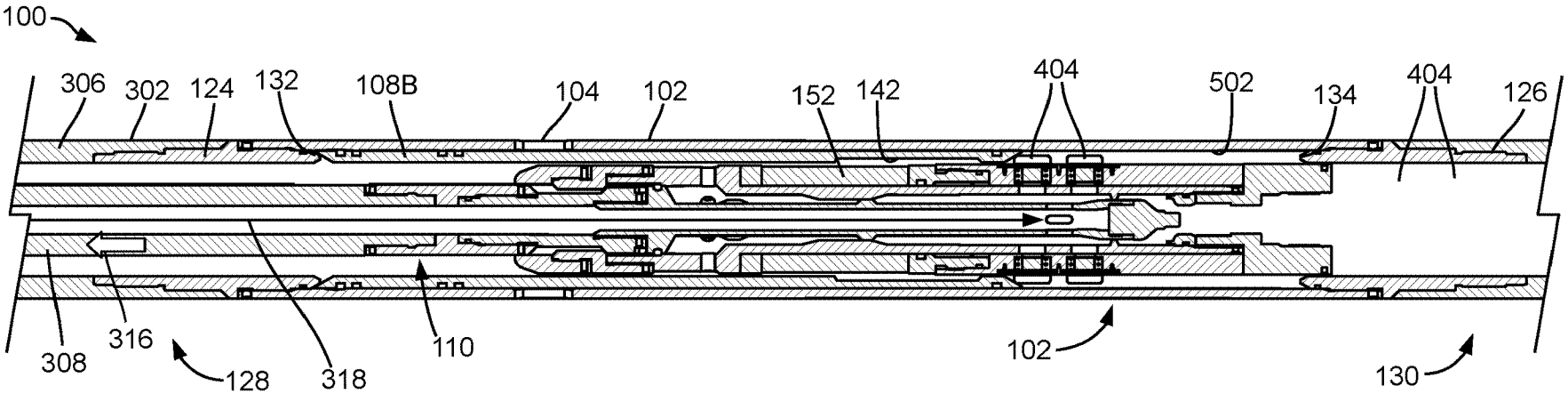
Figure 35D:
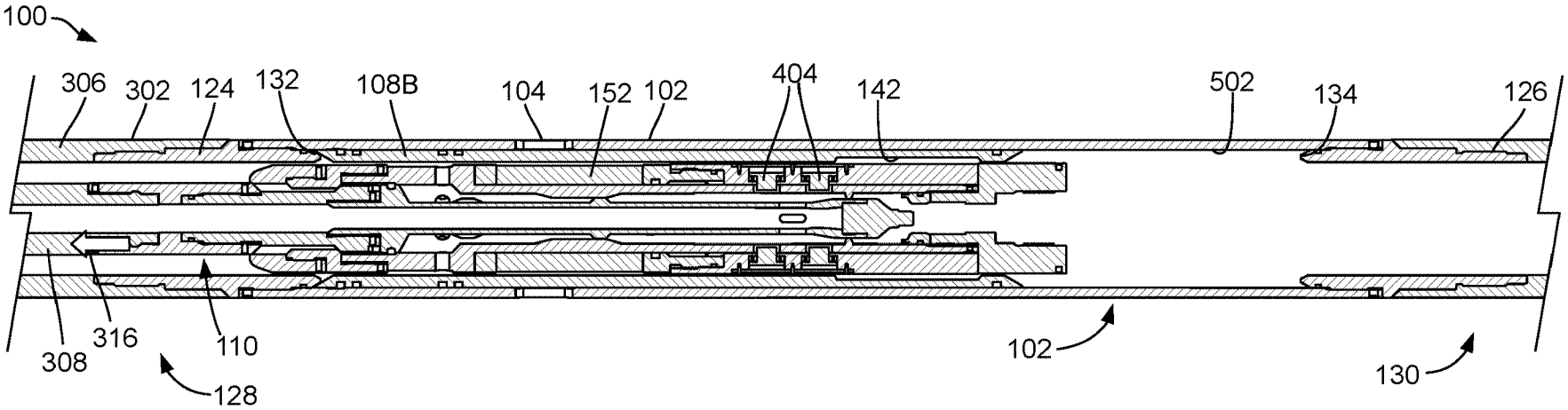
Figure 35E:
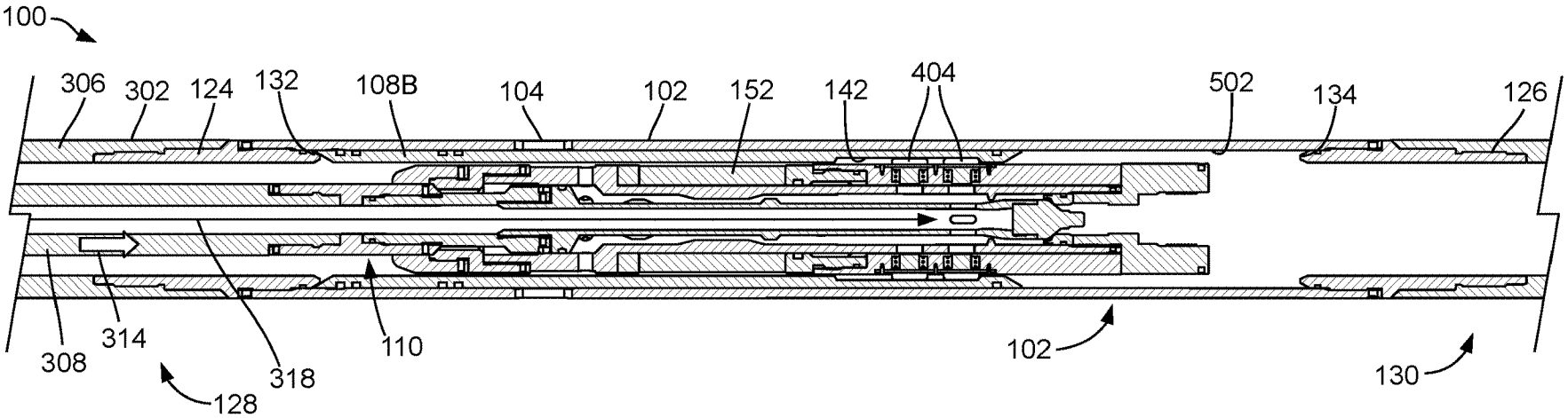
Figure 35F:
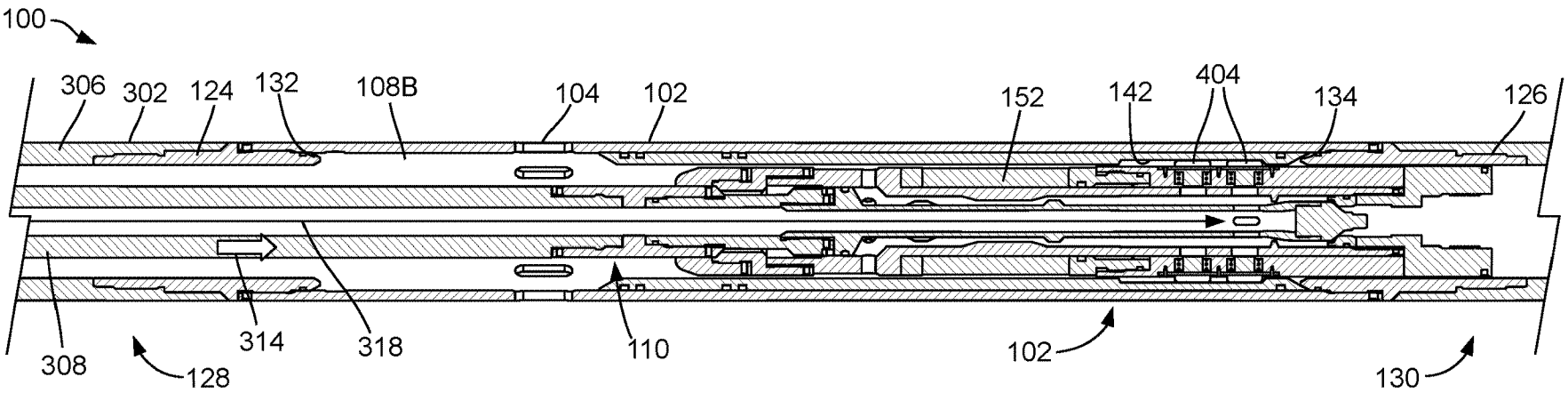
Figure 35G:
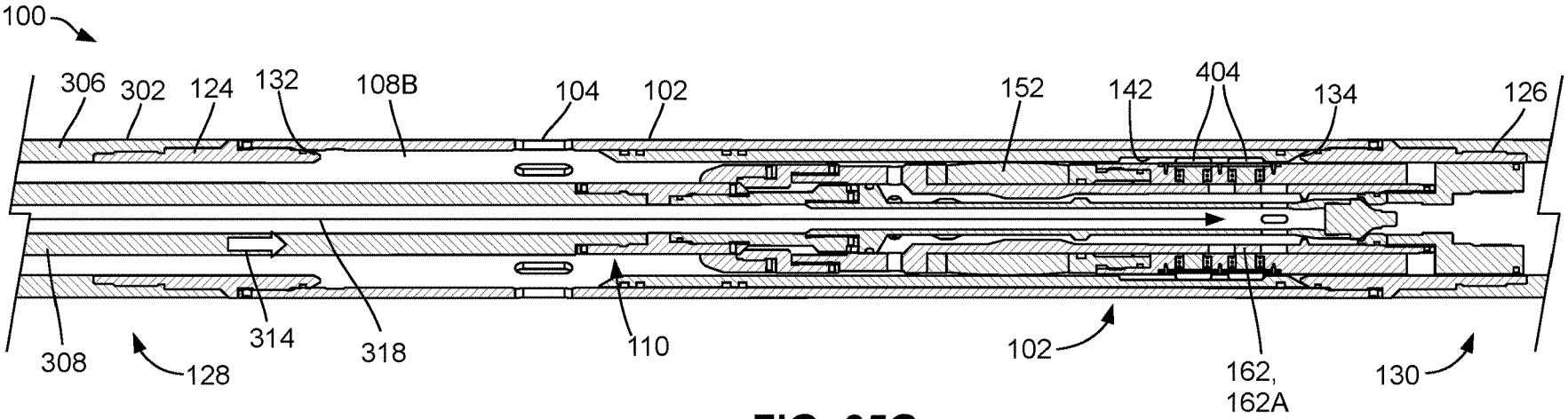
Figure 35H:
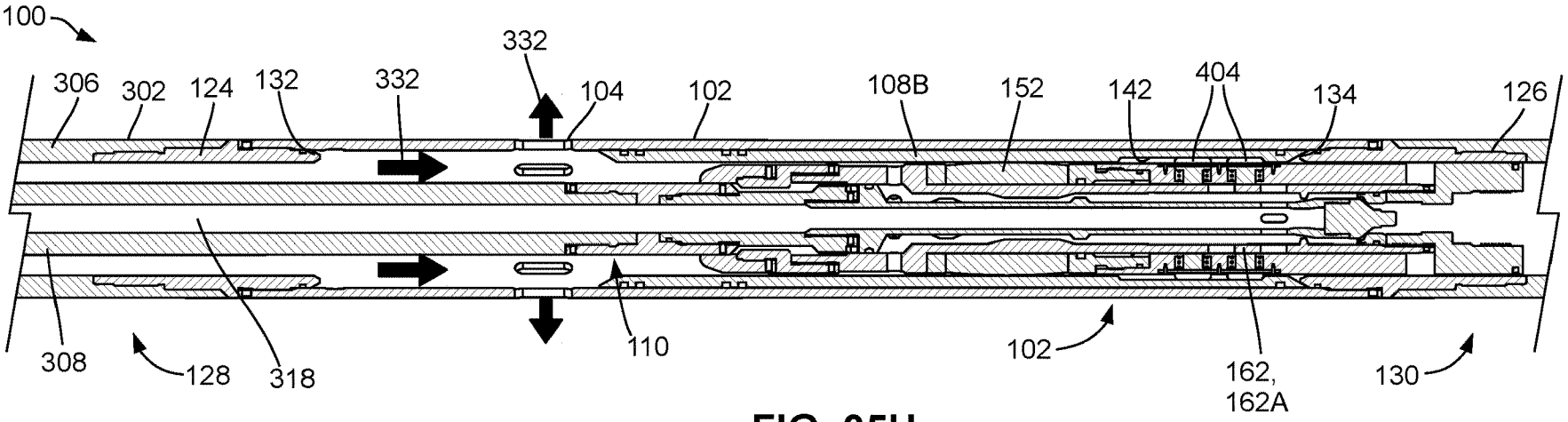
Figure 35I:
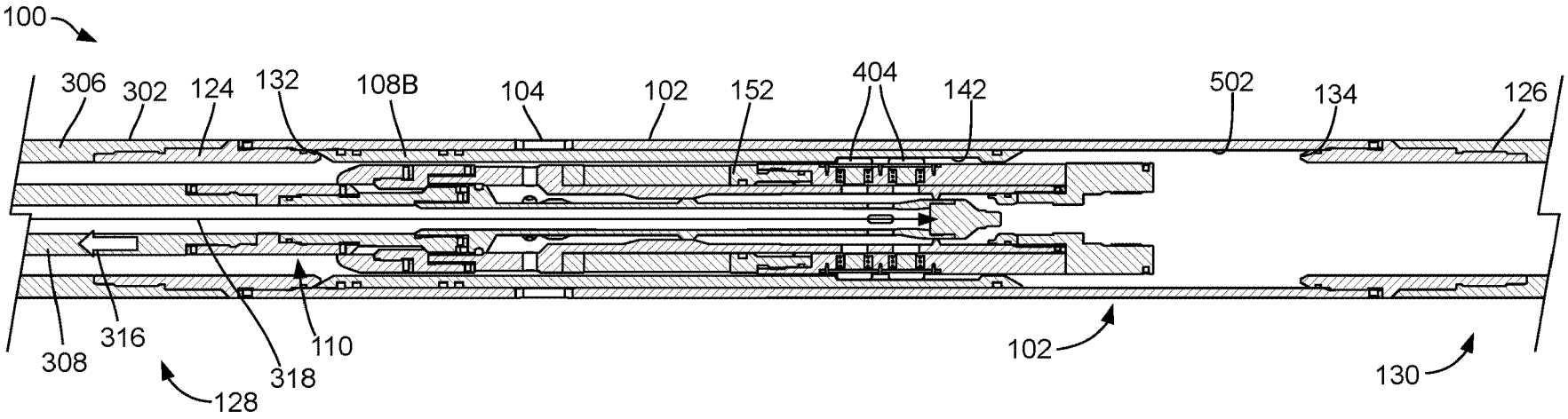
Figure 35J:
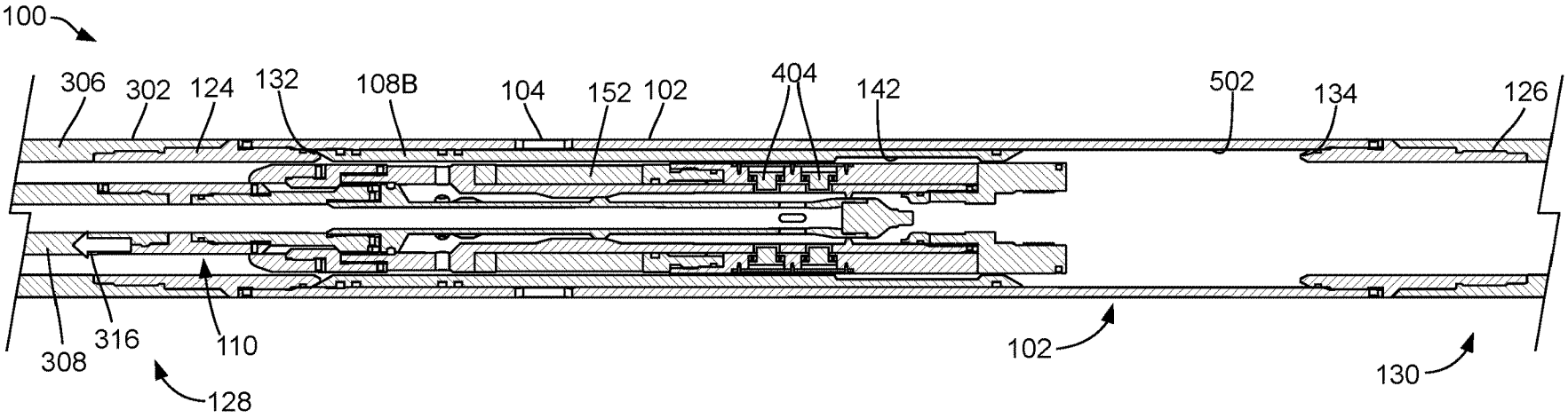
Figure 36:
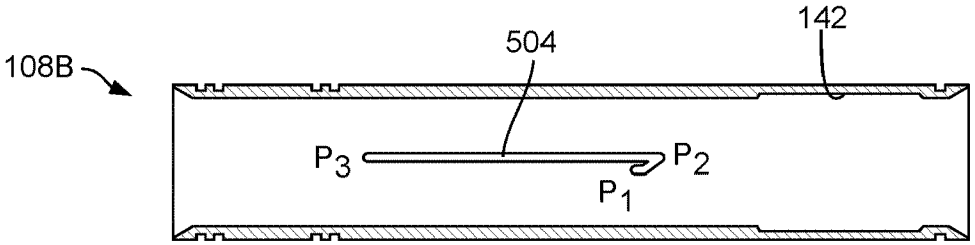
Figure 37:
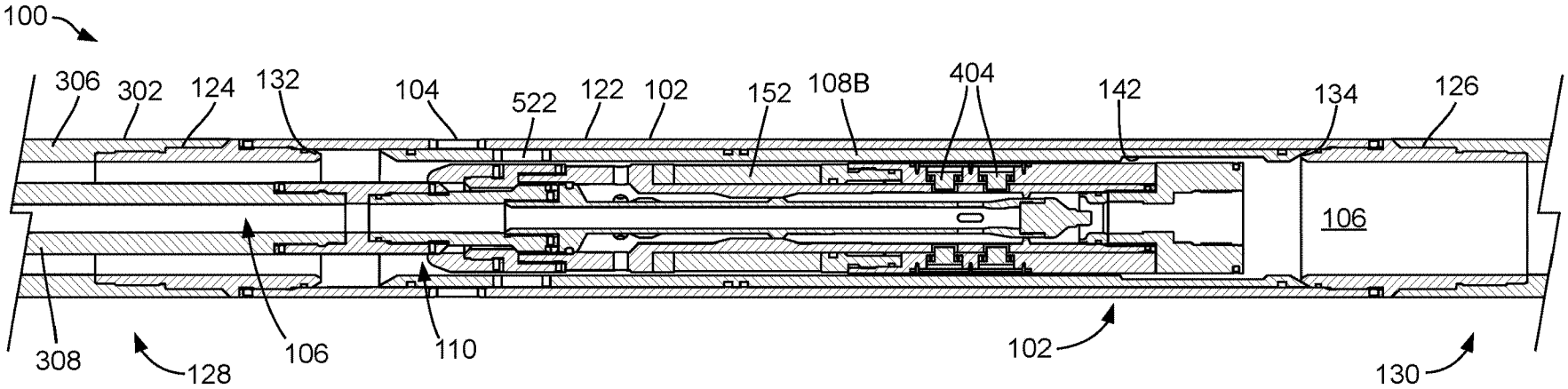
Figure 38A:
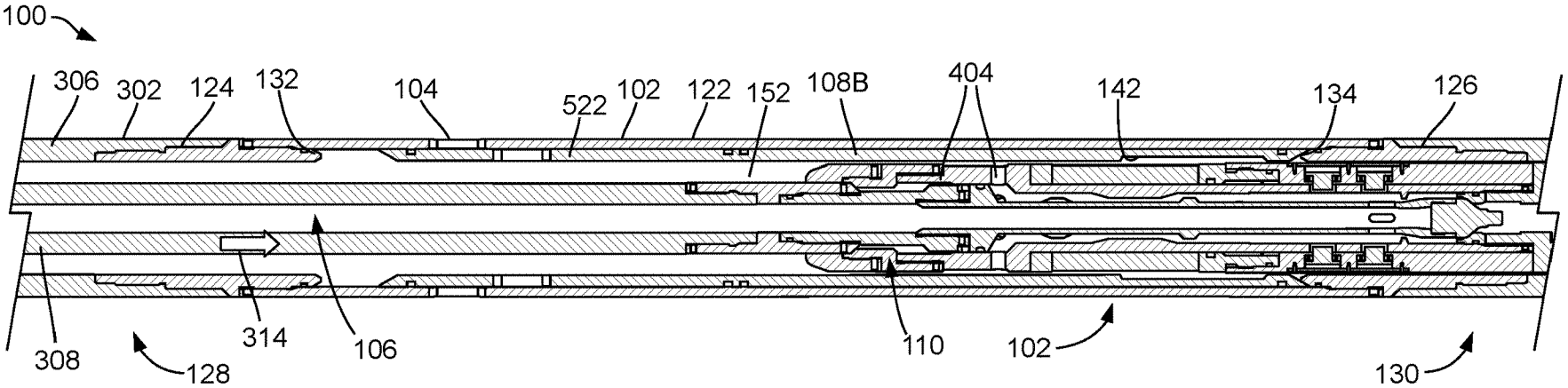
Figure 38B:
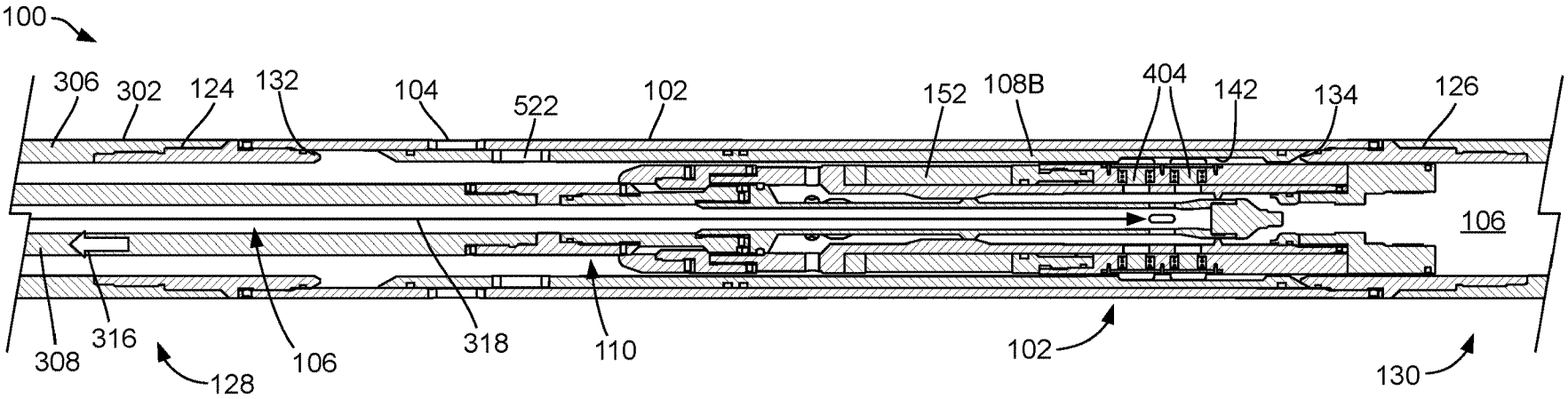
Figure 38C:
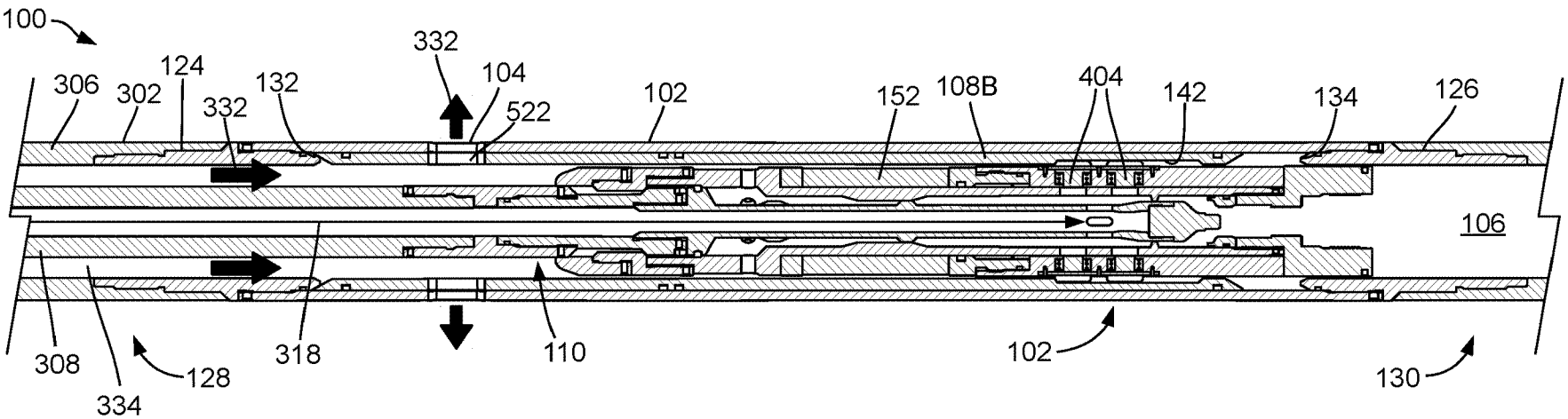
Figure 38D:
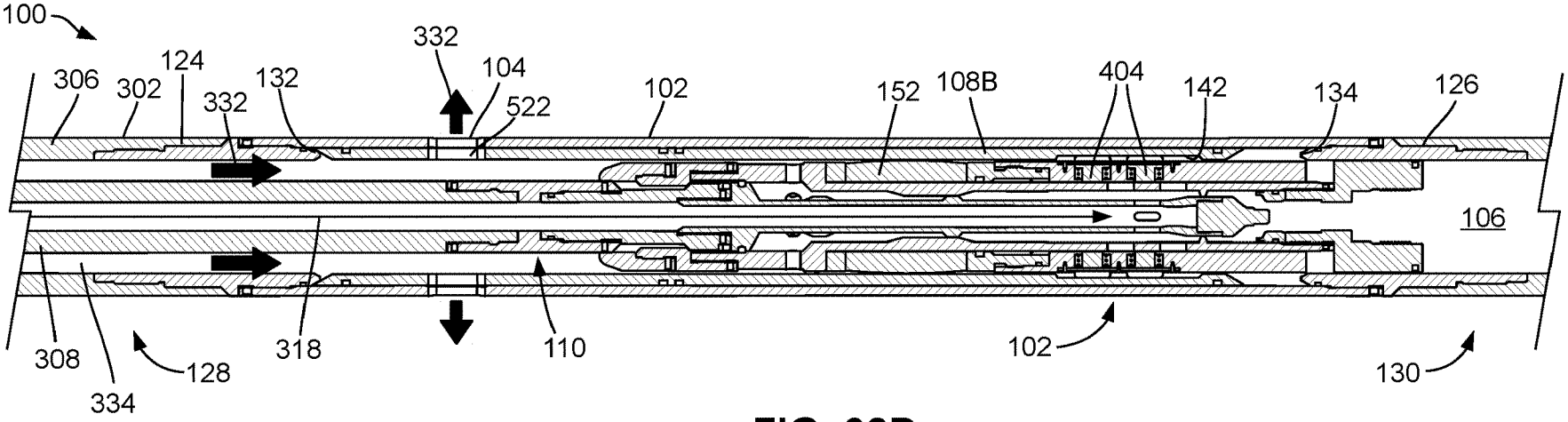

FIG. 19A shows a valve assembly shown in FIG. 3 positioned at a target fracking location in a cased or uncased wellbore, with the sleeve set thereof configured in a downhole closed configuration, FIG. 19B shows an actuation assembly shown in FIG. 6 with one or more slips configured in the radially inwardly retracted configuration running in the wellbore to a location sufficiently downhole to the target fracking location, FIG. 19C shows the actuation assembly shown in FIG. 6 being pulled uphole, FIG. 19D shows a pressurized fluid being injected into the longitudinal bore of the actuation assembly shown in FIG. 6 while the actuation assembly being pulled uphole, FIG. 19E is an enlarged cross-sectional view of the section A of the downhole tool shown in FIG. 19D, FIG. 19F shows the downhole tool wherein the slips are extended into an actuation groove of the sleeve set shown in FIG. 4 and engage therewith, FIG. 19G shows the sleeve set being pulled uphole by the actuation assembly, FIG. 19H shows the actuation assembly being pushed downhole and moving the downhole sliding sleeve of the sleeve set downhole to open the fracking ports of the valve assembly, FIG. 19I shows an uphole portion of the actuation assembly being further moved downhole to extend a tongue under the slips for radially supporting the slips, FIG. 19J shows a high-pressure fracking fluid stream being injected downhole and jetted out from the fracking ports for fracking the formation thereabout, FIG. 19K shows the actuation assembly being further pulled uphole after fracking to configure the slips to the radially inwardly retracted configuration, and FIG. 19L shows the actuation assembly being pulled uphole to another fracking location or to the surface;

FIG. 20 is a schematic diagram showing a process of fracking a subterranean formation using a valve assembly shown in FIG. 3 and an actuation assembly shown in FIG. 6, according to some embodiments of this disclosure;

FIG. 21 shows a high-pressure fracking fluid stream being injected downhole and jetted out from the fracking ports for fracking the formation thereabout, in the fracking process shown in FIG. 20;

FIG. 22 is a side view of a downhole tool, according to some alternative embodiments of this disclosure;

FIG. 23 is a side view of a downhole tool, according to some embodiments of this disclosure;

FIG. 24A is a side view of a downhole tool, according to yet some embodiments of this disclosure;

FIG. 24B is an enlarged cross-sectional view of the section B of the downhole tool shown in FIG. 24A, FIG. 25 is a cross-sectional view of a downhole tool, according to still some embodiments of this disclosure, the downhole tool comprising a valve assembly having a plurality of fracking ports circumferentially distributed on a sidewall thereof, and an actuation assembly movably received in a longitudinal bore of the valve assembly for actuating a sleeve set of the valve assembly between the open configuration and a closed configuration to open and close the fracking ports, wherein the sleeve set shown in this figure is in the open configuration;

FIG. 26 is a cross-sectional view of the actuation assembly shown in FIG. 25, the actuation assembly comprising an actuation housing which receives a compressible sealing element and a button-slip assembly on an outer surface thereof, and axially movably receives in a longitudinal bore thereof an actuation mandrel assembly and a plug assembly;

FIG. 27A is a cross-sectional view of the actuation assembly shown in FIG. 26 without the actuation mandrel assembly;

FIG. 27B is a cross-sectional view of the actuation housing shown in FIG. 26;

FIG. 28A is a plan view of the button-slip assembly shown in FIG. 26 having one or more button-slips in a radially outwardly extended configuration;

FIG. 28B is a cross-sectional view of the button-slip assembly shown in FIG. 26 with the one or more button-slips in the radially outwardly extended configuration;

FIG. 28C is a cross-sectional view of the button-slip assembly shown in FIG. 26 with the one or more button-slips in a radially inwardly retracted configuration;

FIG. 29 is a perspective view of the button-slip shown in FIG. 28A;

FIG. 30 is a cross-sectional view of the actuation mandrel assembly shown in FIG. 26;

FIGS. 31A to 31J show a fracking process using the downhole tool shown in FIG. 25, wherein:

FIG. 31A shows the downhole tool shown in FIG. 25 in a stage similar to that shown in FIG. 19B, FIG. 31B shows the downhole tool shown in FIG. 25 in a stage similar to that shown in FIG. 19C, FIG. 31C shows the downhole tool shown in FIG. 25 in a stage similar to that shown in FIG. 19D, FIG. 31D shows the downhole tool shown in FIG. 25 in a stage similar to that shown in FIG. 19F, FIG. 31E shows the downhole tool shown in FIG. 25 in a stage similar to that shown in FIG. 19G, FIG. 31F shows the downhole tool shown in FIG. 25 in a stage similar to that shown in FIG. 19H, FIG. 31G shows the downhole tool shown in FIG. 25 in a stage similar to that shown in FIG. 19I, FIG. 31H shows the downhole tool shown in FIG. 25 in a stage similar to that shown in FIG. 19J, FIG. 31I shows the downhole tool shown in FIG. 25 in a stage similar to that shown in FIG. 19K; and FIG. 31J shows the downhole tool shown in FIG. 25 in a stage similar to that shown in FIG. 19L;

FIG. 32 is a perspective view of the button-slip shown in FIG. 28A, according to some embodiments of this disclosure;

FIG. 33A is a cross-sectional view of the button-slip assembly shown in FIG. 26 having one or more button-slips shown in FIG. 28A, wherein to the one or more button-slips are in a radially outwardly extended configuration;

FIG. 33B is a cross-sectional view of the button-slip assembly shown in FIG. 26 having one or more button-slips shown in FIG. 28A, wherein to the one or more button-slips are in a radially inwardly retracted configuration;

FIG. 34 is a cross-sectional view of a downhole tool, according to some embodiments of this disclosure, wherein the valve assembly of the downhole tool comprises a valve body receiving therein a single sliding sleeve, the sliding sleeve initially secured at an uphole position with a small distance to an uphole stopper of the valve body for closing the fracking ports;

FIGS. 35A to 35J show a fracking process using the downhole tool shown in FIG. 34, wherein:

FIG. 35A shows an actuation assembly shown in FIG. 26 with one or more button-slips configured in the radially inwardly retracted configuration running in the wellbore to a location sufficiently downhole to the target fracking location, FIG. 35B shows the actuation assembly shown in FIG. 26 being pulled uphole while a pressurized fluid is injected into the longitudinal bore of the actuation assembly to actuate the button-slips to the radially outwardly extended configuration to engage a gap between the sliding sleeve and a downhole stopper, FIG. 35C shows the actuation assembly shown in FIG. 26 being pulled uphole while the pressurized fluid is maintained to shear one or more shear pins of the sliding sleeve and move the sliding sleeve slightly uphole, FIG. 35D shows the actuation assembly shown in FIG. 26 is pulled uphole and "jumps" slightly uphole to an actuation groove of the sliding sleeve, FIG. 35E shows the actuation assembly shown in FIG. 26 is pushed downhole while the pressurized fluid is maintained to actuate the slips to extend into an actuation groove of the sliding sleeve and engage therewith, FIG. 35F shows the actuation assembly shown in FIG. 26 being pushed downhole while the pressurized fluid is maintained to slide the sliding sleeve downhole and open the fracking ports of the valve assembly, FIG. 35G shows an uphole portion of the actuation assembly being further moved downhole to extend a tongue under the slips for radially supporting the slips, FIG. 35H shows a high-pressure fracking fluid stream being injected downhole and jetted out from the fracking ports for fracking the formation thereabout, FIG. 35I shows the actuation assembly, after fracking, being further pulled uphole while the pressurized fluid is maintained to slide the sliding sleeve uphole to close the fracking ports of the valve assembly, and FIG. 35J shows the actuation assembly being further pulled uphole while the pressurized fluid is removed to configure the slips to the radially inwardly retracted configuration;

FIG. 36 is a cross-sectional view of the sliding sleeve of the downhole tool shown in FIG. 34, according to some alternative embodiments;

FIG. 37 is a cross-sectional view of a downhole tool, according to some embodiments of this disclosure, wherein the valve assembly of the downhole tool comprises a valve body receiving therein a single sliding sleeve, the sliding sleeve initially secured at a downhole position for closing the fracking ports and movable to an uphole open position for opening the fracking ports; and FIGS. 38A to 38D show a fracking process using the downhole tool shown in FIG. 37, wherein:

FIG. 38A shows an actuation assembly shown in FIG. 26 with one or more button-slips configured in the radially inwardly retracted configuration running in the wellbore to a location sufficiently downhole to the target fracking location, FIG. 38B shows the actuation assembly shown in FIG. 26 being pulled uphole while a pressurized fluid is injected into the longitudinal bore of the actuation assembly to actuate the button-slips to the radially outwardly extended configuration to engage an actuation groove of the sliding sleeve, FIG. 38C shows the actuation assembly shown in FIG. 26 being further pulled uphole while the pressurized fluid is maintained to slide the sliding sleeve to the uphole open position to open the fracking ports of the valve assembly, and then a high-pressure fracking fluid stream being injected downhole and jetted out from the fracking ports for fracking the formation thereabout, and FIG. 38D shows the actuation assembly being pushed downhole by the high-pressure fracking fluid stream to extend a tongue under the slips for radially supporting the slips.

DETAILED DESCRIPTION

Embodiments herein disclose an apparatus and method for downhole fracking using a pressure-actuated sliding sleeve set. In the following description, the term "downhole" refers to a direction along a wellbore towards the end of the wellbore, and may (e.g., in a vertical wellbore) or may not (e.g., in a horizontal wellbore) coincide with a "downward" direction. The term "uphole" refers to a direction along a wellbore towards surface, and may (e.g., in a vertical wellbore) or may not (e.g., in a horizontal wellbore) coincide with an "upward" direction.

Figure 1:
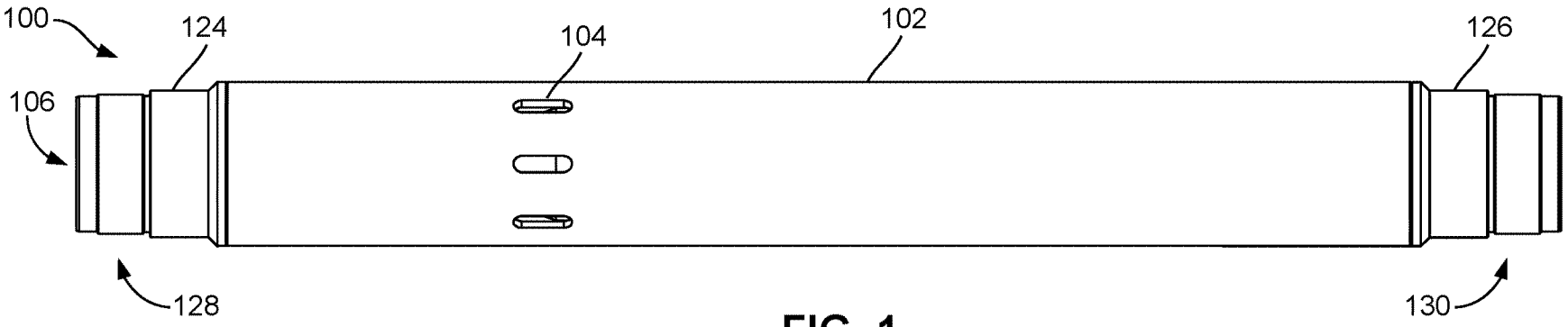
Figure 2:
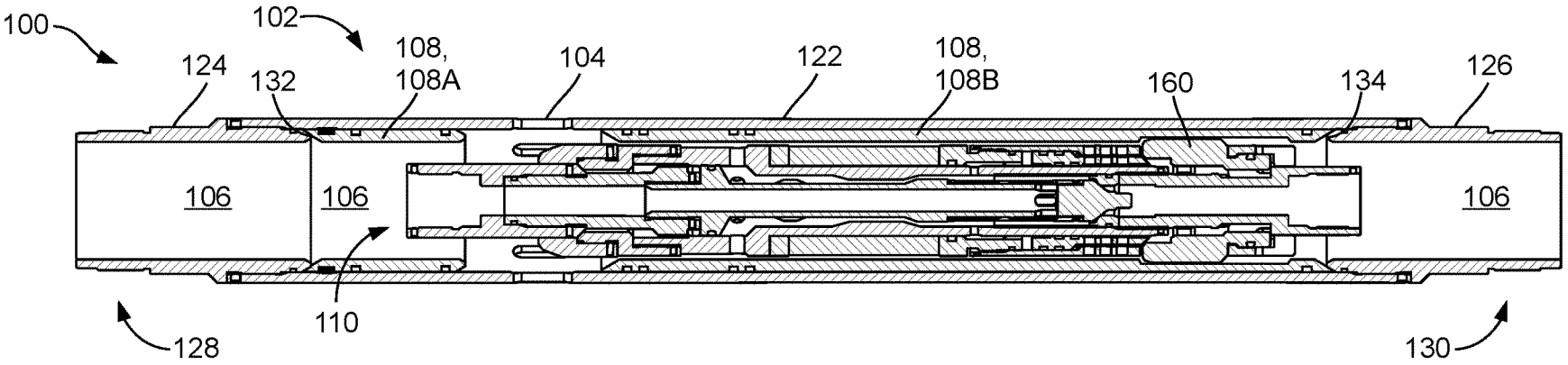

Turning to FIGS. 1 and 2, a downhole tool is shown and is generally identified using reference numeral 100. In these embodiments, the downhole tool 100 comprises a valve assembly 102 having a plurality of fracking ports 104 circumferentially distributed on a sidewall thereof and a longitudinal bore 106 extending therethrough. An actuation assembly 110 is movably received in the longitudinal bore 106 of the valve assembly 102.

Also shown in FIGS. 3 and 4, the valve assembly 102 comprises a tubular valve housing 122 having the plurality of fracking ports 104. A sleeve set 108 is received in a longitudinal bore 106 of the valve housing 122 and is slidable between an open configuration and a closed configuration. For example, the sleeve set 108 shown in FIG. 2 is in the open configuration opening the plurality of fracking ports 104 and the sleeve set 108 shown in FIG. 3 is in a closed configuration closing the plurality of fracking ports 104.

The valve housing 122 is coupled to two couplings 124 and 126 at an uphole end 128 and a downhole end 130, respectively, using suitable coupling means such as threading, bolting, welding, and/or the like. The couplings 124 and 126 extend into the tubular body 122 and form a pair of stoppers 132 and 134, respectively, for limiting the sleeve set 108 movable therebetween. The valve housing 122 also comprises a retaining groove 136 adjacent the uphole stopper 132.

As shown in FIG. 4, the sleeve set 108 in these embodiments comprises an uphole sliding sleeve 108A and a downhole sliding sleeve 108B slidably received in the tubular valve housing 122 between the stoppers 132 and 134. The uphole sliding sleeve 108A comprises an external gland snap-ring 138 adjacent an uphole end thereof for engaging the retaining groove 136 on the valve housing 122 for retaining the uphole sliding sleeve 108A adjacent the uphole stopper 132 when the uphole sliding sleeve 108A is shifted uphole.

The downhole sliding sleeve 108B comprises a circumferential actuation groove 142 adjacent a downhole end 130 thereof for engaging the actuation assembly 110 to open and close the fracking ports 104.

Figure 5:
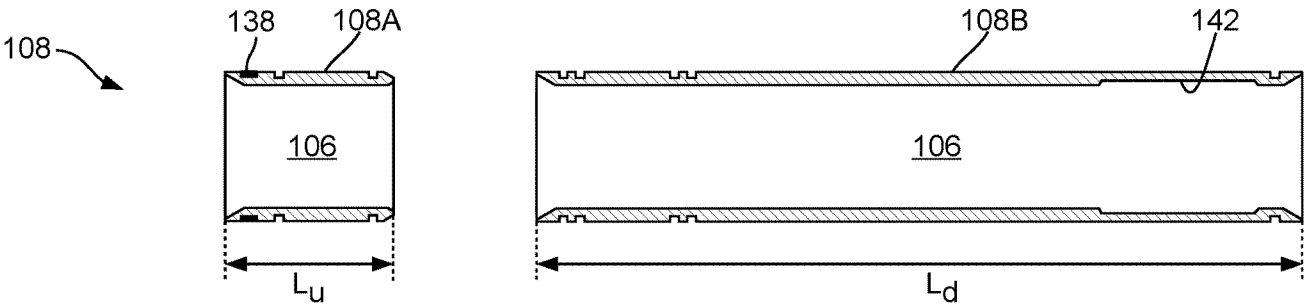
FIG. 5 is a cross-sectional view of the sleeve set of the valve assembly shown in FIG. 3, the sleeve set comprising an uphole sliding sleeve and a downhole sliding sleeve.

The uphole sliding sleeve 108A has a length $L_u$ shorter than the distance $D_u$, between the uphole stopper 132 and the fracking port 104, and the downhole sliding sleeve 108A has a length $L_d$ shorter than the distance $D_d$ between the downhole stopper 134 and the fracking ports 104 (see FIGS. 4 and 5), so as to open the fracking ports 104 when the sleeve set 108 is configured to the open configuration in which the uphole and downhole sliding sleeves 108A and 108B are actuated to engage the uphole and downhole stoppers 132 and 134, respectively (see FIG. 2).

As shown in FIG. 3, the total length ($L_u$+$L_d$) of the uphole and downhole sliding sleeves 108A and 108B is longer than the distance $D_d$ between the downhole stopper 134 and the fracking ports 104, so as to close the fracking ports 104 when the sleeve set 108 is configured to the closed configuration in which the uphole and downhole sliding sleeves 108A and 108B are actuated to a downhole position with the uphole sliding sleeve 108A engaging the downhole sliding sleeve 108B and the downhole sliding sleeve 108B engaging the downhole stopper 134.

FIG. 6 is a cross-sectional view of the actuation assembly 110. As shown, the actuation assembly 110 comprises an actuation housing 150 axially movably receiving a compressible sealing element 152 and a slip assembly 154 on an outer surface thereof, and axially movably receiving an actuation mandrel assembly 156 and a plug assembly 158 in a longitudinal bore 106 thereof. The slip assembly 154 comprises an axially movable piston 204 configured for actuating one or more radially outwardly movable slips or dogs 160 (described later).

When the slips 160 are in a radially inwardly retracted or collapsed configuration, the actuation assembly 110 has an outer diameter (OD) smaller than the inner diameter (ID) of the sleeve set 108 to allow the actuation assembly 110 to move therethrough as needed.

When the slips 160 are in a radially outwardly extended configuration (see FIG. 2), the slips 160 may engage the circumferential actuation groove 142 to axially move the sleeve set 108.

Figure 7A:
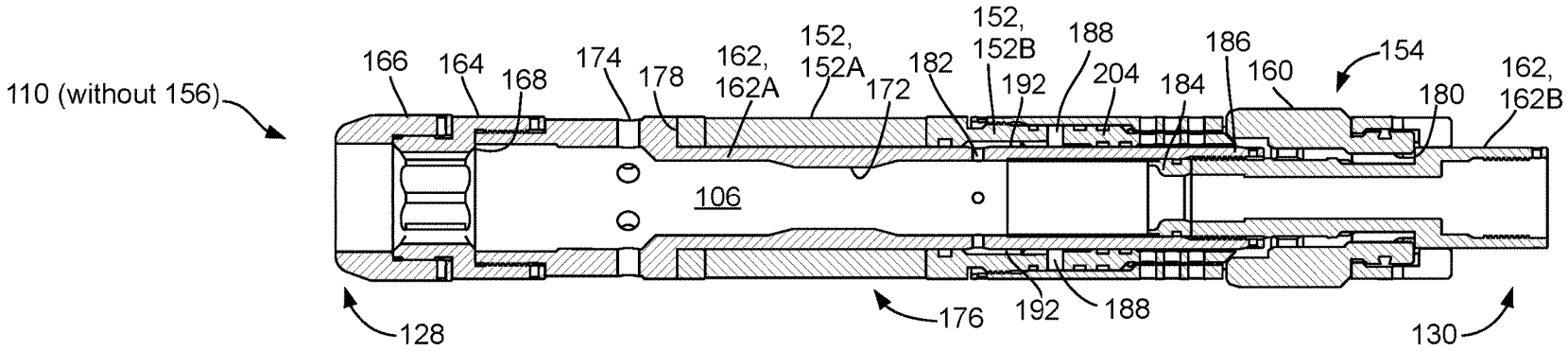
FIG. 7A is a cross-sectional view of the actuation assembly of the downhole tool shown in FIG. 2 without the actuation mandrel assembly.
Figure 7B:
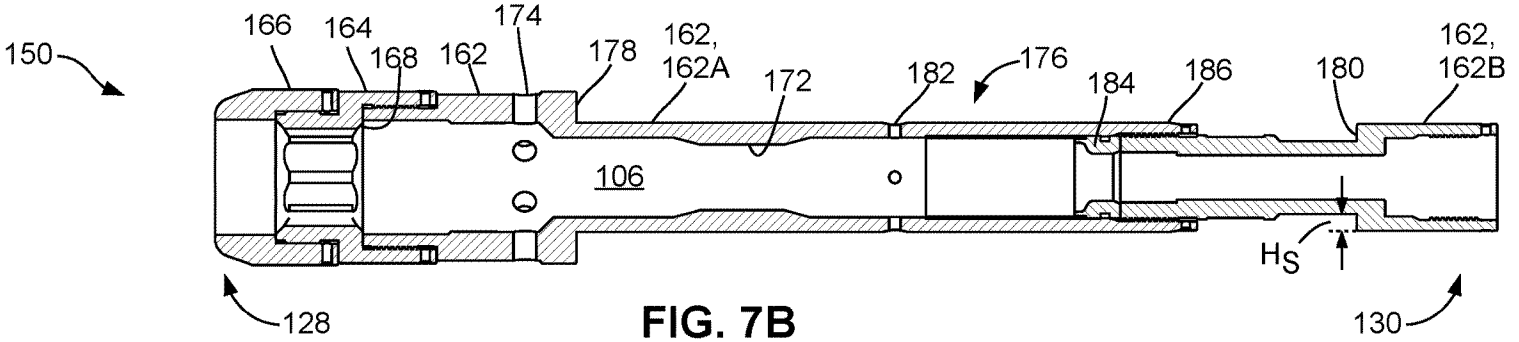
FIG. 7B is a cross-sectional view of the actuation housing of the actuation assembly shown in FIG. 6.

As shown in FIGS. 7A and 7B, the actuation housing 150 comprises an actuation housing body 162 coupled on the uphole side thereof to an actuation coupling adaptor 164 which is in turn coupled to an actuation coupling 166 (which is a consumable wear piece as it takes the brunt of the annular fracking fluid flow; described in more detail later) by using suitable coupling means such as threading, bolting, pins, welding, and/or the like. The actuation coupling adaptor 164 forms a circumferential ridge 168 on an inner surface thereof for limiting the uphole and/or downhole movement of the actuation mandrel assembly 156.

The actuation housing body 162 comprises an uphole body section 162A and a downhole body section 162B coupled together using suitable means such as threading, bolting, pins, welding, and/or the like. The uphole body section 162A comprises a section 172 with a reduced ID such as a circumferential inner ridge radially inwardly extending from the inner surface thereof, for forming a flow-restriction structure against the actuation mandrel assembly 156 to facilitate the radially outwardly actuation of the slips 160 using a fluid pressure (described in more detail later).

On its outer surface, the actuation housing body 162 comprises one or more clean-out ports 174 adjacent an uphole end 128 thereof. Downhole to the clean-out ports 174, the actuation housing body 162 comprises a circumferential recess 176 on the outer surface thereof and one or more fluid-actuation ports 182 in the recess 176.

The circumferential recess 176 axially extending from an uphole shoulder 178 on the uphole body section 162A to a downhole shoulder 180 (having a radial height of $H_S$) on the downhole body section 162B for receiving therein the compressible sealing element 152 and the slip assembly 154. The axial length of the circumferential recess 176 between the uphole and downhole shoulders 178 and 180 is greater than the total axial length of the compressible sealing element 152, the piston 204, and the slip 160 such that a gap 188 between the compressible sealing element 152 (or the coupling section 152B thereof) and the piston 204 is maintained for applying a downhole actuation force to the piston 204 (detailed in more detail later).

In these embodiments, the downhole body section 162B extends into the uphole body section 162A and forms a circumferential shoulder for supporting a plug seat 184 received in the uphole body section 162A. On the outer surface, the downhole end 186 of the uphole body section 162A forms a supporting structure (also denoted a "tongue") which, at certain stage of operation, may move under the radially outwardly extended slips 160 to support the slips 160 in position (described later).

Figure 8:
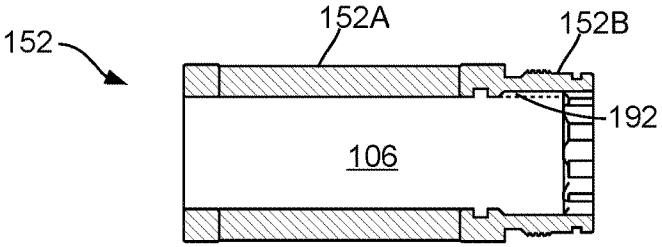
FIG. 8 is a cross-sectional view of the compressible sealing element of the actuation assembly shown in FIG. 6.

FIG. 8 is a cross-sectional view of the compressible sealing element 152. As shown, the compressible sealing element 152 comprises a main section 152A engaging or coupled to a coupling section 152B downhole thereto for movably coupling to the slip assembly 154. The main section 152A of the compressible sealing element 152 is made of a suitable elastic material such as rubber so as to be axially compressible, and has an ID substantively matching the OD of the circumferential recess 176 on the uphole body section 162A of the actuation housing body 162. The coupling section 152B of the compressible sealing element 152 comprises suitable coupling means such as threading, bolt hole(s), pin hole(s), and/or the like on its outer surface for extending into a corresponding coupling section of the slip assembly 154 and coupling thereto. The ID of the coupling section 152B of the compressible sealing element 152 is greater than the OD of the circumferential recess 176 on the uphole body section 162A of the actuation housing body 162 for forming a fluid passage 192 in fluid communication with the one or more actuation ports 182 (also see FIG. 6B).

Figure 9:
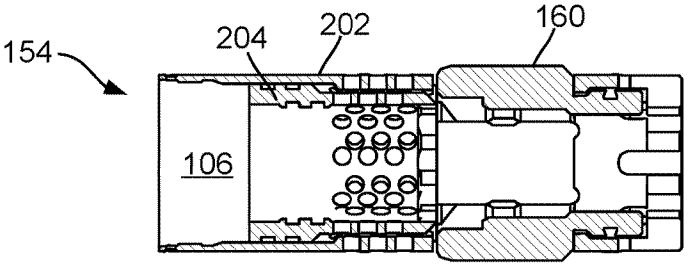
FIG. 9 is a cross-sectional view of the slip assembly of the actuation assembly shown in FIG. 6, the slip assembly comprising a slip holder receiving a piston in a bore thereof and one or more slips radially outwardly movable from an outer surface thereof.

FIG. 9 is a cross-sectional view of the slip assembly 154. As shown, the slip assembly 154 in these embodiments comprises a slip holder 202 receiving the piston 204 in a bore thereof and one or more slips 160 radially outwardly movable from an outer surface thereof.

Figure 10:
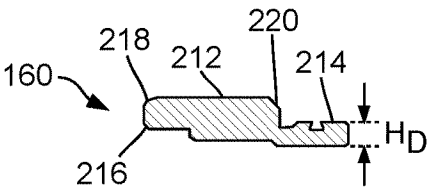
FIG. 10 is a cross-sectional view of the slip of the slip assembly shown in FIG. 9.

As shown in FIG. 10, the slip 160 comprises a main section 212 and a downhole section 214. The main section 212 comprises a plurality of chamfers, including an uphole-inward-facing chamfer 216 at the uphole inward side thereof, an uphole-outward-facing chamfer 218 at the uphole outward side thereof, and a downhole-outward-facing chamfer 220 at the downhole outward side thereof for converting axial forces to radial forces to radially actuate the slip 160. For example, the uphole-inward-facing chamfer 216 at the uphole side 128 thereof may engage a cone-shaped end of the piston 204 (see FIG. 12) to radially outwardly actuate the slip 160.

The downhole section 214 of the slip 160 has a radial thickness $H_D$ smaller than that of the main section 212.

Figure 11:
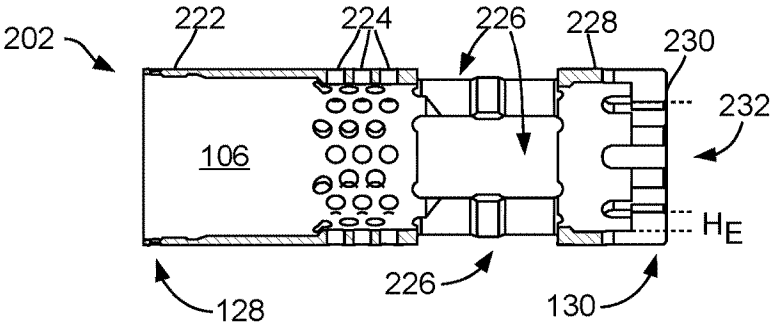
FIG. 11 is a cross-sectional view of the slip holder of the slip assembly shown in FIG. 9.

As shown in FIG. 11, the slip holder 202 has a cylindrical shape with a longitudinal bore 106 and an ID greater than the OD of the downhole body section 162B at the recess area 176. The slip holder 202 comprises a coupling section 222 about the uphole end 128 thereof for coupling to the coupling section 152B of the compressible sealing element 152.

Downhole from the coupling section 152B, the slip holder 202 comprises a plurality of flushing holes 224 for flushing the tool 100 to remove any debris or solids entering therein, and one or more windows 226 on a sidewall thereof adjacent the downhole end 130 for receiving the one or more slips 160 therein. The one or more windows 226 have a longitudinal length greater than or equal to that of the main section 212 of the slips 160. When the slips 160 are received in the windows 226, the downhole section 214 of each slip 160 is received into the bore 106 of the slip holder 202 such that the sidewall portion 228 of the slip holder 202 downhole to the windows 226 retains the slips 106.

The slip holder 202 further comprises a ring-shaped end wall 230 at the downhole end 130 having a central opening 232 with an ID substantially the same as the OD of the downhole body section 162B of the actuation housing body 162 for allowing the downhole body section 162B to extend therethrough. The radial thickness of the ring-shaped end wall 230, calculated as the difference of the ID of the slip holder 202 and that of the end-wall opening 232, is denoted as $H_E$. In these embodiments, the radial thickness $H_E$ of the end wall 230, the radial height of $H_S$ of the downhole shoulder 180 of the circumferential recess 176 (see FIG. 7B), and the radial thickness $H_D$ of the downhole section 214 of the slip 160 (see FIG. 10) have a relationship of $H_D>H_E$ and $H_D>H_S$ for preventing the compressible sealing element 152 and the slip assembly 154 from sliding off the actuation housing 150.

Figure 12:
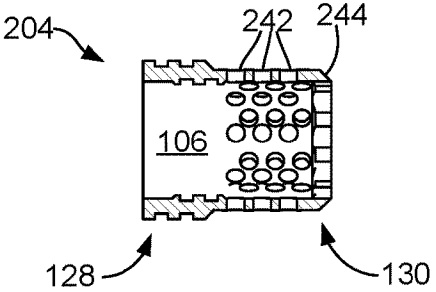
FIG. 12 is a cross-sectional view of the piston of the slip assembly shown in FIG. 9.

FIG. 12 is a cross-sectional view of the piston 204. The piston 204 has a tubular shape with an OD substantially the same as the ID of the slip holder 202. Preferably, the piston 204 has an increased sidewall thickness or comprises an outwardly extended circumferential ridge about an uphole end thereof for facilitating fluid actuation of the piston 204. As shown in FIG. 12, the piston 204 comprises a plurality of flushing holes 242 for flushing the tool 100 to remove any debris or solids entering therein, and a cone-shaped downhole end 244 for engaging the chamfer 216 of the slip 160 to radially outwardly actuate the slip 160.

Figure 13:
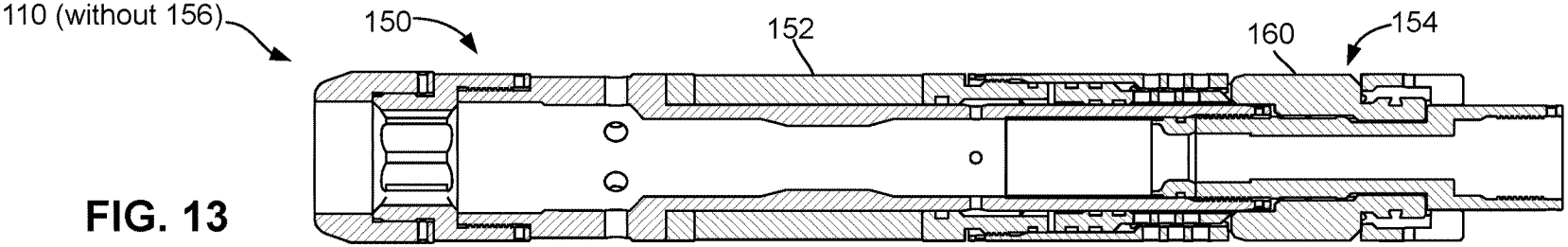
FIGS. 13 and 14 show the compressible sealing element shown in FIG. 8 and the slip assembly shown in FIG. 9 assembled onto the actuation housing shown in FIG. 7B, wherein In FIG. 13, the slips of the slip assembly are in a radially inwardly retracted or collapsed configuration, and in FIG. 14, the slips are actuated to a radially outwardly extended configuration.
Figure 14:
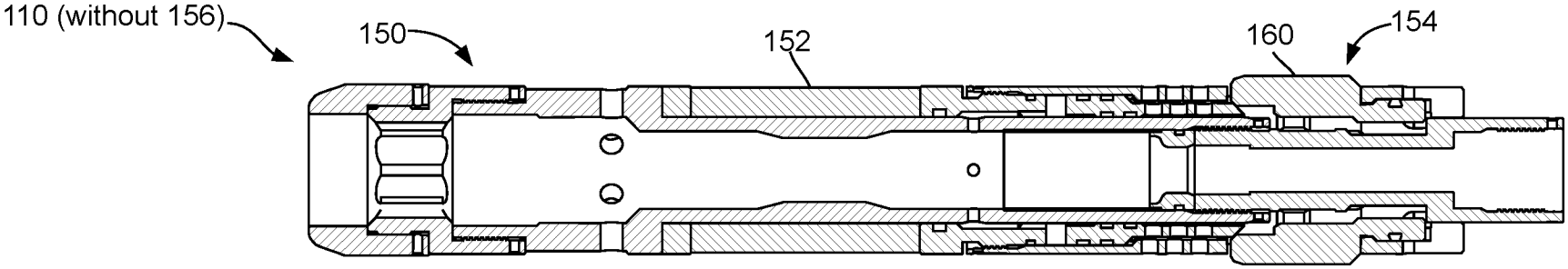

FIGS. 13 and 14 show the compressible sealing element 152 and the slip assembly 154 assembled onto the actuation housing 150. In FIG. 13, the slips 160 are in the radially inwardly retracted or retracted configuration. In FIG. 14, the slips 160 are actuated to a radially outwardly extended configuration.

As the radial thickness $H_D$ of the downhole section 214 of the slip 160 is greater than the radial thickness $H_E$ of the end wall 230 of the slip holder 202 and is also greater than the radial height of $H_S$ of the downhole shoulder 180 of the circumferential recess 176, the compressible sealing element 152 and the slip assembly 154 would not slide downhole off the actuation housing 150 regardless whether the slips 160 are configured in the radially inwardly retracted configuration or are actuated to the radially outwardly extended configuration.

Figure 15:
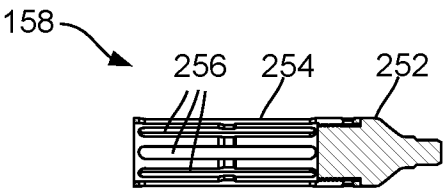
FIG. 15 is a cross-sectional view of the plug assembly of the actuation assembly shown in FIG. 6.

FIG. 15 is a cross-sectional view of the plug assembly 158. The plug assembly 158 comprises a plug 252 for movably seating against the plug seat 184 of the actuation housing 150 and a cylindrical collet 254 extending uphole therefrom. The collet 254 comprises a plurality of slots 256 on a sidewall thereof.

Figure 16:
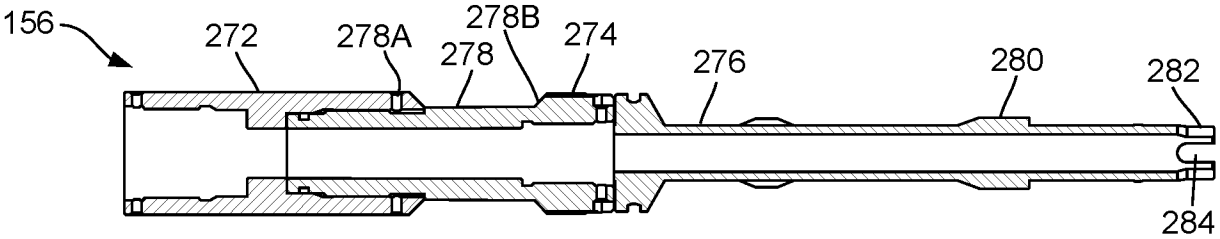
FIG. 16 is a cross-sectional view of the actuation mandrel assembly of the actuation assembly shown in FIG. 6.

FIG. 16 is a cross-sectional view of the actuation mandrel assembly 156. As shown, the actuation mandrel assembly 156 comprises a coupling 272 for coupling to a tubing (not shown) uphole thereto. The coupling 272 couples to a coupling adaptor 274 downhole thereto and the coupling adaptor 274 in turn couples to a hollow mandrel 276 downhole thereto. The coupling 272 and the coupling adaptor 274 have an OD substantially the same as the ID of the actuation housing 150 (see FIG. 6) and form a circumferential recess 278 between an uphole edge 278A and a downhole edge 278B thereof. The circumferential recess 278 has an axial length greater than that of the circumferential ridge 168 of the actuation housing 150 (see FIG. 7B) such that the actuation mandrel assembly 156 may axially move in the bore 106 of the actuation housing 150 without sliding out thereof.

The hollow mandrel 276 generally has an OD smaller than the ID of the actuation housing 150 to allow it movable in the bore 106 of the actuation housing 150, and the downhole end 282 thereof comprises a plurality of openings or slots 284 for fluid communication.

In these embodiments, the hollow mandrel 276 comprises an OD-enlarged section 280 with an OD slightly smaller than the ID of the ID-reduced section 172 of the actuation housing body 162, at an axial location engageable therewith without contact, when the actuation mandrel assembly 156 is pulled or otherwise configured to an uphole position. For example, in some embodiments, the ID-reduced section 172 has an ID of 1.125" (i.e., 1.125 inches) +0.005"/−0.000", and the OD-enlarged section 280 has an OD of 1.120"+0.000"/−0.005", which give rise to a 0.005" to 0.015" clearance therebetween.

Thus, when the actuation mandrel assembly 156 is pulled or otherwise configured to an uphole position, the OD-enlarged section 280 of the hollow mandrel 276 and the ID-reduced section 172 of the actuation housing body 162 may form a flow restriction for maintaining the fluid pressure in a related fluid path (described later) without the risk of wearing caused by the relative movement between the OD-enlarged section 280 and the ID-reduced section 172 and/or the risk of damage during an equalization process after fracking.

Those skilled in the art will appreciate that, in some embodiments, the OD of the OD-enlarged section 280 of the hollow mandrel 276 may be substantially the same as the ID of the ID-reduced section 172 of the actuation housing body 162 to allow them to form a seal that completely blocks the fluid communication between the two opposite sides thereof, when the actuation mandrel assembly 156 is pulled or otherwise configured to an uphole position. Such a seal will also maintain the fluid pressure in the related fluid path. However, the relative movement between the OD-enlarged section 280 of the hollow mandrel 276 and the ID-reduced section 172 of the actuation housing body 162 may cause either or both of them to wear out and fail.

Figure 17:
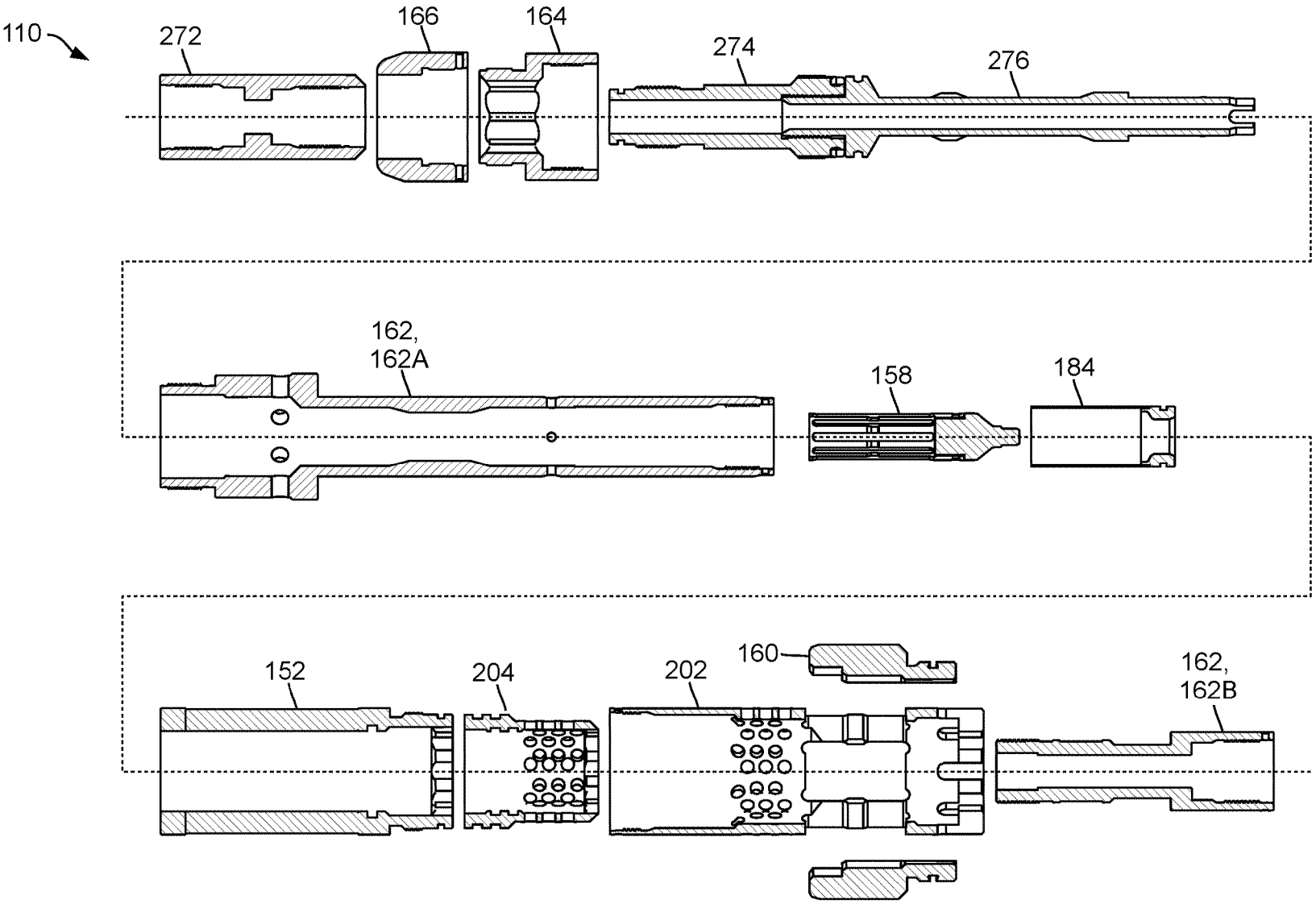
FIG. 17 is an exploded cross-sectional view of the actuation assembly shown in FIG. 6 which also illustrates how to assemble the actuation assembly.

FIG. 17 is an exploded cross-sectional view of the actuation assembly 110 which also illustrates how to assemble the actuation assembly 110.

Figure 18:
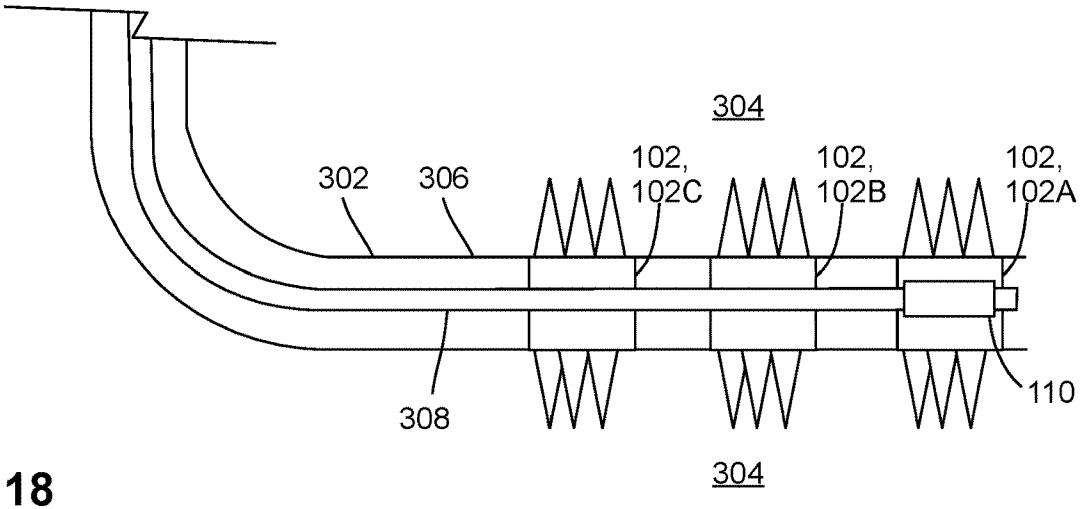
FIG. 18 is a schematic diagram showing fracking a subterranean formation using a plurality of valve assemblies shown in FIG. 3 and one actuation assembly shown in FIG. 6, according to some embodiments of this disclosure.

The downhole tool 100 may be used in a downhole fracking system for subterranean formation fracking. In various embodiments, the downhole fracking system may comprise one or more spaced valve assemblies 102 and one actuation assembly 110 may be used for actuating the valve assemblies 102 to the open configuration for fracking. FIG. 18 shows an example of a downhole fracking system having a plurality of spaced valve assemblies 102 for subterranean formation fracking.

As shown, a wellbore having a horizontal wellbore portion 302 is drilled in the subterranean formation 304. Although FIG. 18 shows a horizontal well 302, those skilled in the art will appreciate that the well may alternatively be a vertical well or a deviated well.

In various embodiments, the wellbore 302 may be an oil or gas well and is cased with a casing string 306 which may be cemented or uncemented in the wellbore 302.

The casing string 306 comprises a plurality of valve assemblies 102 spaced by other suitable subs. Each valve assembly 102 is used for fracturing a respective frack zone or stage and the sleeve set 108 thereof is in the closed configuration before fracking. Hereinafter, the term "zone"

and "stage" refer to a portion of the wellbore to be fractured, and may be used interchangeably.

In some embodiments, an actuation assembly 110 is coupled to a coiled or jointed tubing 308 for fracking one stage at a time starting from the toe-most stage and then moving uphole. During the fracking of each stage, the actuation assembly 110 is extended into the stage to be fractured and actuates the sleeve set 108 of the valve assembly 102 to the open configuration and opens the fracking ports 104 to provide access to the formation 304.

For example, the actuation assembly 110 may first extend into the valve assembly 102A in the toe-most stage and actuate the sleeve set 108 thereof to open the fracking ports 104 for fracking. As will be described in more detail later, the actuation of the sleeve set 108 also seals the bore 106 of the valve assembly 102A at a position downhole to the fracking ports 104. A high-pressure fracking fluid stream is then pumped downhole along the annulus between the casing string 306 and the coiled tubing 308 and jets out of the opened fracking ports 104 for fracking the formation 304 thereabout.

After fracking, the fracking ports 104 may be closed as needed to isolate the fractured stage for various purposes such as for preventing cross flow to previously fractured stages, minimizing sand backflow into the wellbore 302 during production, and/or the like. Then, the actuation assembly 110 is moved uphole into the valve assembly 102B for fracking the stage thereof, and then the valve assembly 102C after the stage of the valve assembly 102B is fractured.

In the following, the fracking process is described with an example of fracking a formation stage using one valve assembly and one actuation assembly 110 as shown in FIGS. 19A to 19L. Those skilled in the art will appreciate that the process of fracking a formation stage using more than one valve assembly and one actuation assembly 110 is similar to the example shown in FIGS. 19A to 19L.

As shown in FIG. 19A, the valve assembly 102 is prepared by configuring the sleeve set 108 thereof in the closed configuration thereby closing the one or more fracking ports 104. In these embodiments, either the uphole sliding sleeve 108A or both the uphole and downhole sliding sleeves 108A and 108B are retained at the closed configuration by using one or more shear pins (not shown).

The valve assembly 102 is then coupled to a casing string 306 of about the same ID thereof (e.g., both the valve assembly 102 (and in particular the sleeve set 108 thereof) and the casing string 306 having an ID of about 4"), inserted into a wellbore 302, and positioned therein at a target fracking location for fracking the subterranean formation about a section of the wellbore 302. The casing string 306 may be cemented or uncemented.

As shown in FIG. 19B, the actuation assembly 110 of the downhole tool 100 is prepared by configuring the one or more slips 160 to the radially inwardly retracted configuration (i.e., retracting into the slip windows 226). Then, the actuation assembly 110 is coupled to a suitable extension means such as a coiled tubing 308 that has an ID about the same as that of the actuation assembly 110 (for example a coiled tubing of 2.375" OD and 2" ID for maximizing annular flow area and minimizing velocity and thus erosion), and then runs downhole (as indicated by the arrow 314) in the wellbore 302 to a location sufficiently downhole to the target fracking location. Thus, the running of the actuation assembly 110 does not need to know the exact target fracking location and only needs to ensure that the actuation assembly 110 has run to a location sufficiently downhole to the target fracking location.

As shown in FIG. 19C, after the actuation assembly 110 has run to a location in the wellbore 302 sufficiently downhole to the target fracking location, the actuation assembly 110 is pulled uphole as indicated by the arrow 316.

As shown in FIG. 19D, the actuation mandrel assembly 156 is pulled uphole relative to the actuation housing 150 such that the downhole edge 278B of the recess 278 of the actuation mandrel assembly 156 engages the circumferential ridge 168 of the actuation housing 150. While the actuation assembly 110 is pulled uphole, a pressurized fluid 318 is injected through the coiled tubing 308 and into the longitudinal bore 106 of the actuation assembly 110.

As shown in FIGS. 19D and 19E, the ID-reduced section 172 of the actuation housing 150 and the OD-enlarged section 280 of the mandrel 276 engage with each other without contact to form a flow restriction (denoted using reference numeral 172-280) with a sufficiently small gap therebetween. The plug assembly 158 is pressed by the pressurized fluid 318 against the plug seat 184 and forms a metal-to-metal seal.

A fluid path is thus formed, guiding the pressurized fluid 318 to flow through the bore 106 of the actuation mandrel assembly 156, the slots 284 of the hollow mandrel 276, the annulus 322 between the collet 254/hollow mandrel 276 and the actuation housing 150, the slots 256 of the plug assembly 158, the annulus 322 between the collet 254 of the plug assembly 158 and the actuation housing 150, the one or more fluid-actuation ports 182, and the fluid passage 192 (i.e., the annulus between the actuation housing body 162 and the compressible sealing element 152; see FIG. 8), into the gap 188 between the compressible sealing element 152 (or the coupling section 152B thereof) and the piston 204 to apply a downhole actuation force 324 to the piston 204. As a result, the piston 204 or more specifically the cone-shaped downhole end 244 thereof, engages the chamfer 216 of the slip 160 to radially outwardly actuate the slip 160 against the inner surface of the valve assembly 102 or that of the casing string 306' downhole thereto.

As shown in FIG. 19E, the pressurized fluid 318 may leak (as indicated by the broken-line arrow 320 therein) at the flow restriction 172-280 to the uphole side thereof due to the small gap thereof. However, as the gap at the flow restriction 172-280 is sufficiently small (e.g., 0.005" to 0.015" clearance), the pressure drop caused by the leak is small and the hydraulic pressure applied to the uphole end of the piston 204 is sufficient for radially outwardly extending the slips 160 and maintaining the radially outwardly extended slips 160 for shearing one or more shear pins (not shown) to move the sleeve set 108 uphole. Of course, those skilled in the art will understand that a smaller gap at the flow restriction 172-280 would give rise to a smaller pressure drop at the uphole end of the piston 204.

The leaked fluid 320 may flow through the annulus between the mandrel 276 and the actuation housing 150, and out of the clean-out ports 174 of the actuation housing body 162 into the annulus between the actuation assembly 110 and the sleeve set 108 for circulation.

As shown in FIG. 19F, when the slips 160 move to a location radially about the actuation groove 142, the piston 204, under the downhole actuation force 324 of the pressurized fluid 318, radially outwardly actuates the slips 160 into the actuation groove 142.

As shown in FIG. 19G, the actuation assembly 110 is further pulled uphole while the pressurized fluid 318 is maintained. The slips 160 engages the uphole edge of the actuation groove 142 and slides the sleeve set 108 uphole until the uphole sliding sleeve 108A engages the uphole stopper 132 of the valve assembly 102. The external gland snap-ring 138 of the uphole sliding sleeve 108A expands into the retaining groove 136 of the valve housing 122 for retaining the uphole sliding sleeve 108A at the location adjacent the uphole stopper 132.

Stopping the sleeve set 108 causes a tension to the coiled tubing 308 which may be detected at the surface. In response, the actuation assembly 110 is pushed downhole, as shown in FIG. 19H. The ID-reduced section 172 of the actuation housing 150 and the OD-enlarged section 280 of the mandrel 276 are then disengaged and the flow restriction 127-280 therebetween is removed, causing the pressurized fluid 318 to leak therethrough and discharge via the clean-out ports 174 of the actuation housing body 162 into the annulus between the actuation assembly 110 and the sleeve set 108 for circulation. However, the OD of the actuation assembly 110 is moderately smaller than the ID of the sleeve set 108 such that the leak 320' of the pressurized fluid 318 is insignificant (although greater than the leak 320 shown in FIG. 19E) and the pressurized fluid 318 still provides a reduced but sufficient downhole force onto the piston 204 to maintain the slips 160 in the radially outwardly extended configuration and engaging the downhole edge of the actuation groove 142.

Consequently, the actuation assembly 110 pushes the downhole sliding sleeve 108B downhole to engage the downhole stopper 134 of the valve assembly 102. The fracking ports 104 are then opened.

As shown in FIG. 19I, an uphole portion of the actuation assembly 110 is further moved downhole by applying an increased downhole pressure to the actuation assembly 110 (and in particular the actuation housing body 162) through the coiled tubing 308. As the downhole end of the actuation assembly 110 is stopped by the stopper 134, the downhole movement of the actuation housing body 162 compresses the compressible sealing element 152 (via the uphole shoulder 178 thereof) and moves the tongue 186 thereof "under" (i.e., on a radially inward side of) the radially outwardly extended slips 160 to support the slips 160 in position. Meanwhile, the compression of the compressible sealing element 152 causes the compressible sealing element 152 to radially outwardly expand at least at a central portion thereof and engage the inner surface of the downhole sliding sleeve 108B, thereby forming a seal downhole to the fracking ports 104 in the annulus between the valve assembly 102 and the actuation assembly 110 for preventing the fracking fluid from flowing downhole through the valve assembly 102.

As shown in FIG. 19J, after the fracking ports 104 are opened, a high-pressure fracking fluid stream 332 is injected downhole through the annulus 334 between the casing string 306 and the coiled tubing 308 (which is also the annulus between the valve assembly 102 and the actuation assembly 110), and is jetted out through the fracking ports 104 for fracking the formation thereabout. As the actuation coupling 166 is exposed to the fracking fluid stream 332, the actuation coupling 166 may be prone to wear and may be preferably considered a consumable piece that requires regular inspection and replacement.

During fracking, the actuation assembly 110 is under a downhole pressure caused by the high-pressure fracking fluid stream 332. As the actuation assembly 110 is retained in position by the engagement between the downhole edge 142B of the actuation groove 142 and the slips 160, each slip 160 is under an inward force applied to the downhole outward-facing chamfer 220 thereof. However, the tongue 186 under the slips 160 supports the slips 160 against the inward force and improves the pressure-resistance of the actuation assembly 110.

Thus, the downhole edge 142B of the actuation groove 142, the slips 160, and the tongue 186 under the slips 160 provide a load-bearing structure for retaining the actuation assembly 110 in place under the high fracking pressure during the fracking process.

The high-pressure fracking fluid stream 332 reinforces the load-bearing structure. As can be seen from FIG. 19J, the high-pressure fracking fluid stream 332 further pushes the actuation housing body 162 and the tongue 186 thereof towards downhole thereby locking the tongue 186 under the slips 160 to support the slips 160. Moreover, the high-pressure fracking fluid stream 332 further pushes the actuation housing body 162 to maintain the compression of the compressible sealing element 152 thereby reinforcing the seal of the annulus between the actuation assembly 110 and the valve assembly 102.

The plug 252 of the plug assembly 158 is pressed by the high-pressure fracking fluid stream 332 against the plug seat 184 and forms a metal-to-metal seal to prevent the high-pressure fracking fluid stream 332 from flowing further downhole through the bore 106. In some alternative embodiments, the plug 252 may be made of or comprise other suitable material such as elastomer for forming a seal to prevent the high-pressure fracking fluid stream 332 from flowing further downhole through the bore 106.

At the step shown in FIG. 19J, the fluid 318 is maintained and circulates through the clean-out ports 174 thereby preventing the high-pressure fracking fluid stream 332 and in particular the proppants (e.g., sands or solids) thereof from entering the actuation assembly. The fluid 318 also prevents the fracking fluid stream 332 from circulating to the surface through the coiled tubing 308. However, those skilled in the art will appreciate that, in embodiments wherein the high-pressure fracking fluid stream 332 does not comprise any solids, the fluid 318 may be removed at this step.

As shown in FIG. 19K, after fracking, the high-pressure fracking fluid stream 332 is removed or sufficiently reduced. The actuation assembly 110 is pulled uphole with a pressurized fluid 318 injected into the bore thereof. The compressible sealing element 152 is then reset to its original uncompressed configuration. The uphole outward-facing chamfer 218 of each slip 160 engages the uphole edge 142A of the actuation groove 142 and then the tongue 186 of the actuation housing body 162 is moved away from under the slips 160. The actuation assembly 110 thus pulls the downhole sliding sleeve 108B uphole until the downhole sliding sleeve 108B engages the uphole sliding sleeve 108A.

As shown in FIG. 19L, the pressurized fluid 318 is removed and the actuation assembly 110 may be further pulled uphole. The uphole edge 142A of the actuation groove 142 then forces the slips 160 (via the chamfers 218 thereof) to move radially inwardly and configures the slips 160 to the radially inwardly retracted configuration to disengage from the actuation groove 142. The actuation assembly 110 is then moved out of the valve assembly 102 and may be moved to another fracking location for fracking, or pulled out of hole to the surface for completing the fracking process.

By the end of the process of fracking a stage, a pressure differential may form across the compressible sealing element 152 as the pressure "below" (or downhole to) the compressible sealing element 152 is usually higher than the pressure "thereabove" (or uphole thereto). Such a pressure differential across the two ends of the compressible sealing element 152 may maintain the compressible sealing element 152 in a compressed configuration and not allow the compressible sealing element 152 to relax and return to its uncompressed shape, even after the compressive load has been removed. In this case, moving the compressed compressible sealing element 152 elements may cause damage thereto.

Therefore, at the end of the process of fracking a stage, a pressure equalization is required to equalize the pressure between the uphole and downhole ends of the compressible sealing element 152 by pulling the plug 252 away from the seat 184 to allow fluid to flow from downhole through the seat 184 and the clean-out ports 174 (acting as equalization ports) to above the compressible sealing element 152.

Those skilled in the art will appreciate that, in some embodiments, after the fracking ports 104 are opened, the actuation assembly 110 may be pushed downhole for a short distance such that the downhole edge 142B actuates the slips 160 to the radially inwardly retracted configuration. Then, the actuation assembly 110 may be moved to another fracking location.

In the embodiments shown in FIG. 19I, an uphole portion of the actuation assembly 110 is further moved downhole by applying an increased downhole pressure to the actuation assembly 110 (and in particular the actuation housing body 162) through the coiled tubing 308 to move the actuation housing body 162 downhole to compress the compressible sealing element 152 to radially outwardly expand at least at a central portion thereof and to move the tongue 186 thereof "under" the radially outwardly extended slips 160 to support the slips 160 in position. In some alternative embodiments, the step shown in FIG. 19I is not used.

For example, in some alternative embodiments, at the end of step shown in FIG. 19H when the actuation assembly 110 shifts the downhole sliding sleeve 108B downhole to open the fracking ports 104, the downhole movement of the downhole sliding sleeve 108B and the actuation assembly 110 is abruptly stopped by the stopper 134. The momentum of the actuation housing body 162 causes the actuation housing body 162 to further move downhole thereby compressing the compressible sealing element 152 to radially outwardly expand at least at a central portion thereof and moving the tongue 186 thereof "under" the radially outwardly extended slips 160 to support the slips 160 in position.

As another example, in some alternative embodiments, after the step shown in FIG. 19H is performed and the fracking ports 104 are opened, the step shown in FIG. 19J is performed by injecting a high-pressure fracking fluid stream 332 downhole through the annulus 334 between the casing string 306 and the coiled tubing 308 (which is also the annulus between the valve assembly 102 and the actuation assembly 110).

While the high-pressure fracking fluid stream 332 is jetted out through the fracking ports 104 for fracking the formation thereabout, the high-pressure fracking fluid stream 332 also pushes the actuation housing body 162 and the tongue 186 thereof downhole thereby compressing the compressible sealing element 152 to radially outwardly expand at least at a central portion thereof and moving the tongue 186 thereof "under" the radially outwardly extended slips 160 to support the slips 160 in position.

In some alternative embodiments, after the step shown in FIG. 19H is performed and the fracking ports 104 are opened, the actuation assembly 110 is maintained at its current position and the hydraulic pressure of the pressurized fluid 318 is increased. Referring again to FIG. 19E, the increased hydraulic pressure is then applied through the gap 188 to both the piston 204 (which is unmovable at the end of step shown in FIG. 19H) and the downhole coupling section 152B of the compressible sealing element 152 thereby compressing the compressible sealing element 152 to radially outwardly expand at least at a central portion thereof.

During the fracking process, the high-pressure fracking fluid stream 332 locks the tongue 186 under the slips 160 to support the slips 160 and maintains the compression of the compressible sealing element 152 thereby reinforcing the seal of the annulus between the actuation assembly 110 and the valve assembly 102.

In some embodiments similar to that shown in FIG. 18, stages may be fractured in clusters or groups starting from the toe-most cluster of stages and then moving uphole. In fracking each cluster of stages, the actuation assembly 110 first extends into the uphole-most valve assembly 102 to open to fracking ports 104 thereof. Then, the actuation assembly 110 moves downhole to the next valve assembly 102 to open to fracking ports 104 thereof. This process is repeated until the actuation assembly 110 moves to the bottom-most valve assembly 102 of the cluster of stages and all fracking ports 104 in the cluster of stages are opened. Fracking is then conducted in this cluster of stages.

After fracking, the actuation assembly 110 moves uphole through the valve assemblies 102 and in some embodiments may close the fracking ports 104 of each valve assembly 102 while moving therethrough.

FIG. 20 is an example showing fracking a subterranean formation using a valve assembly 102 and an actuation assembly 110 in some embodiments.

In these embodiments, the wellbore 302 may be a vertical well or a horizontal well and may be cased or uncased. The valve assembly 102 is configured to the closed configuration and sandwiched between a pair of sealing components such as a pair of packers 336 which are coupled to a tubing string 338. The tubing string 338 is then extended downhole to a target location 340A in the wellbore 302.

Then, the packers 310 are actuated to seal the annulus between the wellbore 302 and the tubing string 338. An actuation assembly 110 is coupled to a coiled tubing 308 and extended downhole into the valve assembly 102 to open the fracking ports 104 and then the formation 304 about the target location 340A is fractured in a manner similar to FIGS. 19A to 19L and as described above. FIG. 21 shows fracking the formation after the fracking ports 104 are opened (wherein the packers 310 are not shown).

After fracking the formation 304 about target location 340A, the valve assembly 102 may be reconfigured to the closed configuration and move to another location 340B or 340C for further fracking.

As those skilled in the art will appreciate, in various embodiments with suitable stage-isolation means, the fracking stages may be fractured in any suitable order such as from heel to toe, from toe to heel, or in other predefined order. However, it may be required that prior to fracking a stage, all fracking ports 104 uphole thereto to be closed.

In some embodiments, the downhole tool 100 disclosed herein may also be used with a sand-jet perforator uphole thereto for sand-jet perforating a stage in the situation that a screen-out occurs (i.e., the flow path for the fracking fluid stream 332 is plugged in the formation, at the fracking ports, or at another place thereof), such that operators may sand-jet perforate the casing and fracking the formation a few meters uphole to the target fracking location, without abandoning the stage.

In these embodiments, the sand-jet perforator may be a cylinder with four holes (e.g., with a diameter of about 3/16") spaced equally around the circumference thereof. When a screen-out occurs, the actuation assembly 110 actuates the valve assembly 102 and closes the fracking ports 104. Then, a slurry is pumped down the tubing (e.g., at about 500 liters per minute) and jets out from the holes to perforate the casing-string section. A high-pressure fracking fluid stream is then pumped downhole to frack the formation through the newly perforated casing-string section.

The downhole tool 100 disclosed herein has several advantages. For example, the downhole tool 100 disclosed herein generally only has two operational positions (pulling uphole and running downhole), thereby significantly reducing the time for completing a fracking process.

Compared to some prior-art downhole fracking tools, the downhole tool 100 disclosed herein comprises less components and in particular less moving parts with a simpler design.

According to various aspects, the downhole tool 100 disclosed herein provides a plurality of circulation paths with a plurality of flushing holes 224 and 242 (see FIGS. 11 and 12) for preventing debris and solids from accumulating in the downhole tool 100. Consequently, the downhole tool 100 disclosed herein is more robust in complicated downhole environment.

Those skilled in the art will appreciate that alternative embodiments are readily available. For example, referring to FIGS. 15 and 16, in some embodiments, a compressible spring (not shown) may be received in the cylindrical collet 254 in a moderately compressed configuration engaging the plug 252 and the downhole end 282 of the hollow mandrel 276. Consequently, the plug 252 is always pressed by the compressible spring against the plug seat 184 when the actuation assembly 110 is running downhole and when the actuation assembly 110 is pulled uphole.

FIG. 22 shows the downhole 100 in some alternative embodiments. The downhole tool 100 in these embodiments is similar to that shown in FIG. 2, except that in these embodiments, the downhole tool 100 or more specifically the actuation assembly 110 does not comprise a plug assembly 158. Rather, the actuation assembly 110 in this embodiment comprises a metal ball 342 for seating against the plug seat 184 in a manner similar to the plug assembly 158 described above for forming a metal-to-metal seal against the plug seat 184.

FIG. 23 shows the downhole tool 100 in some other embodiments. In these embodiments, the hollow mandrel 276 comprises a plurality of ports 284 for fluid communication with the fluid-actuation ports 182 of the actuation housing body 162, and is coupled to the plug 252 at the downhole end thereof via suitable means such as threading. Correspondingly, the actuation housing body 162 comprises a first circumferential inner ridge 172 suitable for engaging a first OD-enlarged section 280 of the hollow mandrel 276 (same as described above), and a second circumferential inner ridge 352 suitable for engaging a second OD-enlarged section 292 of the hollow mandrel 276 at a location downhole to the ports 284, for forming flow restriction structures and/or seals at the respective locations, when the actuation mandrel assembly 156 is pulled uphole against the circumferential ridge 168 of the actuation housing 150.

Similar to the embodiments described above, when the actuation assembly 110 is pulled uphole and a pressurized fluid is injected into the bore of the hollow mandrel 276, the flow restriction or seal between the first circumferential inner ridge 172 and the first OD-enlarged section 280 of the hollow mandrel 276 and the flow restriction or seal between the second circumferential inner ridge 352 and the second OD-enlarged section 292 of the hollow mandrel 276 downhole to the ports 284 ensure a fluid path to the uphole side of the piston 204 for creating a back pressure thereto to actuate the piston 204 downhole and radially outwardly extend the slips 160. Such flow restriction and seal are removed when the actuation assembly 110 is pushed downhole.

Those skilled in the art will appreciate that in some alternative embodiments similar to that shown in FIG. 23, rather than using a plug 252 coupled to the downhole end of the hollow mandrel 276, a plug assembly 158 or a ball 342 described above may be freely located between the hollow mandrel 276 and the plug seat 184 engageable therewith, as described above.

In above embodiments, the OD-enlarged section 280 of the hollow mandrel 276 is required to have an OD about the same or slightly smaller than the ID of the circumferential inner ridge 172 of the actuation housing body 162 to form a seal or a flow restriction when the actuation assembly 110 is pulled uphole.

FIGS. 24A and 24B show the downhole 100 in another embodiment. The downhole tool 100 in this embodiment is similar to that shown in FIG. 2. However, the OD of the OD-enlarged section 280 of the hollow mandrel 276 in this embodiment may be smaller than the ID of the circumferential inner ridge 172 of the actuation housing body 162. The OD-enlarged section 280 of the hollow mandrel 276 may comprise suitable sealing structure 362 such as a snap ring retained thereto such that the sealing structure 362 would not be removed or eroded from the hollow mandrel 276 by pressurized fluid stream injected downhole or during equalization after a fracking process. When the actuation assembly 110 is pulled uphole, the sealing structure 362 of the hollow mandrel 276 engages the circumferential inner ridge 172 of the actuation housing body 162 to form therebetween a seal or a flow restriction structure with more limited leakage (compared to that of previously-described embodiments).

FIG. 25 shows a downhole tool 100 according to some alternative embodiments. Similar to that shown in FIG. 2, the downhole 100 in these embodiments comprises a valve assembly 102 having a plurality of fracking ports 104 circumferentially distributed on a sidewall thereof and a longitudinal bore 106 extending therethrough, and an actuation assembly 110 movably received in the longitudinal bore 106. The valve assembly 102 is the same as that shown in FIG. 3.

The actuation assembly 110 is similar to that shown in FIG. 6 except that the actuation assembly 110 in this embodiment comprises a button-slip assembly having one or more radially outwardly movable button-slips or button-dogs, and does not comprise any piston 204. Accordingly, the actuation housing body 162 is also slightly different. Below is a detailed description of the actuation assembly 110.

FIG. 26 is a cross-sectional view of the actuation assembly 110. As shown, the actuation assembly 110 comprises an actuation housing 150 receiving a compressible sealing element 152 and a button-slip assembly 402 on an outer surface thereof, and axially movably receiving an actuation mandrel assembly 156 having a plug 252 in a longitudinal bore 106 thereof. The button-slip assembly 402 comprises one or more radially outwardly movable button-slips or button-dogs 404 for actuating the sleeve set 108 between the open and closed configurations to open and close the fracking ports 104 (described later). For example, the button-slips 404 shown in in FIG. 25 are in the radially inwardly retracted configuration and the sleeve set 108 is in the open configuration.

When the button-slips 404 are in the radially inwardly retracted configuration, the actuation assembly 110 has an OD smaller than the ID of the sleeve set 108 to allow the actuation assembly 110 to move therethrough as needed.

The actuation housing 150 is similar to that shown in FIG. 23. As shown in FIGS. 27A and 27B, the actuation housing 150 in these embodiments comprises an actuation housing body 162 coupled on the uphole side thereof to an actuation coupling adaptor 164 which is in turn coupled to an actuation coupling 166 by using suitable coupling means such as threading, bolting, pins, welding, and/or the like. The actuation coupling adaptor 164 forms a circumferential ridge 168 on an inner surface thereof for limiting the uphole movement of the actuation mandrel assembly 154.

The actuation housing body 162 comprises an uphole body section 162A and a downhole body section 162B coupled together using suitable means such as threading, bolting, pins, welding, and/or the like. Similar to the actuation housing body 162 shown in FIG. 7B, the downhole body section 162B extends into the uphole body section 162A and forms a circumferential shoulder for supporting a plug seat 184 received in the uphole body section 162A.

The uphole body section 162A comprises a first circumferential inner ridge 172 for forming a flow restriction against the actuation mandrel assembly 156 to radially outwardly actuate the slips 160 using a fluid pressure (described in more detail later).

On its outer surface, the actuation housing body 162 comprises one or more clean-out ports 174 adjacent an uphole end 128 thereof. Downhole to the clean-out ports 174, the actuation housing body 162 comprises a circumferential recess 176 on the outer surface thereof. The circumferential recess 176 axially extending from an uphole shoulder 178 on the uphole body section 162A to a downhole shoulder 180 on the downhole body section 162B for receiving therein the compressible sealing element 152 and the button-slip assembly 402. The actuation housing body 162 further comprises one or more slip-accessing holes 406 for the one or more button-slips 404 to access, and a second circumferential inner ridge 352 downhole to the slip-accessing holes 406 and suitable for engaging the hollow mandrel 276 when the actuation mandrel assembly 156 is pulled uphole against the circumferential ridge 168 of the actuation housing 150.

FIGS. 28A to 28C show the button-slip assembly 402 having the one or more button-slips 404. FIG. 28A is a plan view of the button-slip assembly 402 with the one or more button slips 404 in the radially outwardly extended configuration; FIG. 28B is a cross-sectional view of the button-slip assembly 402 with the one or more button-slips 404 in the radially outwardly extended configuration; and FIG. 28C is a cross-sectional view of the button-slip assembly 402 with the one or more button-slips 404 in the radially inwardly retracted configuration.

As shown, the button-slip assembly 402 comprises a tubular button-slip holder 422 having a longitudinal bore 106 extending therethrough and one or more slip-recesses 424 (e.g., two sets of eight recesses) on an outer surface of the sidewall thereof for receiving therein the one or more button-slips 404. Each slip-recess 424 has a suitable size of area (e.g., about 1.75 square inches) for providing sufficient force to the sleeve 108B, and is in communication with a reduced-diameter slip-hole 426 at the bottom thereof thereby allowing the respective button-slip 404 to partially move through the sidewall of the button-slip holder 422 into the bore 106.

FIG. 29 is a perspective view of a button-slip 404. The button-slip 404 comprises a head portion 442 with a diameter matching that of the slip-recess 424 and a tail portion 444 with a diameter matching that of the slip-hole 426. The head portion 442 comprises a longitudinal groove 446 on the top surface thereof which divides the head portion 442 into two parts, each part comprising one or more tungsten carbide buttons 448 brazed thereto. The head portion 442 also comprises a circumferential groove 450 on a sidewall thereof for receiving an O-ring for sealing against the slip-recess 424 when the button-slip 404 is installed therein.

Referring back to FIGS. 28A to 28C, to assemble the button-slip assembly 402, an extendable spring 428 is first positioned into a respective slip-recess 424. The one or more button-slips 404 are fit into respective slip-recesses 424 such that the tail portion 444 of each button-slip 404 extends into the extendable spring 428. Each button-slip 404 is then coupled with the respective extendable springs 428. As those skilled in the art will appreciate, the extendable springs 428 bias the button-slip 404 to the radially inwardly retracted configuration and provides a larger and more evenly distributed loading.

A locking bar 430 is then fastened to the button-slip holder 422 overlapping the grooves 446 of one or more longitudinally aligned button-slips 404 by using suitable fastening means such as screws 432.

FIG. 30 shows the actuation mandrel assembly 156 which is similar to that shown in FIG. 23. In particular, the actuation mandrel assembly 156 is coupled to a plug 252 at a downhole end thereof, and comprises a circumferential ridge 280 for engaging the first circumferential inner ridge 172 of the actuation housing body 162. The actuation mandrel assembly 156 also comprises a plurality of openings 284 at a suitable longitudinal location such that plurality of openings 284 are between the first and second circumferential inner ridges 172 and 352 of the actuation housing body 162 when the actuation assembly 110 is pulled uphole against the circumferential ridge 168 of the actuation housing 150.

The downhole tool 100 in these embodiments may be operated in a similar manner as shown in FIGS. 19A to 19L and described above. FIGS. 31A to 31J show a fracking process using the downhole tool 100 in these embodiments.

Similar to the first stage shown in FIG. 19A, the valve assembly 102 is prepared by configuring the sleeve set 108 thereof in the closed configuration thereby closing the one or more fracking ports 104. The valve assembly 102 is coupled to the casing string 306 and positioned in the wellbore 302 at a target fracking location for fracking the subterranean formation. The casing string 306 may be cemented or uncemented.

As shown in FIG. 31A, in a stage similar to that shown in FIG. 19B, the actuation assembly 110 is is coupled to a coiled tubing 308 and is pushed downhole as indicated by the arrow 314. The button-slips 404 of the downhole tool 100 are biased by the extendable springs 428 to the radially inwardly retracted configuration, in which the tail portion of each button-slip 404 is extended into the respective slip-accessing hole 406.

As shown in FIG. 31B, in a stage similar to that shown in FIG. 19C, after the actuation assembly 110 has run to a location in the wellbore 302 sufficiently downhole to the target fracking location, the actuation assembly 110 is pulled uphole as indicated by the arrow 316.

As shown in FIG. 31C, in a stage similar to that shown in FIG. 19D, while the actuation assembly 110 is pulled uphole (indicated by the arrow 316), a pressurized fluid 318 is injected through the coiled tubing 308 and into the longitudinal bore 106 of the actuation assembly 110. With the flow restriction structures or seals established uphole and downhole to the openings 284 as described above, the pressurized fluid 318 flows through the openings 284 and slip-accessing holes 406 and applies a radially outward force to the button-slips 404 to actuate the button-slips 404 against the inner surface of the valve assembly 102 or that of the casing string 306' downhole thereto.

As shown in FIG. 31D, in a stage similar to that shown in FIG. 19F, when the button-slips 404 move to a location radially about the actuation groove 142, the pressurized fluid 318 overcomes the bias of the extendable springs 428 and radially outwardly actuates the button-slips 404 to the extended configuration. The actuated button-slips 404 then move into and engage the groove 142.

As shown in FIG. 31E, in a stage similar to that shown in FIG. 19G, the actuation assembly 110 is further pulled uphole (indicated by the arrow 316) while the pressurized fluid 318 is maintained. With the engagement between the button-slips 404 and the groove 142, the actuation assembly 110 moves the sleeve set 108 uphole.

As shown in FIG. 31F, in a stage similar to that shown in FIG. 19H, the actuation assembly 110 is pushed downhole (indicated by the arrow 314) while the pressurized fluid 318 is maintained. Similar to FIG. 19H, the leak 320' of the pressurized fluid 318 is relatively small and the pressurized fluid 318 still provides a reduced but sufficient downhole force onto the button-slips 404 to maintain the button-slips 404 in the radially outwardly extended configuration and engaging the downhole edge of the actuation groove 142 to move the downhole sliding sleeve 108B to the downhole position engaging the downhole stopper 134 of the valve assembly 102. The fracking ports 104 are then opened.

As shown in FIG. 31G, in a stage similar to that shown in FIG. 19I, an uphole portion of the actuation assembly 110 is further moved downhole. The actuation housing body 162 then compresses the compressible sealing element 152 (via the uphole shoulder 178 thereof) and further moves downhole while the button-slips 404 are stopped by the downhole stopper 134 of the valve assembly 102. Consequently, the slip-accessing holes 406 are misaligned with the slip-hole 426, and the button-slips 404 (in particular the tail portions of the button-slips 404) are supported by the actuation housing body 162. Meanwhile, the compression of the compressible sealing element 152 causes the compressible sealing element 152 to radially outwardly expand at least at a central portion thereof and engage the inner surface of the downhole sliding sleeve 108B, thereby forming a seal for preventing the fracking fluid 332 from flow further downhole in the bore 106.

As shown in FIG. 31H, in a stage similar to that shown in FIG. 19J, after the fracking ports 104 are opened, a high-pressure fracking fluid stream 332 is injected downhole through the annulus 334 between the valve assembly 102 and the actuation assembly 110 (which is also the annulus between the casing string 306 and the coiled tubing 308), and is jetted out through the fracking ports 104 for fracking the formation thereabout. As the actuation coupling 166 is exposed to the fracking fluid stream 332, the actuation coupling 166 may be prone to wear and may be preferably considered a consumable piece that requires regular inspection and replacement.

The high-pressure fracking fluid stream 332 also applies a downhole pressure to the actuation assembly 110.

The downhole edge 142B of the actuation groove 142, the button-slip 404, and the actuation housing body 162 under the button-slip 404 provide a load-bearing structure for retaining the actuation assembly 110 in place under the high fracking pressure during the fracking process. The plug 252 is pressed against the plug seat 184 and forms a metal-to-metal seal to prevent the high-pressure fracking fluid stream 332 from flowing further downhole through the bore 106. As described above, in some alternative embodiments, the plug 252 may be made of or comprise other suitable material such as elastomer for forming a seal to prevent the high-pressure fracking fluid stream 332 from flowing further downhole through the bore 106.

At the step shown in FIG. 31H, the fluid 318 is maintained and circulates through the clean-out ports 174 thereby preventing the high-pressure fracking fluid stream 332 and in particular the sands or solids thereof from entering the actuation assembly. However, those skilled in the art will appreciate that, in embodiments wherein the high-pressure fracking fluid stream 332 does not comprise any solids, the fluid 318 may be removed at this step when the high-pressure fracking fluid stream 332 is injected downhole for fracking.

As shown in FIG. 31I, in a stage similar to that shown in FIG. 19K, after fracking, the high-pressure fracking fluid stream 332 is removed or sufficiently reduced. The actuation assembly 110 is pulled uphole with a pressurized fluid 318 injected into the bore thereof. The compressible sealing element 152 is then reset to its original uncompressed configuration and the slip-accessing holes 406 and the slip-hole 426 are re-aligned. The pressurized fluid 318 maintains the button-slips 404 engaging the actuation groove 142. The actuation assembly 110 thus pulls the downhole sliding sleeve 108B uphole until the downhole sliding sleeve 108B engages the uphole sliding sleeve 108A.

As shown in FIG. 31J, in a stage similar to that shown in FIG. 19L, the actuation assembly 110 is further pulled uphole with the pressurized fluid 318 removed. The springs 428 then bias the button-slips 404 to the inwardly retracted configuration thereby disengaging the button-slips 404 from the actuation groove 142. The actuation assembly 110 is then moved out of the valve assembly 102 and may be moved to another fracking location for fracking, or pulled out of hole to the surface for completing the fracking process.

Other alternative embodiments are also readily available. For example, while in above embodiments the actuation assembly 110 comprises a slip assembly 154/402 for engaging a circumferential actuation groove 142 of the sleeve set 108, in some alternative embodiments the slip assembly 154/402 and the circumferential actuation groove 142 may comprise matching profiles. The sleeve sets 108 of different valve assemblies 102 may comprise different sleeve-profiles each may only match the slip-profile of one slip assembly 154/402. In this manner, a plurality of valve assemblies 102 may be used, and may be selectively actuated to the open configuration by selectively using an actuation assembly 110 having a corresponding slip-profile.

In another embodiment wherein button-slips 404 are used, the downhole sleeve 108B may comprise a plurality of circumferential actuation-grooves each having a width matching the diameter of a corresponding button-slip 404. The actuation-grooves of different valve assembly 102 may have different widths and/or spacing thereby giving rise to different sleeve-profiles. Each profile only matches one actuation assembly 110 having button-slips 404 with corresponding diameters and/or spacing.

Although in above embodiments the button-slips 404 may comprise tungsten carbide buttons 448, in some embodiments, at least some button-slips 404 may not comprise any tungsten carbide buttons 448.

FIG. 32 is a perspective view of a button-slip 404 in some embodiments. The button-slip 404 is similar to that shown in FIG. 29 except that the button-slip 404 in these embodiments comprises one or more spring-holes 450 in the groove 446.

As shown in FIGS. 33A and 33B, the button-slip assembly 402 in these embodiments comprises one or more compressible springs 452 extending from the bar 430 into respective spring-holes 450 for biasing the button-slips 404 to the radially inwardly retracted configuration. Similar to the embodiments shown in FIGS. 25 to 31E, the button-slips 404 may be actuated by hydraulic pressure to the radially outwardly extended configuration for actuating the sleeve set 108.

Although in above embodiments, the actuation groove 142 is used for actuating the sleeve set 108, in some embodiments, the downhole sliding sleeve 108B does not comprise any actuation groove 142. In these embodiments, the actuation assembly 110 comprises one or more spring-biased button-slips 404 having tungsten carbide buttons 448. Moreover, positioning means such as a collar locator may be needed for properly positioning the actuation assembly 110 for fracking. When the actuation assembly 110 is positioned at a proper location, the button-slips 404 are actuated by using a hydraulic pressure as described above to the radially outwardly extended configuration. The tungsten carbide buttons 448 thereof may "bite" into the downhole sliding sleeve 108B for engaging and moving the sleeve set 108. As described above, after the hydraulic pressure is removed, the springs may bias the button-slips 404 to the radially inwardly retracted configuration.

In some embodiments, the actuation assembly 110 may not comprise the compressible sealing element 152. Rather, the actuation assembly 110 may comprise other suitable compressible-element such as an axially compressible spring for, when under a predetermined downhole pressure, actuating the tongue downhole under the slips 160 to support the slips 160. However, additional means is required for forming a seal downhole to the fracking ports 104 in the annulus between the valve assembly 102 and the actuation assembly 110 for preventing the fracking fluid from flowing downhole through the valve assembly 102.

In some embodiments, the actuation assembly 110 may not comprise the compressible sealing element 152 or other suitable compressible-element. The actuation housing body 162 and the tongue 186 thereof may still be actuated downhole to move the tongue 186 under the slips 160 to support the slips 160. However, additional means is required for forming a seal downhole to the fracking ports 104 in the annulus between the valve assembly 102 and the actuation assembly 110 for preventing the fracking fluid from flowing downhole through the valve assembly 102.

Although in above embodiments, the sleeve set 108 comprises an uphole sliding sleeve 108A and a downhole sliding sleeve 108B, in some alternative embodiments as shown in FIG. 34, the sleeve set 108 may not comprise an uphole sliding sleeve 108A.

In these embodiments, the sleeve set 108 only comprise the downhole sliding sleeve 108B (simply denoted the sliding sleeve 108B hereinafter) which is initially secured by a shear pin (not shown) at an uphole position with a small distance to the uphole stopper 132 for closing the fracking ports 104. A gap 502 is thus formed between the sliding sleeve 108B and the downhole stopper 134.

As shown in FIG. 35A, an actuation assembly 110 as described above (with the slips 160 or button-slips 404 in the radially inwardly retracted configuration) runs downhole passing the valve assembly 102.

As shown in FIG. 35B, the actuation assembly 110 is then pulled uphole with a pressurized fluid 318 injecting into the bore 106 of the actuation mandrel assembly 156. The one or more slips 160 or button-slips 404 are actuated to the radially outwardly extended configuration, move into the gap 502, and engage the downhole end of the sliding sleeve 108B.

As shown in FIG. 35C, with pressurized fluid 318 maintained, the actuation assembly 110 is pulled uphole to shear the shear pin of the sliding sleeve 108B. The sliding sleeve 108B is slightly moved uphole.

Then as shown in FIG. 35D, the pressurized fluid 318 is removed and the actuation assembly 110 is further pulled uphole to configure the one or more slips 160 or button-slips 404 to the radially inwardly retracted configuration, at which time the actuation assembly 110 may "jump" uphole due to the tension in the coiled tubing. As a result, the actuation assembly 110 and specifically the one or more slips 160 or button-slips 404 are located slightly uphole of the actuation groove 142.

As shown in FIG. 35E, the actuation assembly 110 is then pushed downhole with the pressurized fluid 318 applied. The one or more slips 160 or button-slips 404 are then actuated to the radially outwardly extended configuration and engage the actuation groove 142.

As shown in FIG. 35F, the actuation assembly 110 then slides the sliding sleeve 108B downhole to open the fracking ports 104.

As shown in FIG. 35G, the actuation assembly 110 may move further downhole to compress the compressible sealing element 152 and extend a portion of the actuation housing 150 or more specifically a portion of the actuation housing body 162 on an inward side of the one or more slips 160 or button-slips 404 for supporting the one or more slips 160 or button-slips 404 at the radially outwardly extended configuration. Fracking is then conducted (FIG. 35H).

As shown in FIG. 35I, after fracking, the actuation assembly 110 may be pulled uphole (meanwhile, the pressurized fluid 318 may be maintained or removed) to reset the compressible sealing element 152 to its original uncompressed configuration and slide the sliding sleeve 108B uphole to close the fracking ports 104.

As shown in FIG. 35J, the actuation assembly 110 may be further pulled uphole with the pressurized fluid 318 removed to reset the one or more slips 160 or button-slips 404 to the radially inwardly retracted configuration. Then, the actuation assembly 110 may be pulled uphole to the next fracking location or to the surface.

The downhole tool 100 in the embodiments shown in FIG. 34, including both the valve assembly 102 and the actuation assembly 110, may be shorter in length compared to prior-art downhole fracking tools, thereby significantly reducing the manufacturing cost and causing less burden to operators.

In some embodiments related to those shown in FIG. 36, the sliding sleeve 108B also comprises a J-slot 504 engaging a J-pin (not shown) on the inner surface of the valve housing 122 for preventing the sliding sleeve 108B from being prematurely or accidentally actuated by a downward stroke for example during cementing operations and opening the fracking ports 104.

The J-slot 504 comprises an initial location $P_1$ for engaging the J-pin when the sliding sleeve 108B is in the closed configuration. The location $P_1$ is connected to an intermediate location $P_2$ at a small distance downhole thereto, which in turn connected to an end position $P_3$ at a large distance uphole thereto. Therefore, the initial location of the J-pin in position $P_1$ prevents any downhole movement of the sliding sleeve 108B, thereby preventing the sliding sleeve 108B from being prematurely or accidentally actuated by a downward stroke to the open configuration and opening the fracking ports 104.

The transition of the J-pin from position $P_1$ to $P_2$ corresponds to the above-described uphole actuation of the sliding sleeve 108B for shearing the shear pin. The transition of the J-pin from position $P_2$ to $P_3$ corresponds to the above-described subsequent downhole actuation of the sliding sleeve 108B to the open configuration and opening the fracking ports 104.

In some embodiments, an indexing J-slot wrapping around the circumference of the sliding-sleeve 108B may be used for locking the sliding sleeve 108B at the open configuration for opening the plurality of ports. In some embodiments, such an indexing J-slot may comprise a plurality of positions for locking and preventing the sliding-sleeve 108B from moving uphole or downhole. The indexing J-slot may also have positions to allow the sliding sleeve 108B to at least partially open the fracking ports 104 in various stages (e.g., configuring the fracking ports 104 to fully open, 75% open, 50% open, or open to any other port-opening percentage, based on the position of the sleeve and determined by the profile of the indexing J-slot, thereby providing a choke or flow control. In these embodiments, the downhole sliding sleeve 108B is essentially a flow control device.

FIG. 37 is a cross-sectional view of a downhole tool 100 in some alternative embodiments. Similar to that shown in FIG. 34, the sleeve set 108 of the downhole tool 100 only comprise one sliding sleeve 108B. However, in these embodiments, the sliding sleeve 108B is initially positioned at a downhole position for closing the fracking ports 104 of the valve housing 122. The sliding sleeve 108B comprises one or more fracking ports or apertures 522 at locations corresponding to those of the fracking ports 104 when the sliding sleeve 108B is at an uphole open position.

The sliding sleeve 108B also comprises a set of ratchet threads (not shown) about the uphole end thereof for engaging a set of ratchet threads (not shown) on the valve housing 122 about the uphole stopper 132.

The same actuation assembly 110 as described in above embodiments may be used for actuating the sliding sleeve 108B from the downhole closed position to the uphole open position.

As shown in FIG. 38A, the actuation assembly 110 (with the slips 160 or button-slips 404 in the radially inwardly retracted configuration) runs downhole passing the valve assembly 102.

As shown in FIG. 38B, the actuation assembly 110 is then pulled uphole with a pressurized fluid 318 injecting into the bore 106 of the actuation mandrel assembly 156. The one or more slips 160 or button-slips 404 are actuated to the radially outwardly extended configuration, move into the actuation groove 142 and engage therewith.

With pressurized fluid 318 maintained, the actuation assembly 110 is further pulled uphole to shift the sliding sleeve 108B to the uphole open position. The ratchet threads of the sliding sleeve 108B then engage the ratchet threads of the valve housing 122 to lock the sliding sleeve 108B at the uphole open position.

As shown in FIG. 38C, the fracking apertures 522 of the sliding sleeve 108B are aligned with the fracking ports 104 of the valve housing 122. A high-pressure fracking fluid stream 332 is injected downhole through the annulus 334 between the casing string 306 and the coiled tubing 308 (which is also the annulus between the valve assembly 102 and the actuation assembly 110), and is jetted out through the fracking ports 104 for fracking the formation thereabout.

As shown in FIG. 38D, the high-pressure fracking fluid stream 332 may push the actuation assembly 110 slightly downhole. Moreover, the high-pressure fracking fluid stream 332 also pushes the actuation assembly 110 to compress the compressible sealing element 152 and extend a portion of the actuation housing 150 or more specifically a portion of the actuation housing body 162 on an inward side of the one or more slips 160 or button-slips 404 for supporting the one or more slips 160 or button-slips 404 at the radially outwardly extended configuration.

After fracking, the actuation assembly 110 may be pulled uphole to reset the compressible sealing element 152 to its original uncompressed configuration and slide the actuation assembly 110 uphole to the next fracking location or to the surface.

In above embodiments, a plug 252 or ball 342 is used to block (fully or with a small amount of leak) the fluid communication between the bore of the actuation assembly 110 and the wellbore downhole thereto. In some alternative embodiments, a check valve such as a flapper valve may be used for blocking the fluid communication between the bore of the actuation assembly 110 and the wellbore downhole thereto.

Those skilled the art will appreciate that the apparatus, system, and method described in above embodiments are for illustrative purpose only, and variations and modifications are readily available, which in various embodiments, may be a combination and/or permutation of different structural components, method steps, features, and/or the like of the apparatus, system, and method described in above embodiments.

For example, in some embodiments, a method of fracking a subterranean formation about a section of a wellbore may comprise the steps of:

locating a valve assembly in said section of the wellbore, said valve assembly having a valve body and a first sliding sleeve slidably received in a longitudinal bore thereof, the valve body having at least one fracking port, the first sliding sleeve comprising a circumferential actuation groove, and the first sliding sleeve being secured at an uphole or downhole position covering the at least one fracking port and at a distance to a respective uphole or downhole shoulder of the valve body;

running an actuation assembly downhole to pass the valve assembly, said actuation assembly comprising one or more slips reconfigurably in a radially inwardly retracted configuration;

pulling the actuation assembly uphole;

while pulling the actuation assembly uphole, actuating the one or more slips radially outwardly to a radially outwardly extended configuration so as to engage a downhole end of the first sliding sleeve;

continuing to move the actuation assembly uphole or downhole to slide the first sliding sleeve to open the at least one fracking port;

further moving an uphole portion of the actuation assembly downhole to position a supporting structure on the radially inward side of the one or more slips for supporting the one or more slips at the radially outwardly extended configuration; and fracking the formation by injecting a fracking fluid stream downhole and jetting the fracking fluid stream through the at least one fracking port into the formation.

Although embodiments have been described above with reference to the accompanying drawings, those of skill in the art will appreciate that variations and modifications may be made without departing from the scope thereof as defined by the appended claims.

What is claimed is:

1. A downhole valve comprising:

a valve body having a longitudinal bore extending therethrough, an uphole shoulder and a downhole shoulder in the longitudinal bore, and at least one port on a sidewall of the valve body and intermediate the uphole and downhole shoulders; and a sliding-sleeve set received in the bore of the valve body and slidable between the uphole and downhole shoulders thereof for configuring the sliding-sleeve set between a closed configuration for closing the at least one port and an open configuration for opening the at least one port;

wherein the sliding-sleeve set comprises an uphole sliding sleeve and a downhole sliding sleeve each longitudinally slidable within the longitudinal bore of the valve body;

wherein the sliding-sleeve set is in the closed configuration when the downhole sliding sleeve contacts the downhole shoulder of the valve body and the uphole sliding sleeve and the downhole sliding sleeve are in contact with each other;

wherein the sliding-sleeve set is in the open configuration when the downhole sliding sleeve contacts the downhole shoulder of the valve body and the uphole sliding sleeve contacts the uphole shoulder of the valve body;

wherein the sliding-sleeve set is in an additional closed configuration when the uphole sliding sleeve contacts the uphole shoulder of the valve body and the downhole sliding sleeve contacts the uphole sliding sleeve; and wherein the sliding-sleeve set comprises an actuation structure for engaging an actuation assembly for being actuated by the actuation assembly from the closed configuration to the additional closed configuration and to the open configuration.

2. The downhole valve as claimed in claim 1, wherein the downhole sliding sleeve comprises the actuation structure.

3. The downhole valve as claimed in claim 1 or 2 further comprising the actuation assembly for engaging the sliding-sleeve set and actuating the sliding-sleeve set to the additional closed configuration and to the open configuration;

wherein the actuation assembly comprises one or more radially outwardly movable slips or dogs; and wherein the actuation structure comprises a circumferential groove for engaging the one or more slips or dogs when the one or more slips or dogs are radially outwardly extended.

4. The downhole valve as claimed in claim 3, wherein the actuation assembly comprises a fluid path for directing a pressurized fluid to radially outwardly actuate the one or more slips or dogs.

5. A downhole valve comprising:

a valve body having a given longitudinal bore extending therethrough, and at least one port at a longitudinal location therealong circumferentially spaced about a sidewall thereof; and a sliding-sleeve set slidably received in the bore of the valve body and comprising an uphole sliding sleeve and a downhole sliding sleeve;

wherein the sliding-sleeve set is in a closed configuration for closing the at least one port when the downhole sliding sleeve is at a downhole position in the valve body and the uphole sliding sleeve engages the downhole sliding sleeve;

wherein the sliding-sleeve set is in an open configuration for opening the at least one port when the downhole sliding sleeve is at the downhole position in the valve body and the uphole sliding sleeve is at an uphole position in the valve body;

wherein the sliding-sleeve set is in an additional closed configuration when the uphole sliding sleeve is at the uphole position in the valve body and the downhole sliding sleeve engages the uphole sliding sleeve and covers said at least one port; and wherein the sliding-sleeve set comprises an actuation structure for engaging an actuation assembly for being actuated by the actuation assembly from the closed configuration to the additional closed configuration and to the open configuration.

6. The downhole valve as claimed in claim 5, wherein the downhole sliding sleeve comprises the actuation structure.

7. The downhole valve as claimed in claim 5 or 6 further comprising the actuation assembly for engaging the sliding-sleeve set and actuating the sliding-sleeve set to the additional closed configuration and to the open configuration;

wherein the actuation assembly comprises one or more radially outwardly movable slips or dogs; and wherein the actuation structure comprises a circumferential groove for engaging the one or more slips or dogs when the one or more slips or dogs are radially outwardly extended.

8. The downhole valve as claimed in claim 7, wherein the actuation assembly comprises a fluid path for directing a pressurized fluid to radially outwardly actuate the one or more slips or dogs.

* * * * *